US006881528B2

(12) United States Patent
Daimon et al.

(10) Patent No.: US 6,881,528 B2
(45) Date of Patent: Apr. 19, 2005

(54) IMAGE FORMATION METHOD

(75) Inventors: Katsumi Daimon, Minamiashigara (JP); Takashi Imai, Minamiashigara (JP); Katsumi Nukada, Minamiashigara (JP); Wataru Yamada, Minamiashigara (JP)

(73) Assignee: Fuji Xerox, Co., Ltd., Tokyo (JP)

( * ) Notice: Subject to any disclaimer, the term of this patent is extended or adjusted under 35 U.S.C. 154(b) by 0 days.

(21) Appl. No.: 10/077,949

(22) Filed: Feb. 20, 2002

(65) Prior Publication Data

US 2003/0190545 A1 Oct. 9, 2003

(30) Foreign Application Priority Data

Sep. 20, 2001 (JP) ..... 2001-287914

(51) Int. Cl.[7] ..... G03G 13/20

(52) U.S. Cl. ..... 430/124; 430/582; 430/66; 430/109.4; 430/111.4

(58) Field of Search ..... 430/124, 126, 430/58.2, 66, 109.4, 111.4

(56) References Cited

U.S. PATENT DOCUMENTS

| | | | | |
|---|---|---|---|---|
| 4,801,517 A | | 1/1989 | Frechet et al. | 430/73 |
| 4,891,293 A | * | 1/1990 | Sacripante et al. | 430/109.4 |
| 6,569,592 B1 | * | 5/2003 | Ishihara et al. | 430/124 |
| 6,582,869 B1 | * | 6/2003 | Daimon et al. | 430/109.4 |
| 6,607,864 B1 | * | 8/2003 | Serizawa et al. | 430/124 |
| 2002/0018952 A1 | * | 2/2002 | Daimon et al. | 430/109.4 |

FOREIGN PATENT DOCUMENTS

| | | | |
|---|---|---|---|
| JP | 47-30330 | | 11/1972 |
| JP | B2 4-24702 | | 4/1992 |
| JP | A 4-198376 | | 7/1992 |
| JP | A 5-43813 | | 2/1993 |
| JP | A 5-98181 | | 4/1993 |
| JP | A 5-140472 | | 6/1993 |
| JP | A 5-140473 | | 6/1993 |
| JP | A 5-263007 | | 10/1993 |
| JP | A 5-279591 | | 10/1993 |
| JP | A 6-250423 | | 9/1994 |
| JP | A 6-282092 | | 10/1994 |
| JP | A 6-282093 | | 10/1994 |
| JP | A 8-176293 | | 7/1996 |
| JP | A 8-208820 | | 8/1996 |
| JP | A 8-278653 | | 10/1996 |
| JP | A 9-304972 | | 11/1997 |
| JP | A 11-38656 | | 2/1999 |
| JP | A 11-184106 | | 7/1999 |
| JP | A 11-316468 | | 11/1999 |
| JP | A 2000-250259 | | 9/2000 |
| JP | 2001-249478 | * | 9/2001 |

OTHER PUBLICATIONS

Japanese Patent Office Machine–Assisted Translation of JP 2001–249478 (pub. Sep. 14, 2001).*

Japanese Patent Office Machine–Assisted Translation of JP 11–18106 (pub. Jul. 9, 1999).*

Trademark Electronic Search System (Tess), Serial No. 72062272, printed on Jul. 10, 2004.*

Sakamoto, Shuji and Morishita, Hironobu, "Denshi shashin kankotai zairyo", Electrophotographic Photoconductor Materials, Idemitsu giho, vol. 36, No. 2, pp. 88–94, 1993.

* cited by examiner

*Primary Examiner*—Janis L. Dote
(74) *Attorney, Agent, or Firm*—Oliff & Berridge, PLC

(57) ABSTRACT

An electrophotographic photoreceptor with excellent wear resistance and high durability, and an image formation method having a high toner transferring efficiency and capable of providing images with high quality. The image formation method features a developing step of forming a toner image by developing an electrostatic latent image formed on the surface of a latent image carrier by a developer containing at least a toner, a transferring step of forming a transferred image by transferring the toner image formed on the surface of the latent image carrier to the surface of an object recording medium, and a fixing step of fixing the toner image transferred on the surface of the object recording medium. The latent image carrier has a surface layer containing a cross-linked resin having charge transporting property, and the toner is a toner containing at least a binder resin of mainly a crystalline resin and a coloring agent.

11 Claims, 5 Drawing Sheets

IMAGE FORMATION METHOD

BACKGROUND OF THE INVENTION

1. Field of Invention

The present invention relates to an image formation method applicable for electrophotographic apparatuses such as a copying apparatus, a printer, a facsimile and the like which use electrophotographic processes.

2. Description of Related Art

Conventionally, there have been many methods as an image formation method using the electrophotographic process and in a copying apparatus, a printer and the like, a method generally employed is a method comprising steps of forming an image on an electrophotographic photoreceptor by charging, exposing, and developing processes and transferring the obtained image to an object recording medium and fixing the image to obtain a copying image.

Recently, in the investigation and the development of the electrophotographic process and a material for the electrophotography, forming a link in the chain of tackling the environmental problems, technological developments have positively been achieved aiming to save energy, save resources and the like. Among the developments, for the purpose to save resources, investigations aiming to prolong lives of various members have positively been performed and also regarding a photoreceptor, it has highly been expected to further improve the durability of the photoreceptor.

As a photoreceptor, in place of a conventional inorganic photoreceptor, a variety of organic photoreceptors economical and excellent in the producibility and disposal property have practically been employed and in general, as one important factor to determine the life of an organic photoreceptor, there is wear of the surface layer. Regarding presently existing organic photoreceptors, so-called layered type ones comprising a charge transporting layer layered on a generating layer are the main stream and, in many cases, the charge transporting layer is to be the surface layer. However, regarding the charge transporting layers employed mainly today, although those with satisfactory functions in terms of the electric properties have been made available, a large quantity of compounds with low molecular weight compounds are dispersed in a binder resin and for that the original mechanical capabilities of the binder resin are deteriorated to result in a defect that the charge transporting layers have inevitably been weak in the wear.

Hence, a variety of proposals have been disclosed as the method for improving the mechanical strength of a charge transporting layer: 1) addition of a hard fine particle (Japanese Patent Application Laid-Open (JP-A) No. 6-282093); 2) addition of a substance for decreasing the surface energy such as silicone oil and the like; 3) modification of a binder resin (Idemitsu Technological Method, 36 (2), 88 (1993)) and the like; 4) formation of an overcoat layer on a charge transporting layer (e.g., JP-A No. 6-282092); 5) utilization of a charge transporting polymer compound (the specification of U.S. Pat. No. 4,801,517 and the like); and 6) curing of a charge transporting layer (JP-A No. 6-250423 and the like).

However, since the methods of the above-described 1) to 3) basically employ a binder resin in which low molecular weight compounds are dispersed, remarkable improvement in the mechanical strength cannot be expected. Further, the overcoat layer in the method of 4) contributes to decrease of the wear loss, yet it has a problem that an image is easily fogged especially under a high humidity since a conductive powder is dispersed in the binder resin. Meanwhile, in the case of the methods of 5) and 6), if a charge transporting polymer compound having sufficient capabilities is employed, the methods have an advantage that it is not necessary to disperse low molecular weight compounds, resulting in not only remarkable improvement of the mechanical properties but also applicability of conventional production facilities. Especially, in the method disclosed in the JP-A No. 6-250423, a charge transporting polymer compound is three-dimensionally bonded and therefore, further improved effect can be expected. However, in order to obtain such kind of charge transporting polymer compounds, at least one kind of monomers having reactive substituents is required to be synthesized and since the molecular design for improving the charge transporting property is greatly restricted, such a charge transporting polymer compound with sufficient capabilities has not been developed yet.

On the other hand, even in the case of employing a photoreceptor having a highly durable surface layer owing to an overcoating of, for example, a silicone type polymer, in some cases, the transferring efficiency is still deteriorated and a problem occurs in the images, and as a measure to solve such problems, a technique to use a toner in which resin particles are melted and bonded to one another in an aqueous medium is proposed (JP-A No. 2000-250259) and it has been tried to suppress fine powder generation, prevent decrease of the transferring efficiency, and improve the inferior cleaning property by making the toner shape even or making the toner surface irregular. However, no toner is available which does not contain or generate a fine powder at all and a photoreceptor is more or less polluted by adhesion of a fine powder.

Since many of the above-described adhering components are release agents with small molecular weights, there have been proposed methods: a method employing a release agent with a large molecular weight for a toner (JP-A No. 8-278653) and a method for scraping adhering components by a development method by bringing a carrier into contact with the photoreceptor (JP-A No. 9-304972). However, even these techniques cannot be said sufficient to achieve the original purposes without deteriorating other capabilities.

SUMMARY OF THE INVENTION

The present invention has been developed under the above-described conventional technological circumstances. That is, the object of the present invention is to provide an image formation method capable of giving a high toner transferring efficiency and an image with a high image quality while providing an electrophotographic photoreceptor with high wear resistance and high durability.

In order to solve the above-described problems, the following are required. That is, one is, as described above, a photoreceptor having a surface layer which is scarcely worn and highly durable and the other is an image formation technique by which the transferring efficiency and the like is scarcely decreased in the initial or a long time use even if such a highly durable photoreceptor is employed.

As the former, innovative three-dimensionally cross-linked materials have been disclosed in JP-A Nos. 11-38656, 11-184106, 11-316468 and the like and it has proved that these materials have excellent properties. Photoreceptors using them not only have little wear loss but also hardly cause image fogging and thus have excellent durability which conventional ones never have had before.

However, in cases where a photoreceptor having such a highly durable surface layer is used, since polar groups such as unreacted hydroxyl groups and the like remain in the surface layer, adhesive force between the photoreceptor surface and the toner is increased if the toner is of a common type, resulting in the probability of a new problem that transferring efficiency at a time of transferring the toner from the photoreceptor surface to a transfer belt, a transfer drum (an object material to be transferred to), or a sheet of paper (an object material to be recorded on) cannot be increased. Especially, fine powder in the toner is hard to transfer, and cleaning fine powder that remains after transfer is difficult, so that this fine powder causes filming on the photoreceptor surface and appears as whitening and fogging in the image. With regard to the apparatus, it is ideal if the toner on the photoreceptor surface is transferred 100%, making a cleaning system unnecessary. From this point of view, assurance of a high transferring efficiency is greatly desired.

Hence, regarding the above-described image formation technique, considering that approaches to the surface improvement of a toner, the improvement of the particle size distribution and the like are effective, inventors of the present invention have enthusiastically made investigations and consequently found that the following image formation method can solve the above-described problems.

That is, conventionally, in terms of low temperature fixation, a method utilizing a crystalline resin with a low melting point for a binder resin of a toner (Japanese Patent Application Publication (JP-B) No. 4-24702 and the like) has been proposed and if image formation is carried out on the surface of an object transferring material or an object recording medium in combination with the above-described photoreceptor using a toner containing such a crystalline resin as a main component, the transferring efficiency is high and an image with a high quality can be obtained as compared with those in the case of using a toner containing a common non-crystalline resin.

More practically, the means for solving the above-described problems are as follows. That is, according to a first aspect of the present invention, there is provided an image formation method comprising a developing step of forming a toner image by developing an electrostatic latent image formed on the surface of a latent image carrier by a developer containing at least a toner, a transferring step of forming a transferred image by transferring the toner image formed on the surface of the latent image carrier to the surface of an object recording medium, and a fixing step of fixing the toner image transferred on the surface of the object recording medium, wherein the latent image carrier has a surface layer containing a cross-linked resin having charge transporting property and the toner is a toner containing at least a binder resin of mainly a crystalline resin and a coloring agent.

According to a second aspect of the present invention, there is provided an image formation method wherein the cross-linked resin contained in the surface layer of the latent image carrier is a resin containing siloxane bonds.

According to a third aspect of the present invention, there is provided an image formation method wherein the resin containing siloxane bonds is a resin containing a compound represented by the following general formula (I):

$$F—[D—A]_b \qquad \text{General formula (I)}$$

(wherein, the reference character F represents an organic group derived from a photo-functional compound; D represents a flexible organic subunit; A represents a substituent silicon group represented by $—Si(R_1)_{(3-a)}Q_a$; and b represents an integer of 1 to 4, wherein $R_1$ represents hydrogen, an alkyl, or an unsubstituted or substituted aryl; Q represents a hydrolyzable group; and a represents an integer of 1 to 3.).

According to a fourth aspect of the present invention, there is provided an image formation method wherein the organic group F derived from a photo-functional compound in the compound represented by the general formula (I) is an organic group derived from a compound represented by the following general formula (II):

General formula (II)

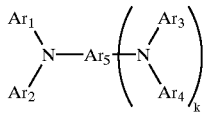

(wherein, the reference characters $Ar_1$ to $Ar_4$ each independently represent a substituted or unsubstituted aryl; $Ar_5$ represents a substituted or unsubstituted aryl or arylene; and incidentally, one to four groups among $Ar_1$ to $Ar_5$ may be bonded with a bonding group represented by —D—A in the above-described general formula (I); and k represents 0 or 1.).

According to a fifth aspect of the present invention, there is provided an image formation method wherein the surface layer of the above-described latent image carrier further contains a compound having a group possible to be bonded with the compound represented by the above-described general formula (I).

According to a sixth aspect of the present invention, there is provided an image formation method wherein the compound having a group possible to be bonded with the compound represented by the above-described general formula (I) is an organosilicon compound represented by the following general formula (III).

$$B—[—A']_n \qquad \text{General formula (III)}$$

(wherein, the reference character A' represents a substituent silicon group having a hydrolyzable group represented by $—Si(R_1)_{(3-a)}Q_a$; B represents at least one group selected from an n-valent hydrocarbon group optionally comprising branches, an n-valent phenyl group, —NH—, and —O—Si— or their combination; a represents an integer of 1 to 3; and n represents an integer of not less than 2.).

According to a seventh aspect of the present invention, there is provided an image formation method wherein the crystalline resin which is the main component of the above-described binder resin is a crystalline polyester resin.

According to an eighth aspect of the present invention, there is provided an image formation method wherein the above-described crystalline polyester resin has the ester concentration M represented by the following expression (2) in a range not lower than 0.01 to not higher than 0.2:

$$M=K/N \qquad \text{expression (2)}$$

(wherein, the reference character M represents the ester concentration; K represents the number of the ester groups in the polymer; and N represents the number of atoms composing the polymer chains of the polymer.).

According to a ninth aspect of the present invention, there is provided an image formation method wherein the melting point of the above-described crystalline resin which is the main component of the binder resin of the toner is 50 to 120° C.

According to a tenth aspect of the present invention, there is provided an image formation method wherein the above-described toner has the storage modulus $G_L(90)$ and the loss modulus $G_N(90)$ at angular frequency of 1 rad/s and 90° C. and the storage modulus $G_L(120)$ and the loss modulus $G_N(120)$ at angular frequency of 1 rad/s and 120° C. all to be not more than $1\times10^5$ Pa and relation between the storage modulus $G_L(90)$ and the storage modulus $G_L(120)$ satisfying the following expression (1):

$$\log G_L(90)-\log G_L(120)<2 \qquad \text{expression (1).}$$

According to an eleventh aspect of the present invention, there is provided an image formation method wherein the above-described toner has a melt viscosity not less than 100 Pa·s at 120° C.

According to a twelfth aspect of the present invention, there is provided an image formation method wherein the above-described toner is produced by any one of production methods selected from an emulsifying and aggregation method, a dissolving and suspending method, and a melting and suspending method.

DETAILED DESCRIPTION OF PREFERRED EMBODIMENTS

Hereinafter, the image formation method of the present invention will be described in details.

The image formation method of the present invention comprises a latent image-forming step of forming an electrostatic latent image on the surface of a latent image carrier, a developing step of forming a toner image by developing the electrostatic latent image formed on the surface of the latent image carrier, a transferring step of forming a transferred image by transferring the toner image formed on the surface of the latent image carrier to the surface of an object recording medium, a fixing step of thermally fixing the toner image transferred on the surface of the object recording medium, and if necessary, a cleaning step of cleaning the toner remaining on the surface of the latent image carrier, wherein the latent image carrier has a surface layer containing a cross-linked resin having charge transporting property and the toner is a toner containing a binder resin of mainly a crystalline resin and a coloring agent. Incidentally, at the time of image formation, both black and white image formation and color image formation may be carried out. Further, the transferring step may be a step of transferring the toner image directly to the object recording medium from the latent image carrier or transferring the toner image once to an intermediate transferring medium (an object transferring medium) from the latent image carrier and then transferring the toner image to the recording medium.

Figure 1:
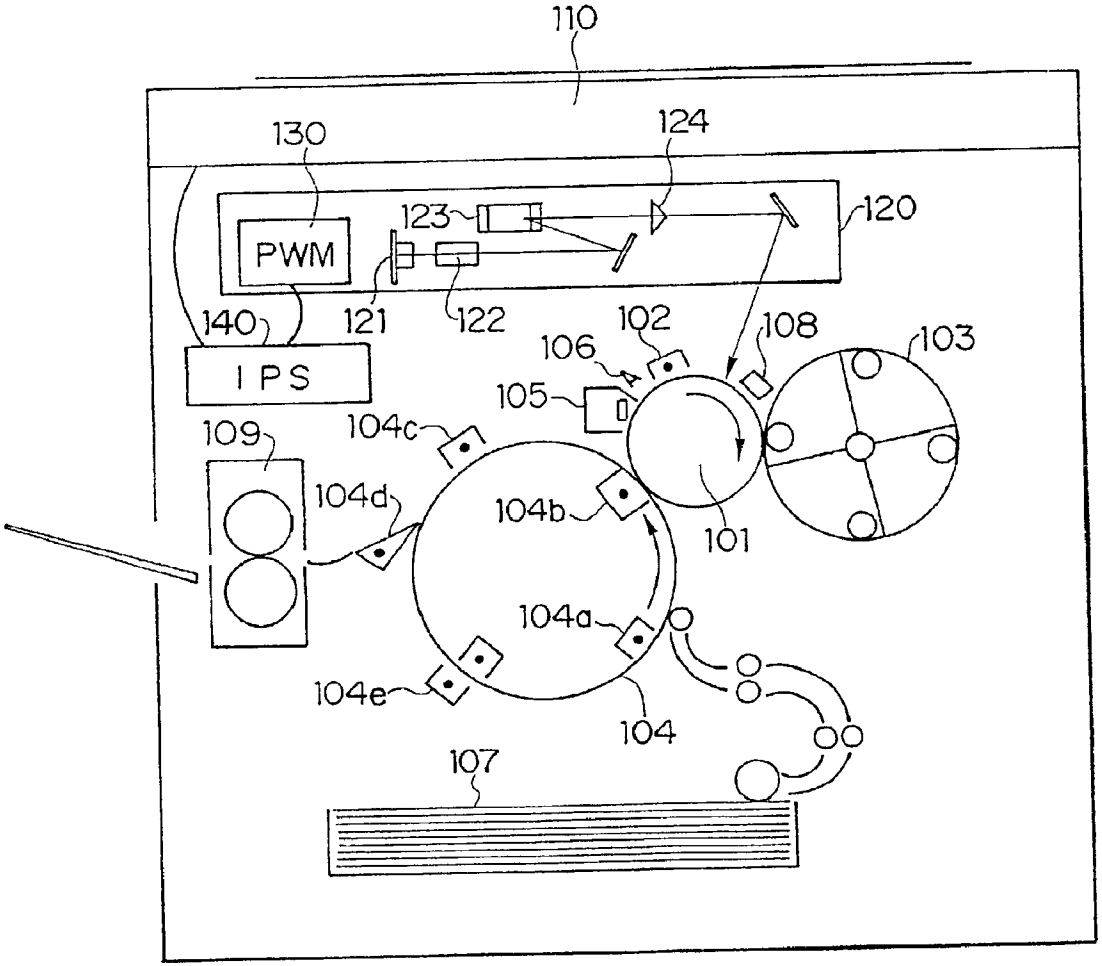
FIG. 1 is one example of an apparatus for carrying out the image formation method of the present invention.

FIG. 1 shows a schematic constitution of one example of an image forming apparatus for carrying out especially a color image formation method among the image formation methods of the present invention. In the circumference of a photoreceptor (a latent image carrier) 101 which rotates in the direction of the arrow, there installed are a charger 102, a rotary developer 103, a transfer drum 104, a cleaner 105, a prior exposure 106, a potential sensor 108, and the like. The photoreceptor 101 is evenly charged by the charger 102 in the dark. The concentration signals for respective colors, R (red), G (green), and B (blue), supplied from an image input apparatus 110 or the like are converted to concentration signals of respective colors, Y (yellow), M (magenta), C (cyan), and K (black) by a color conversion treatment circuit 140 and corresponding to the converted concentration signals, exposure of the photoreceptor 101 is carried out by a light beam scanning apparatus 120 to form an electrostatic latent image. The light beam scanning apparatus 120 comprises a semiconductor laser 121, a collimator lens 122, a polygon mirror 123, an image-forming optical system 124, a light beam pulse width modulation (PWM) circuit 130 and the like and scanning of the photoreceptor 101 is carried out by light beam converted to be pulse width signals corresponding to the concentrations by the light beam PWM circuit 130.

The rotary developer 103 is composed of four developers respectively containing the respective yellow, cyan, magenta, and black toners. In this example, an inversion development method employing a binary magnetic brush development is employed for the respective color development. The rotary developer 103 is properly rotated and develops an electrostatic latent image with desired toners. An alternating electric field is applied to the rotary developer 103 by a development bias circuit which is not illustrated. The development bias circuit is provided with a high voltage a.c. power source to supply a.c. bias current and a high voltage d.c. power source to supply d.c. bias current. The transfer drum 104 is rotated while bearing the object recording medium in the outer circumference. The developed toner image on the photoreceptor surface is transferred to the object recording medium 107 for every color by a transferring charger 104*b* to form a multicolor toner image on the object recording medium. Incidentally, the reference character 104*a* represents a charger for object recording medium absorption, 104*c* represents a charger for separation, 104*d* represents a separation claw, and 104*e* represents a charger for static elimination.

In the image forming apparatus, electrostatic latent image formation, development and transferring are carried out for the respective colors of black, yellow, magenta, and cyan, in this order. The formed toner image on the surface of the object recording medium has a structure in which the toner images of respective colors of black, yellow, magenta, and cyan are overlaid and the black color toner image is in the most underlayer. The object recording medium to which the toner image is transferred by those steps is separated from the transfer drum 104 by the separation claw 104*d* and then fixed by the fuser 109 to obtain a multicolor image.

Hereinafter, the steps of the image formation method of the present invention will be described in details separately for every step.

<Latent Image Forming Step>

The latent image forming step is a step of forming an electrostatic image by evenly charging the surface of a latent image carrier (hereinafter sometime referred to as a photoreceptor) with a charging means and successively exposing the photoreceptor with a laser optical system or LED array. As the charging means, a non-contact type charger such as a corotron, a scorotron, and the like, and a contact type charger for charging the photoreceptor surface by applying voltage to a conductive member brought into contact with the photoreceptor surface and any type of chargers can be employed. However, from a viewpoint that ozone generation is slight and environment-friendly and printing resistant characteristics are provided, a contact charging type charger is preferable. In the above-described contact charging type charger, the shape of the conductive member may be like a brush, a blade, a pin electrode, a roller and the like, and a roller-like member is preferable.

The image formation method of the present invention is not at all particularly restricted in the latent image forming step.

(Photoreceptor)

Hereinafter, the above-described photoreceptor to be employed for the image formation method of the present invention will be described in details.

Figure 2:
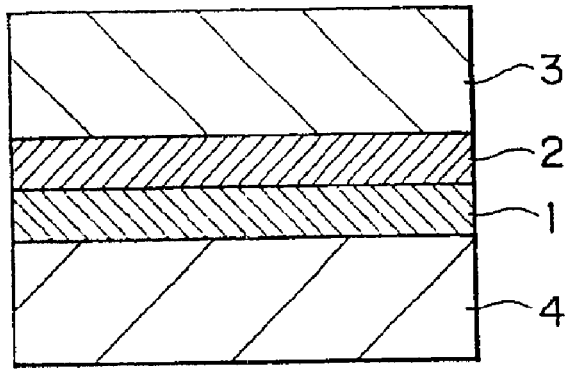
FIG. 2 is an enlarged figure of one example of a photoreceptor to be employed for the present invention.
Figure 3:
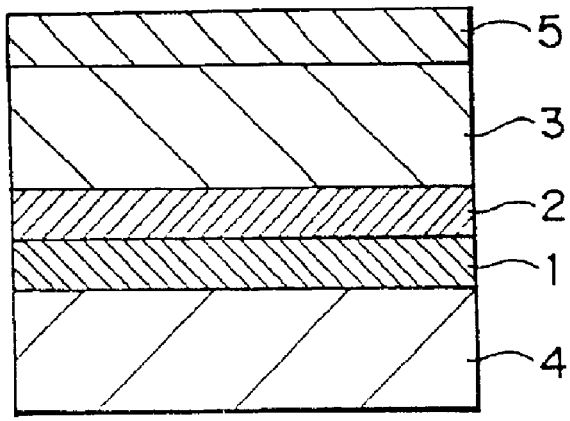
FIG. 3 is an enlarged figure of another example of a photoreceptor to be employed for the present invention.
Figure 4:
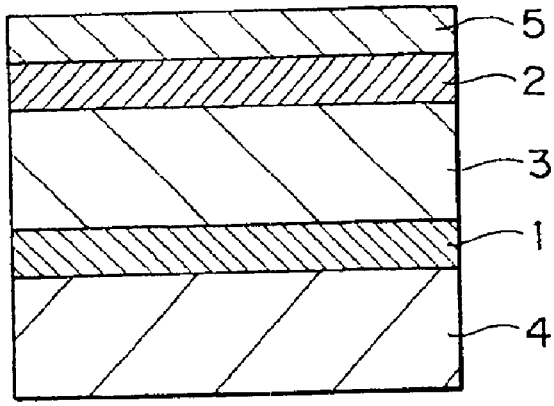
FIG. 4 is an enlarged figure of another example of a photoreceptor to be employed for the present invention.
Figure 5:
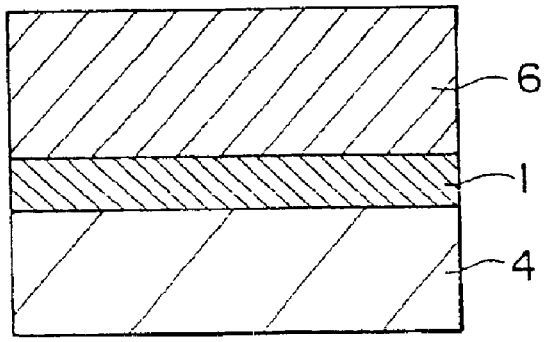
FIG. 5 is an enlarged figure of another example of a photoreceptor to be employed for the present invention.
Figure 6:
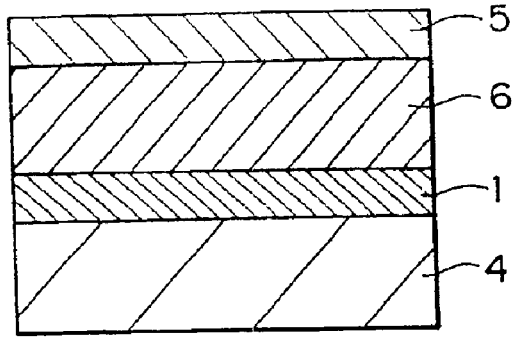
FIG. 6 is an enlarged figure of another example of a photoreceptor to be employed for the present invention.

FIG. 2 to FIG. 6 are schematic views of the cross-sectional views of photoreceptors for electrophotography. Photosensitive layers with a layered structure are illustrated in FIG. 2 to FIG. 4 and those with a monolayer structure are illustrated in FIG. 5 and FIG. 6. In FIG. 2, an underlayer 1 is formed on a conductive support 4 and thereon, a charge generating layer 2 and a charge transporting layer 3 are formed. In FIG. 3, further on the surface, a surface protective layer 5 is formed. In FIG. 4, an underlayer 1 is formed on a conductive support 4 and thereon, a charge transporting layer 3 and a charge generating layer 2 are formed, further on the surface, a surface protective layer 5 is formed. In FIG. 2 to FIG. 4, the underlayer may not be formed. In FIG. 5, an underlayer 1 is formed on a conductive support 4 and thereon, a monolayer type photosensitive layer 6 having both functions of the charge generating layer and the charge transporting layer is formed. Further, in FIG. 6, a surface protective layer 5 is further formed on the surface.

Conductive Support

As the conductive support, generally aluminum in form of a drum-like, sheet-like, plate-like or other properly shaped shape is employed, and it is not restricted to these examples. In the case that a photoreceptor drum is employed for a laser printer, in order to prevent interference patterns caused at the time of radiating laser beam, the surface of the support is preferably roughened as to have the average roughness between center line $R_{a75}$ value in a range of 0.04 $\mu$m to 0.5 $\mu$m. As the method for roughening the surface, a preferable method is a wet honing carried out by suspending an abrasive in water and blowing the resulting suspension to the support, or a center-less polishing for continuously carrying out polishing by bringing the support to a rotating wheel by pressure. If the $R_{a75}$ value is lower than 0.04 $\mu$m, the surface becomes almost a mirror face to result in no interference preventive effect obtained, and if the $R_{a75}$ is higher than 0.5 $\mu$m, even if coating is formed as the underlayer, the image quality becomes rough and therefore it is unsuitable. In the case incoherent light is used as the light source, the surface roughening for preventing the interference patterns is not particularly needed and since the defect occurrence by unevenness of the surface of a substrate can be suppressed, it is suitable for life prolongation.

Surface Layer

Next, the surface layer will be described. As described above, in the photoreceptor to be employed for the present invention, the following cases are possible: the case that the surface protective layer is a surface layer; the case the charge transporting layer or the charge generating layer is a surface layer; and a monolayer type photosensitive layer is a surface layer.

The surface layer of the photoreceptor to be employed for the present invention contains a cross-linked resin having the charge transporting property and as such a resin, there is no particular restriction, and the following are usable such as a cross-linked resin having siloxane bonds, a cross-linked resin having urea bonds, a cross-linked resin having amido bonds, a cross-linked resin having urethane bonds, a cross-linked resin having ester bonds, a cross-linked resin having ether bonds and the like. Among them, the cross-linked resin having siloxane bonds is particularly preferable in the transparency, the electric breakdown resistance, and photo-stability and the like. Hereinafter, the cross-linked resin having siloxane bonds to be employed for the present invention will be described.

The cross-linked resin having siloxane bonds is a resin obtained by three-dimensionally cross-linking siloxane, dimethylsiloxane, methyl phenyl siloxane, other necessary components and the like in the present invention, the cross-linked resin having siloxane bonds and containing a compound represented by the following general formula (I) is preferable since it is especially excellent in wear resistance, charge transporting property and the like in addition to the above-described characteristics:

$$F—[D—A]_b \qquad \text{General formula (1)}$$

(wherein, the reference character F represents an organic group derived from a photo-functional compound. The reference character D represents a flexible organic subunit. The reference character A represents a substituent silicon group having a hydrolyzable group represented by $—Si(R_1)_{(3-a)}Q_a$ (wherein reference character $R_1$ represents hydrogen, an alkyl, or an unsubstituted or substituted aryl; reference character Q represents a hydrolyzable group; and the reference character a represents an integer of 1 to 3.). The reference character b represents an integer of 1 to 4.).

In the general formula (I), the reference character F is preferably a group having a positive hole transporting function or an electron transporting function and especially as a group having the electron transporting function, practical examples are organic group derived from quinone-type compounds, fluorenone-type compounds, xanthone-type compounds, benzophenone-type compounds, cyanovinyl-type compounds, ethylene-type compounds, and the like. As the group having the positive hole transporting function, practical examples are those having a structure with photo-carrier transporting characteristics such as triarylamine-type compounds, benzidine-type compounds, arylalkane-type compounds, aryl-substituted ethylene-type compounds, stilbene-type compounds, anthracene-type compounds, hydrazone-type compounds, and further quinone-type compounds, fluorenone-type compounds, xanthone-type compounds, benzophenone-type compounds, cyanovinyl-type compounds, ethylene-type compounds, and the like.

In the general formula (I), the reference character A represents a substituent silicon group having a hydrolyzable group represented by $—Si(R_1)_{(3-a)}Q_a$ and the substituent silicon group is for forming three-dimensional Si—O—Si bond, that is an inorganic glassy network, by causing cross-linking reaction itself. The group represented as D in the general formula (I) is for directly bonding F for providing photoelectric characteristics to the three-dimensional inorganic glassy network. The group also functions to provide the inorganic glassy network, which is rigid and, on the contrary, fragile, with proper flexibility to improve the strength as a film. Practical groups usable are divalent hydrocarbon groups given in the case n is represented by an integer from 1 to 15 such as $—C_nH_2—$, $—C_nH_{(2n-2)}—$, $—C_nH_{(2n-4)}—$, and —COO—, —S—, —O—, $—CH_2—C_6H_4—$, —N=CH—, $—(C_6H_4)—(C_6H_4)—$, and their combinations and substituted groups and the like.

Among the compounds represented by the general formula (I), the compounds in which F represents groups represented by a general formula (II) have especially excellent positive hole transporting function and mechanical characteristics. In the general formula (II), the reference characters $Ar_1$ to $Ar_4$ each independently represent a substituted or unsubstituted aryl and practically they are preferably among the following structure group 1.

General formula (II)

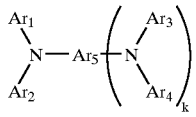

(wherein, the reference characters $Ar_1$ to $Ar_4$ each independently represent a substituted or unsubstituted aryl; and $Ar_5$ represents a substituted or unsubstituted aryl or arylene. Incidentally, one to four groups among $Ar_1$ to $Ar_5$ are possible to be bonded with a bonding group represented by —D—A in the above-described general formula (I). The reference character k represents 0 or 1.).

Structure group 1

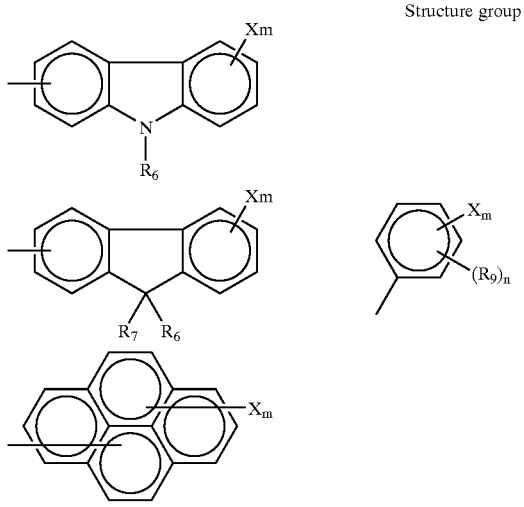

-continued

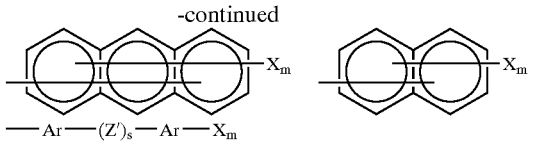

In the structure group 1, the reference character Ar preferably represents those among the following structure group 2.

Structure group 2

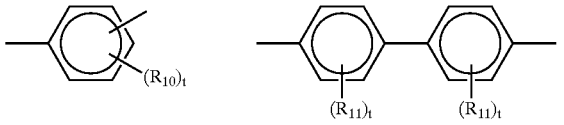

Further, the above-described reference character Z' preferably represents those among the following structure group 3.

Structure group 3

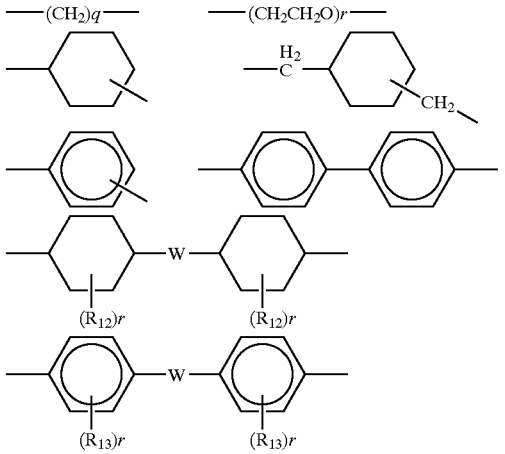

In the structure group 3, $R_6$ represents hydrogen; an alkyl of 1 to 4 carbon atoms; phenyl substituted with an alkyl of 1 to 4 carbon atoms or an alkoxyl of 1 to 4 carbon atoms; unsubstituted phenyl; or an aralkyl of 7 to 10 carbon atoms. The reference characters $R_7$ to $R_{13}$ each independently represent hydrogen; an alkyl of 1 to 4 carbon atoms; an alkoxyl of 1 to 4 carbon atoms; phenyl substituted with an alkoxyl of 1 to 4 carbon atoms; unsubstituted phenyl; an aralkyl of 7 to 10 carbon atoms; or a halogen. The reference characters m and s each independently represent 0 or 1; the reference characters q and r each independently represent an integer of 1 to 10; and the reference characters t and t' each independently represent an integer of 1 to 3. In the formulae, the reference character X represents the same as —D—A already described in the definition of the general formula (I).

Further, the above-described reference character W preferably represents those among the following structure group 4.

Structure group 4

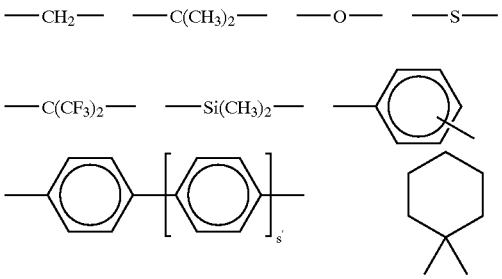

In the structure group 4, the reference character s' represents an integer of 0 to 3.

As practical structure for $Ar_5$ in the general formula (II), a structure given in the case the reference character m of the above-described $Ar_1$ to $Ar_4$ is 1 if k=0, and a structure given in the case the reference character m of the above-described $Ar_1$ to $Ar_4$ is 0 if k=1. Table 1 to Table 55 show practical examples of the compound (II), but the compound is not at all restricted to them.

TABLE 1

| Compound | k | $Ar^1$ | $Ar^2$ | $Ar^3$ | $Ar^4$ |
|---|---|---|---|---|---|
| 1 | 0 | 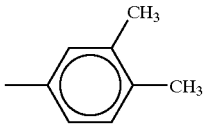 | 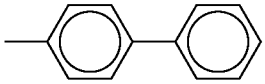 | — | — |
| 2 | 0 | 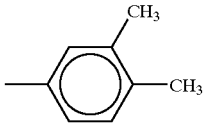 | 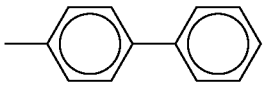 | — | — |
| 3 | 0 | 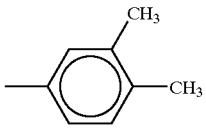 | 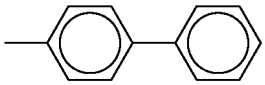 | — | — |
| 4 | 0 | 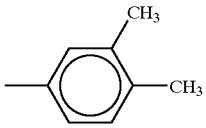 | 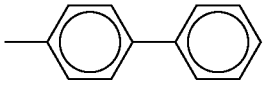 | — | — |
| 5 | 0 | 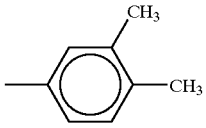 | 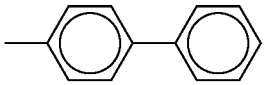 | — | — |

| Compound | k | $Ar^5$ | X |
|---|---|---|---|
| 1 | 0 | 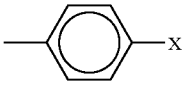 | —CH=NCH$_2$— —Si(OMe)$_2$Me |
| 2 | 0 | 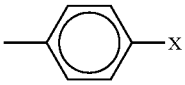 | —CH=N(CH$_2$)$_3$ —Si(OMe)$_3$ |
| 3 | 0 | 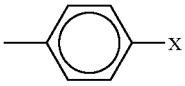 | —CH=N(CH$_2$)$_3$— —Si(OEt)$_3$ |
| 4 | 0 | 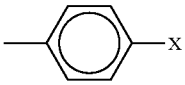 | 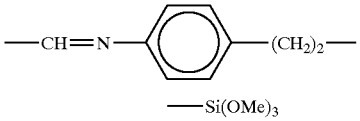 |

TABLE 1-continued
| | | | |
|---|---|---|---|
| 5 | 0 | 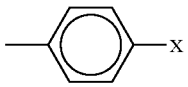 | 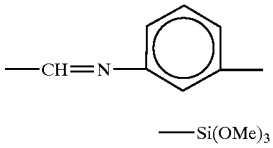 |
TABLE 2
| Compound | k | $Ar^1$ | $Ar^2$ | $Ar^3$ | $Ar^4$ | $Ar^5$ | X |
|---|---|---|---|---|---|---|---|
| 6 | 0 | 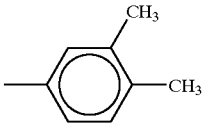 | 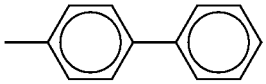 | — | — | 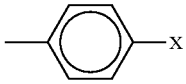 | —$O(CH_2)_3Si(OMe)_3$ |
| 7 | 0 | 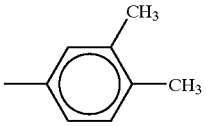 | 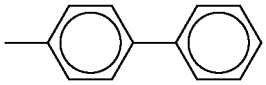 | — | — | 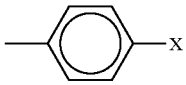 | —$O(CH_2)_3$—<br>—$SiMe(OMe)_2$ |
| 8 | 0 | 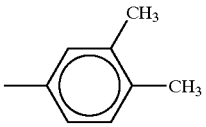 | 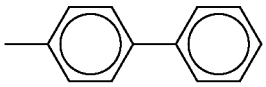 | — | — | 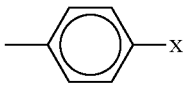 | —$O(CH_2)_3Si(OEt)_3$ |
| 9 | 0 | 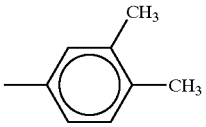 | 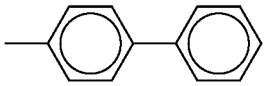 | — | — | 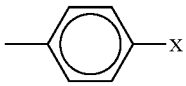 | —$CH_2O(CH_2)_3$—<br>—$Si(OMe)_3$ |
| 10 | 0 | 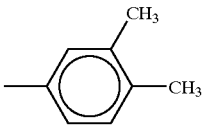 | 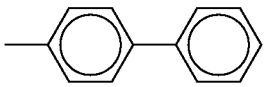 | — | — | 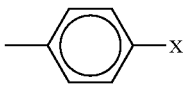 | —$(CH_2)_3O(CH_2)_3$—<br>—$Si(OMe)_3$ |
TABLE 3
| Compound | k | $Ar^1$ | $Ar^2$ | $Ar^3$ | $Ar^4$ | $Ar^5$ | X |
|---|---|---|---|---|---|---|---|
| 11 | 0 | 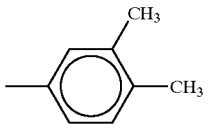 | 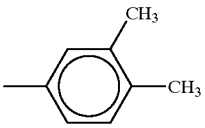 | — | — | 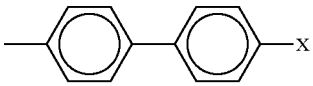 | —$COO(CH_2)_3$—<br>—$Si(OMe)_3$ |
| 12 | 0 | 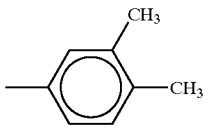 | 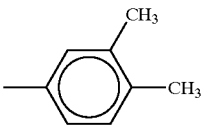 | — | — | 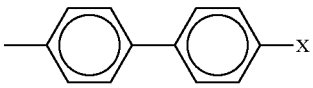 | —$CH_2COO(CH_2)_3$—<br>—$Si(OMe)_3$ |

TABLE 3-continued
| Compound | k | $Ar^1$ | $Ar^2$ | $Ar^3$ | $Ar^4$ | $Ar^5$ | X |
|---|---|---|---|---|---|---|---|
| 13 | 0 | 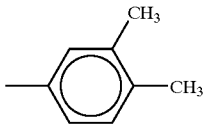 | 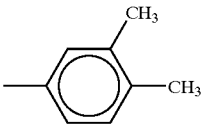 | — | — | 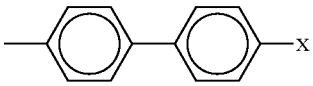 | —$(CH_2)_2COO$— —$(CH_2)_3Si(OMe)_3$ |
| 14 | 0 | 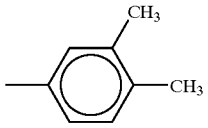 | 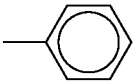 | — | — | 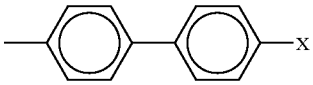 | —$COO(CH_2)_3$— —$Si(OMe)_3$ |
| 15 | 0 | 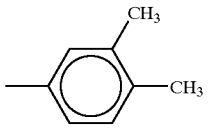 | 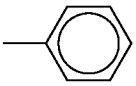 | — | — | 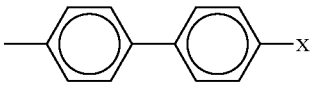 | —$CH_2COO(CH_2)_3$— —$Si(OMe)_3$ |
TABLE 4
| Compound | k | $Ar^1$ | $Ar^2$ | $Ar^3$ | $Ar^4$ | $Ar^5$ | X |
|---|---|---|---|---|---|---|---|
| 16 | 0 | 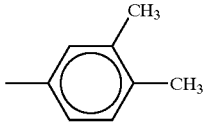 | 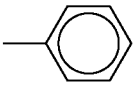 | — | — | 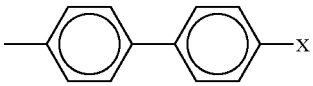 | —$(CH_2)_2COO$— —$(CH_2)_3Si(OMe)_3$ |
| 17 | 0 | 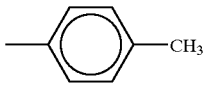 | 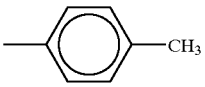 | — | — | 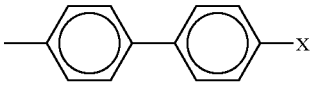 | —$COO(CH_2)_3$— —$Si(OMe)_3$ |
| 18 | 0 | 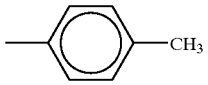 | 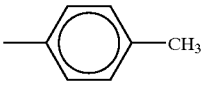 | — | — | 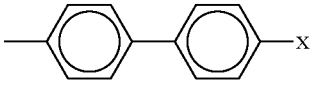 | —$CH_2COO(CH_2)_3$— —$Si(OMe)_3$ |
| 19 | 0 | 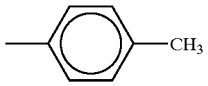 | 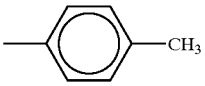 | — | — | 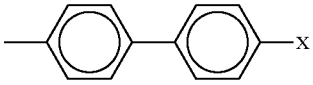 | —$(CH_2)_2COO$— —$(CH_2)_3Si(OMe)_3$ |
| 20 | 0 | 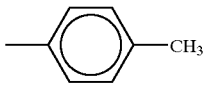 | 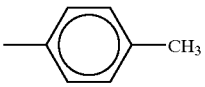 | — | — | 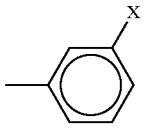 | —$COO(CH_2)_3$— —$Si(OMe)_3$ |
TABLE 5
| Compound | k | $Ar^1$ | $Ar^2$ | $Ar^3$ | $Ar^4$ | $Ar^5$ | X |
|---|---|---|---|---|---|---|---|
| 21 | 0 | 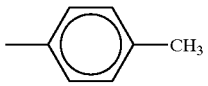 | 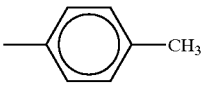 | — | — | 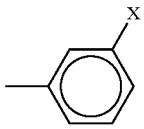 | —$COOCH_2C_6H_4$— —$Si(OMe)_3$ |

TABLE 5-continued
| Compound | k | $Ar^1$ | $Ar^2$ | $Ar^3$ | $Ar^4$ | $Ar^5$ | X |
|---|---|---|---|---|---|---|---|
| 22 | 0 | 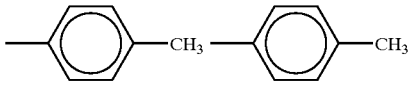 | | — | — | 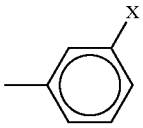 | —$COOCH_2C_6H_4$— —$(CH_2)_3Si(OMe)_3$ |
| 23 | 0 | 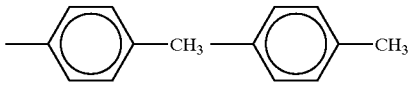 | | — | — | 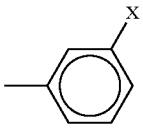 | —$CH_2COO(CH_2)_3$— —$Si(OMe)_3$ |
| 24 | 0 | 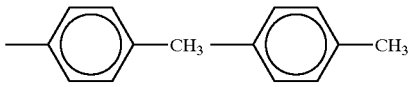 | | — | — | 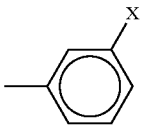 | —$CH_2COOCH_2$— —$C_6H_4Si(OMe)_3$ |
| 25 | 0 | 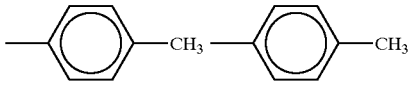 | | — | — | 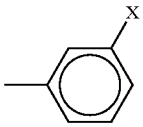 | —$CH_2COO$— —$CH_2C_6H_4(CH_2)_2$— —$Si(OMe)_3$ |
TABLE 6
| Compound | k | $Ar^1$ | $Ar^2$ | $Ar^3$ | $Ar^4$ | $Ar^5$ | X |
|---|---|---|---|---|---|---|---|
| 26 | 0 | 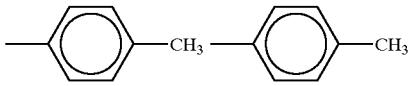 | | — | — | 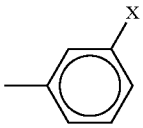 | —$(CH_2)_2COO$— —$(CH_2)_3Si(OMe)_3$ |
| 27 | 0 | 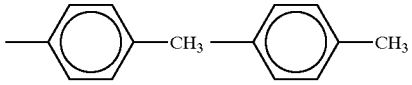 | | — | — | 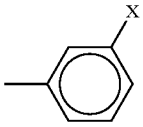 | —$(CH_2)_2COOCH_2$— —$C_6H_4Si(OMe)_3$ |
| 28 | 0 | 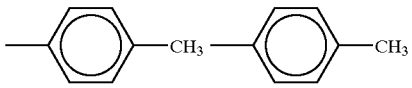 | | — | — | 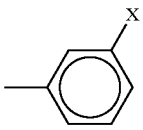 | —$CH_2COO$— —$CH_2C_6H_4(CH_2)_2$— —$Si(OMe)_3$ |
| 29 | 0 | 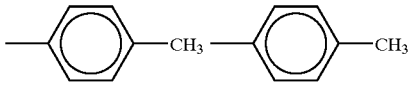 | | — | — | 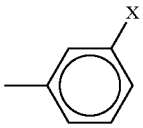 | —$COO(CH_2)_3$— —$Si(OMe)_3$ |
| 30 | 0 | 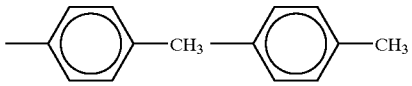 | | — | — | 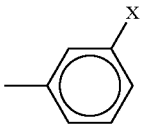 | —$COOCH_2C_6H_4$— —$(CH_2)_2Si(OMe)_3$ |

TABLE 7
| Compound | k | $Ar^1$ | $Ar^2$ | $Ar^3$ | $Ar^4$ | $Ar^5$ | X |
|---|---|---|---|---|---|---|---|
| 31 | 0 | 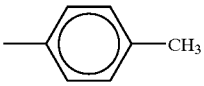 | 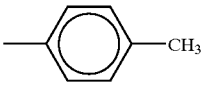 | — | — | 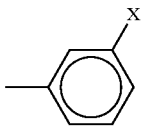 | —$(CH_2)_3COO$—<br>—$(CH_2)_3Si(OMe)_3$ |
| 32 | 0 | 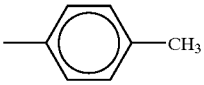 | 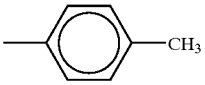 | — | — | 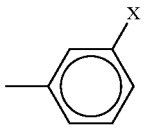 | —$(CH_2)_2COO$—<br>—$CH_2C_6H_4(CH_2)_2$—<br>—$Si(OMe)_3$ |
| 33 | 0 | 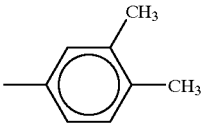 | 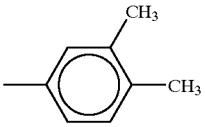 | — | — | 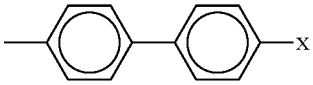 | —$COO(CH_2)_3$—<br>—$Si(OMe)_3$ |
| 34 | 0 | 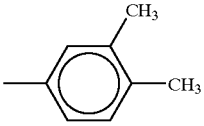 | 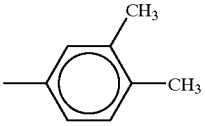 | — | — | 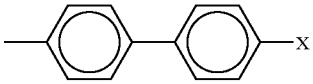 | —$COOCH_2$—<br>—$C_6H_4Si(OMe)_3$ |
| 35 | 0 | 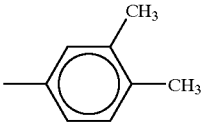 | 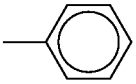 | — | — | 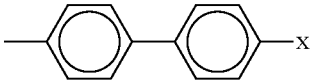 | —$COO(CH_2)_3$—<br>—$Si(OMe)_3$ |
TABLE 8
| Compound | k | $Ar^1$ | $Ar^2$ | $Ar^3$ | $Ar^4$ | $Ar^5$ | X |
|---|---|---|---|---|---|---|---|
| 36 | 0 | 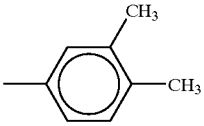 | 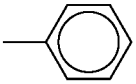 | — | — | 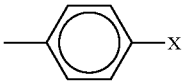 | —$COO(CH_2)_3$—<br>—$Si(OMe)_3$ |
| 37 | 0 | 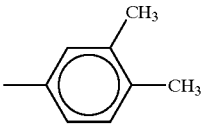 | 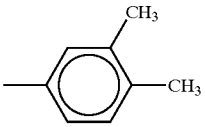 | — | — | 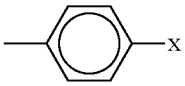 | —$COO(CH_2)_3$—<br>—$Si(OMe)_3$ |
| 38 | 0 | 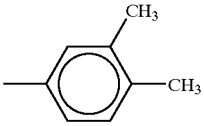 | 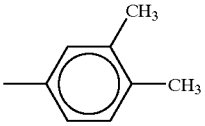 | — | — | 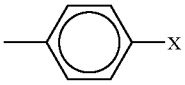 | —$COOCH_2C_6H_4$—<br>—$(CH_2)_2Si(OMe)_3$ |
| 39 | 0 | 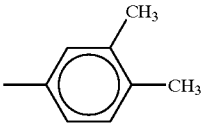 | 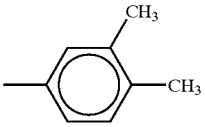 | — | — | 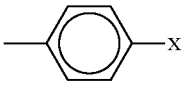 | —$CH_2COO(CH_2)_3$—<br>—$Si(OMe)_3$ |

TABLE 8-continued

| Compound | k | $Ar^1$ | $Ar^2$ | $Ar^3$ | $Ar^4$ | $Ar^5$ | X |
|---|---|---|---|---|---|---|---|
| 40 | 0 | 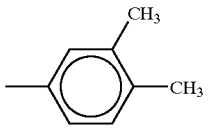 | 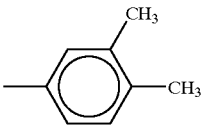 | — | — | 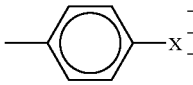 | —$CH_2COO$—<br>—$CH_2C_6H_4(CH_2)_2$—<br>—$Si(OMe)_3$ |

TABLE 9

| Compound | k | $Ar^1$ | $Ar^2$ | $Ar^3$ | $Ar^4$ | $Ar^5$ | X |
|---|---|---|---|---|---|---|---|
| 41 | 0 | 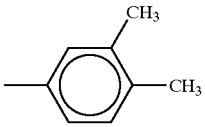 | 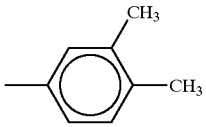 | — | — | 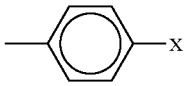 | —$(CH_2)_2COO$—<br>—$(CH_2)_3Si(OMe)_3$ |
| 42 | 0 | 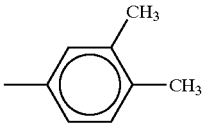 | 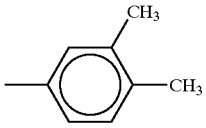 | — | — | 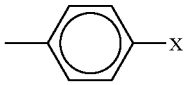 | —$(CH_2)_2COO$—<br>—$CH_2C_6H_4(CH_2)_2$—<br>—$Si(OMe)_3$ |
| 43 | 0 | 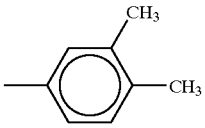 | 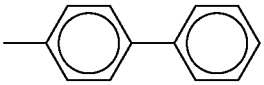 | — | — | 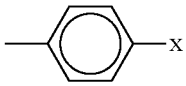 | —$COO(CH_2)_3$—<br>—$Si(OMe)_3$ |
| 44 | 0 | 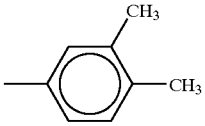 | 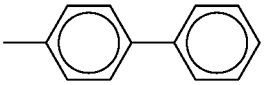 | — | — | 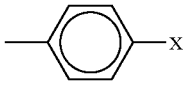 | —$COOCH_2C_6H_4$—<br>—$(CH_2)_2Si(OMe)_3$ |
| 45 | 0 | 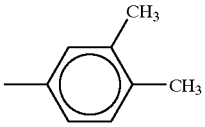 | 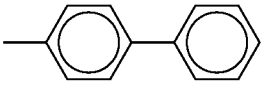 | — | — | 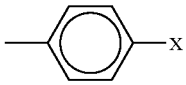 | —$CH_2COO(CH_2)_3$—<br>—$Si(OMe)_3$ |

TABLE 10

| Compound | k | $Ar^1$ | $Ar^2$ | $Ar^3$ | $Ar^4$ | $Ar^5$ | X |
|---|---|---|---|---|---|---|---|
| 46 | 0 | 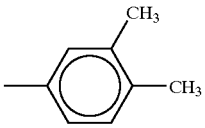 | 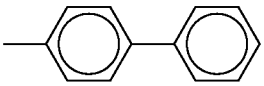 | — | — | 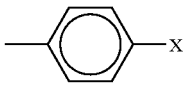 | —$CH_2COO$—<br>—$CH_2C_6H_4(CH_2)_2$—<br>—$Si(OMe)_3$ |
| 47 | 0 | 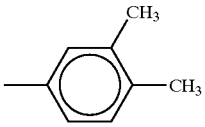 | 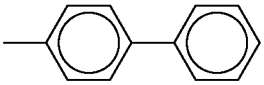 | — | — | 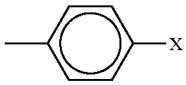 | —$(CH_2)_2COO$—<br>—$(CH_2)_3Si(OMe)_3$ |

TABLE 10-continued

| Compound | k | $Ar^1$ | $Ar^2$ | $Ar^3$ | $Ar^4$ | $Ar^5$ | X |
|---|---|---|---|---|---|---|---|
| 48 | 0 | 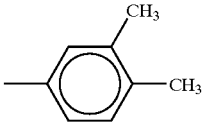 | 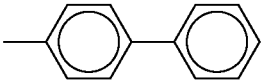 | — | — | 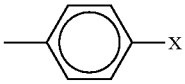 | —$(CH_2)_2COO$—<br>—$CH_2C_6H_4(CH_2)_2$—<br>—$Si(OMe)_3$ |
| 49 | 0 | 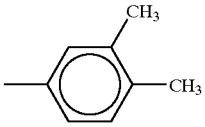 | 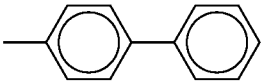 | — | — | 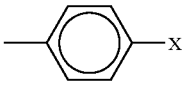 | —CH═CH$Si(OEt)_3$ |
| 50 | 0 | 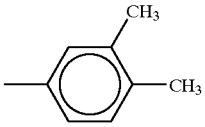 | 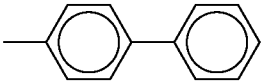 | — | — | 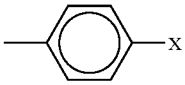 | —CH═$CHCH_2$—<br>—$Si(OEt)_3$ |

TABLE 11

| Compound | k | $Ar^1$ | $Ar^2$ | $Ar^3$ | $Ar^4$ | $Ar^5$ | X |
|---|---|---|---|---|---|---|---|
| 51 | 0 | 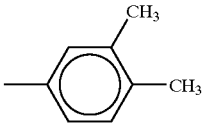 | 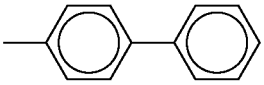 | — | — | 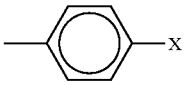 | —CH═$CH(CH_2)_2$—<br>—$Si(OMe)_3$ |
| 52 | 0 | 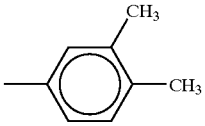 | 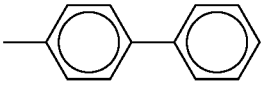 | — | — | 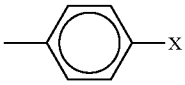 | —CH═$CH(CH_2)_2$—<br>—$SiMe(OMe)_2$ |
| 53 | 0 | 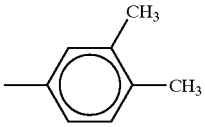 | 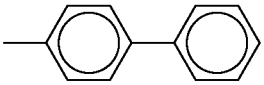 | — | — | 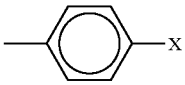 | —CH═$CHCH_2$—<br>—$Si(OMe)_2Me$ |
| 54 | 0 | 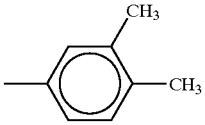 | 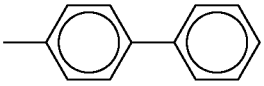 | — | — | 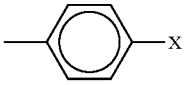 | —CH═$CH(CH_2)_2$—<br>—$Si(OEt)_3$ |
| 55 | 0 | 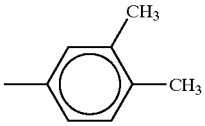 | 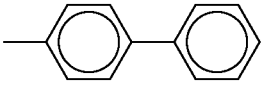 | — | — | 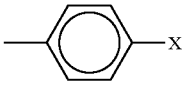 | —CH═$CH(CH_2)_{10}$—<br>—$Si(OMe)_3$ |

TABLE 12

| Compound | k | $Ar^1$ | $Ar^2$ | $Ar^3$ | $Ar^4$ | $Ar^5$ | X |
|---|---|---|---|---|---|---|---|
| 56 | 0 | 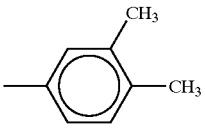 | 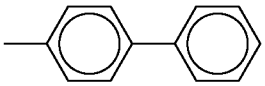 | — | — | 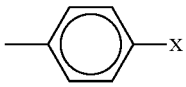 | —CH═$CHC_6H_4$—<br>—$Si(OMe)_3$ |

TABLE 12-continued
| Compound | k | $Ar^1$ | $Ar^2$ | $Ar^3$ | $Ar^4$ | $Ar^5$ | X |
|---|---|---|---|---|---|---|---|
| 57 | 0 | 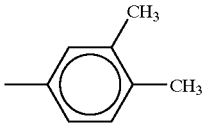 | 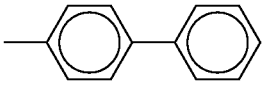 | — | — | 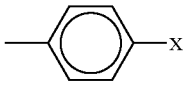 | —CH═CHC$_6$H$_4$— —(CH$_2$)$_2$Si(OMe)$_3$ |
| 58 | 0 | 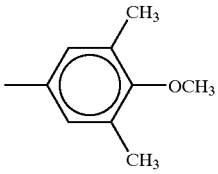 | 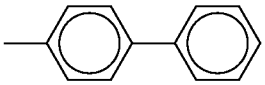 | — | — | 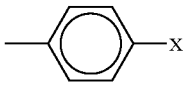 | —CH═CH(CH$_2$)$_2$— —Si(OMe)$_3$ |
| 59 | 0 | 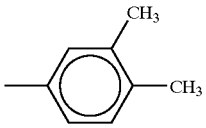 | 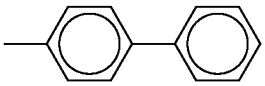 | — | — | 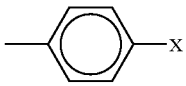 | —(CH$_2$)$_2$Si(OEt)$_3$ |
| 60 | 0 | 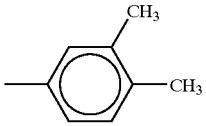 | 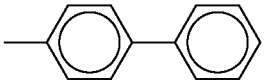 | — | — | 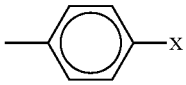 | —(CH$_2$)$_3$Si(OEt)$_3$ |
TABLE 13
| Compound | k | $Ar^1$ | $Ar^2$ | $Ar^3$ | $Ar^4$ | $Ar^5$ | X |
|---|---|---|---|---|---|---|---|
| 61 | 0 | 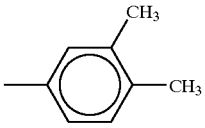 | 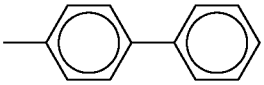 | — | — | 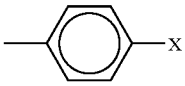 | —(CH$_2$)$_4$Si(OMe)$_3$ |
| 62 | 0 | 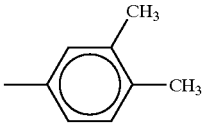 | 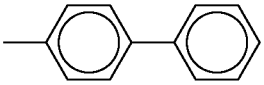 | — | — | 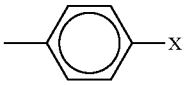 | —(CH$_2$)$_4$— —SiMe(OMe)$_2$ |
| 63 | 0 | 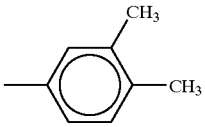 | 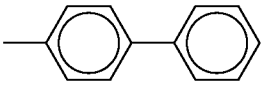 | — | — | 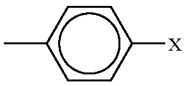 | —(CH$_2$)$_4$— —SiMe$_2$(OMe) |
| 64 | 0 | 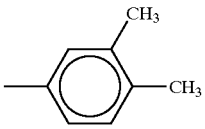 | 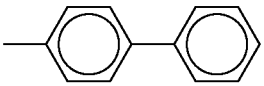 | — | — | 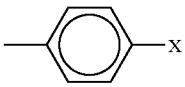 | —(CH$_2$)$_4$Si(OEt)$_3$ |
| 65 | 0 | 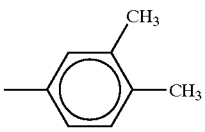 | 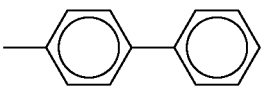 | — | — | 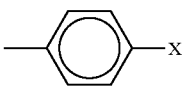 | —(CH$_2$)$_6$SiMe(OEt)$_2$ |

TABLE 14
| Compound | k | $Ar^1$ | $Ar^2$ | $Ar^3$ |
|---|---|---|---|---|
| 66 | 0 | 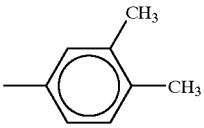 | 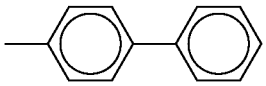 | — |
| 67 | 0 | 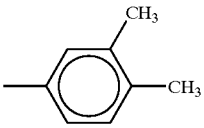 | 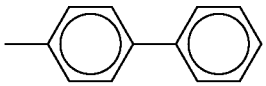 | — |
| 68 | 0 | 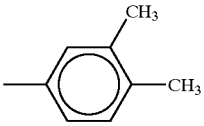 | 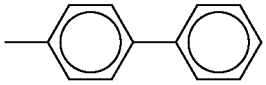 | — |
| 69 | 1 | 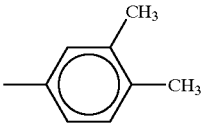 | 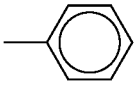 | 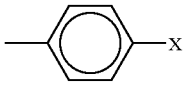 |
| 70 | 1 | 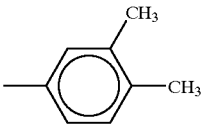 | 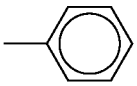 | 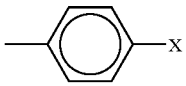 |
| Compound | k | $Ar^4$ | $Ar^5$ | X |
|---|---|---|---|---|
| 66 | 0 | — | 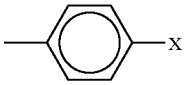 | $—(CH_2)_{12}Si(OMe)_3$ |
| 67 | 0 | — | 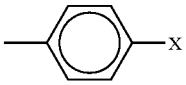 | $—(CH_2)_2C_6H_4—$ $—(CH_2)_2Si(OMe)_3$ |
| 68 | 0 | — | 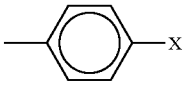 | $—C_2H_4C_4H_6—$ $—Si(OMe)_3$ |
| 69 | 1 | 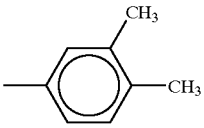 | 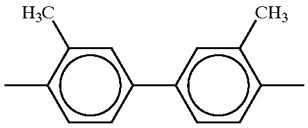 | $—CH{=}N(CH_2)_3—$ $—Si(OMe)_3$ |
| 70 | 1 | 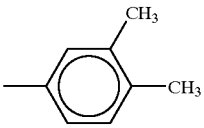 | 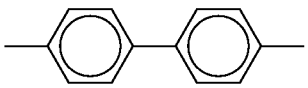 | $—CH{=}N(CH_2)_3—$ $—Si(OMe)_3$ |

TABLE 15
| Compound | k | $Ar^1$ | $Ar^2$ | $Ar^3$ |
|---|---|---|---|---|
| 71 | 1 | 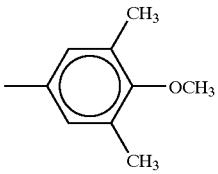 | 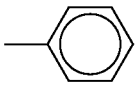 | 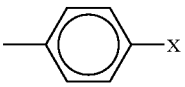 |
| 72 | 1 | 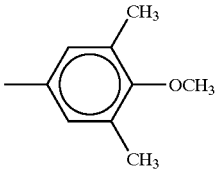 | 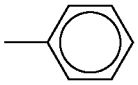 | 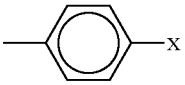 |
| 73 | 1 | 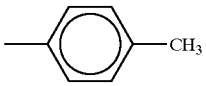 | 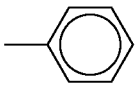 | 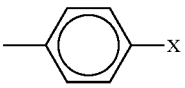 |
| 74 | 1 | 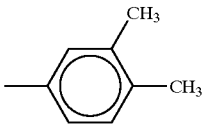 | 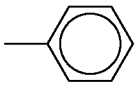 | 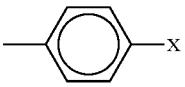 |
| 75 | 1 | 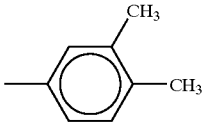 | 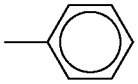 | 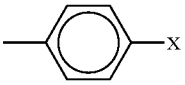 |
| Compound | k | $Ar^4$ | $Ar^5$ | X |
|---|---|---|---|---|
| 71 | 1 | 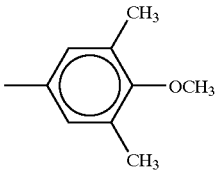 | 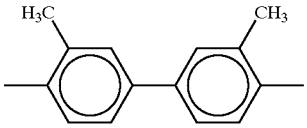 | —CH═N($CH_2$)$_3$— —Si(OMe)$_3$ |
| 72 | 1 | 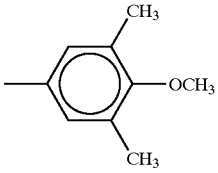 | 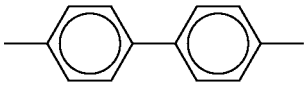 | —CH═N($CH_2$)$_3$— —Si(OMe)$_3$ |
| 73 | 1 | 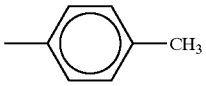 | 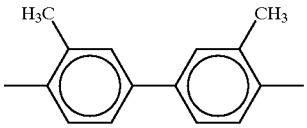 | —CH═N($CH_2$)$_3$— —Si(OMe)$_3$ |
| 74 | 1 | 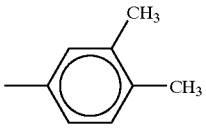 | 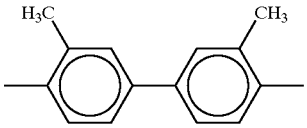 | 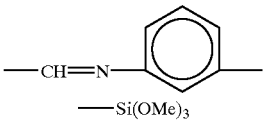 |

TABLE 15-continued
| | | | | |
|---|---|---|---|---|
| 75 | 1 | 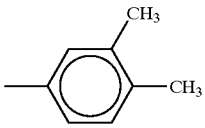 | 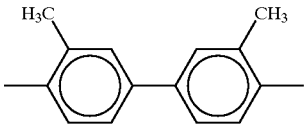 | —O(CH$_2$)$_6$Si(OMe)$_3$ |
TABLE 16
| Compound | k | Ar$^1$ | Ar$^2$ | Ar$^3$ |
|---|---|---|---|---|
| 76 | 1 | 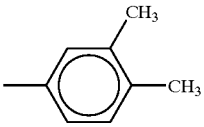 | 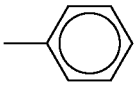 | 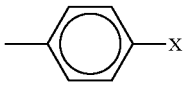 |
| 77 | 1 | 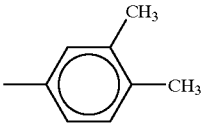 | 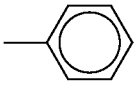 | 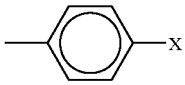 |
| 78 | 1 | 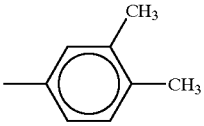 | 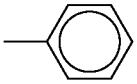 | 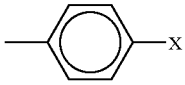 |
| 79 | 1 | 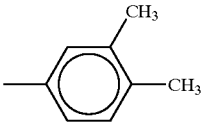 | 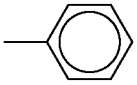 | 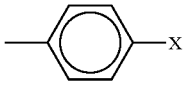 |
| 80 | 1 | 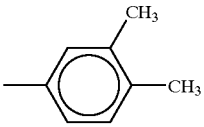 | 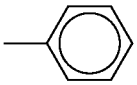 | 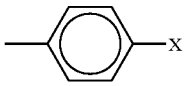 |
| Compound | k | Ar$^4$ | Ar$^5$ | X |
|---|---|---|---|---|
| 76 | 1 | 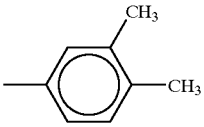 | 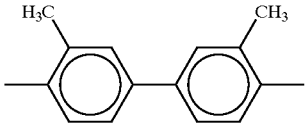 | —O(CH$_2$)$_3$Si(OEt)$_3$ |
| 77 | 1 | 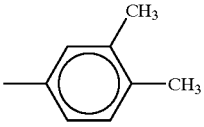 | 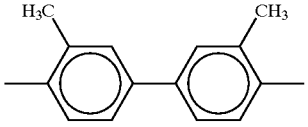 | —CH$_2$O(CH$_2$)$_3$—<br>—Si(OMe)$_3$ |
| 78 | 1 | 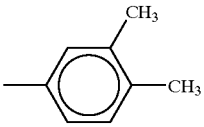 | 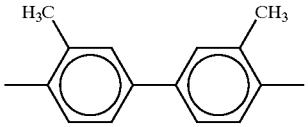 | —(CH$_2$)$_3$O(CH$_2$)$_3$—<br>—Si(OMe)$_3$ |

TABLE 16-continued
| | | | | |
|---|---|---|---|---|
| 79 | 1 | 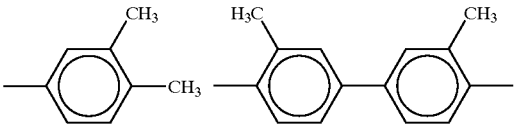 | | —$(CH_2)_4Si(OMe)_3$ |
| 80 | 1 | 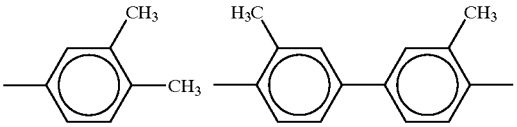 | | —$(CH_2)_2C_6H_4$— —$Si(OMe)_3$ |
15
TABLE 17
| Compound | k | $Ar^1$ | $Ar^2$ | $Ar^3$ |
|---|---|---|---|---|
| 81 | 1 | 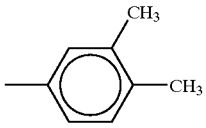 | 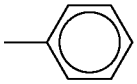 | 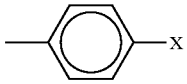 |
| 82 | 1 | 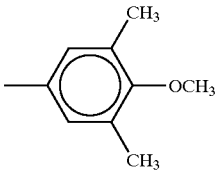 | 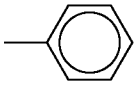 | 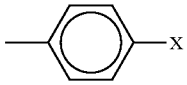 |
| 83 | 1 | 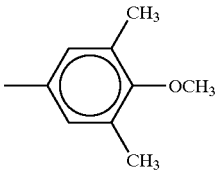 | 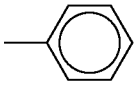 | 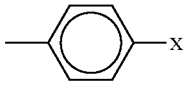 |
| 84 | 1 | 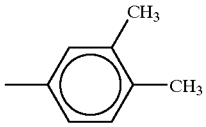 | 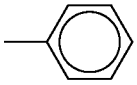 | 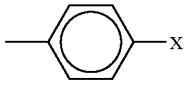 |
| 85 | 1 | 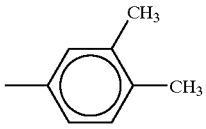 | 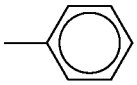 | 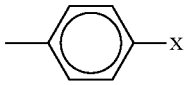 |
| Compound | k | $Ar^4$ | $Ar^5$ | X |
|---|---|---|---|---|
| 81 | 1 | 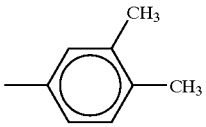 | 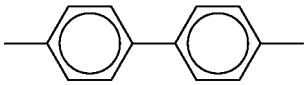 | —$(CH_2)_4Si(OMe)_3$ |

TABLE 17-continued
| | | | | |
|---|---|---|---|---|
| 82 | 1 | 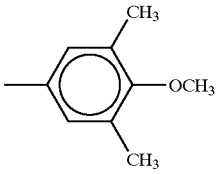 | 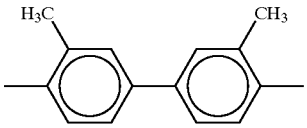 | —$(CH_2)_4Si(OMe)_3$ |
| 83 | 1 | 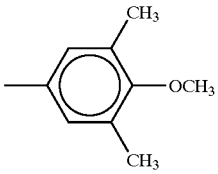 | 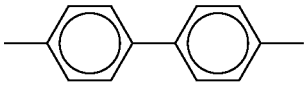 | —$(CH_2)_4Si(OMe)_3$ |
| 84 | 1 | 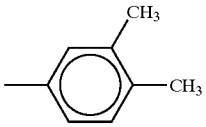 | 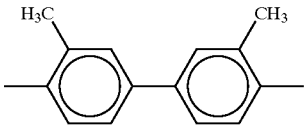 | —CH═CH$(CH_2)_2$— —$Si(OMe)_3$ |
| 85 | 1 | 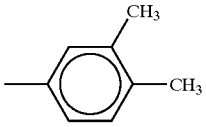 | 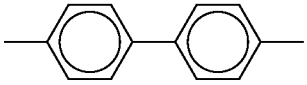 | —CH═CH$(CH_2)_2$— —$Si(OMe)_3$ |
30
TABLE 18
| Compound | k | $Ar^1$ | $Ar^2$ | $Ar^3$ |
|---|---|---|---|---|
| 86 | 1 | 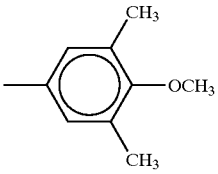 | 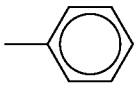 | 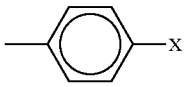 |
| 87 | 1 | 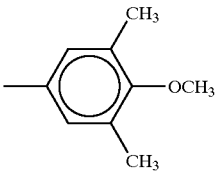 | 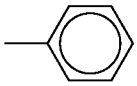 | 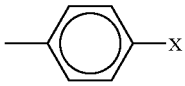 |
| 88 | 1 | 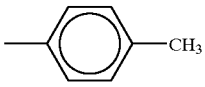 | 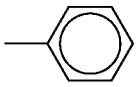 | 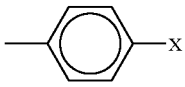 |
| 89 | 0 | 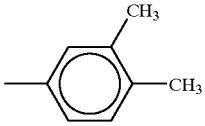 | 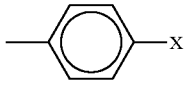 | — |
| 90 | 0 | 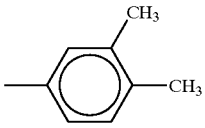 | 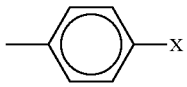 | — |

TABLE 18-continued
| Compound | k | $Ar^4$ | $Ar^5$ | X |
|---|---|---|---|---|
| 86 | 1 | 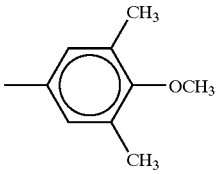 | 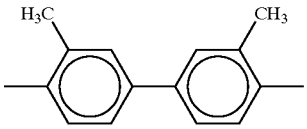 | —CH═CH$(CH_2)_2$— —Si$(OMe)_3$ |
| 87 | 1 | 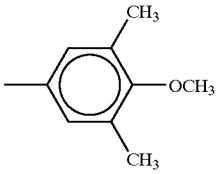 | 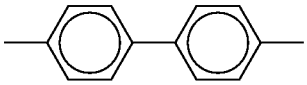 | —CH═CH$(CH_2)_2$— —Si$(OMe)_3$ |
| 88 | 1 | 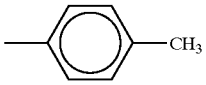 | 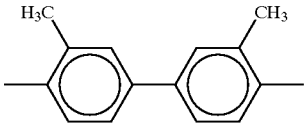 | —CH═CH$(CH_2)_2$— —Si$(OMe)_3$ |
| 89 | 0 | — | 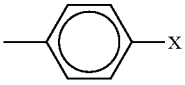 | —$(CH_2)_2$Si$(OEt)_3$ |
| 90 | 0 | — | 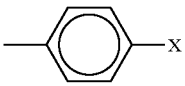 | —$(CH_2)_3$Si$(OEt)_3$ |
TABLE 19
| Compound | k | $Ar^1$ | $Ar^2$ | $Ar^3$ | $Ar^4$ | $Ar^5$ | X |
|---|---|---|---|---|---|---|---|
| 91 | 0 | 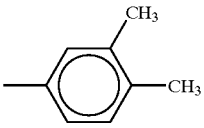 | 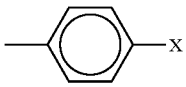 | — | — | 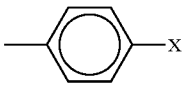 | —$(CH_2)_3$— —Si$(OMe)_2$Me |
| 92 | 0 | 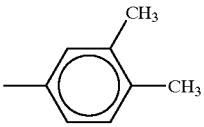 | 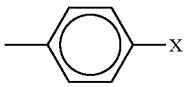 | — | — | 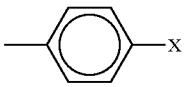 | —$(CH_2)_4$Si$(OMe)_3$ |
| 93 | 0 | 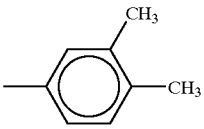 | 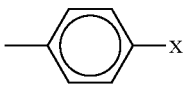 | — | — | 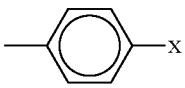 | —$(CH_2)_{12}$Si$(OMe)_3$ |
| 94 | 0 | 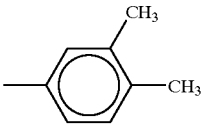 | 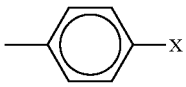 | — | — | 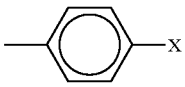 | —$(CH_2)_4$Si$(OEt)_3$ |

TABLE 19-continued
| Compound | k | $Ar^1$ | $Ar^2$ | $Ar^3$ | $Ar^4$ | $Ar^5$ | X |
|---|---|---|---|---|---|---|---|
| 95 | 0 | 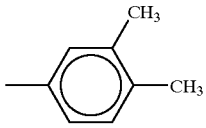 | 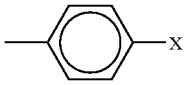 | — | — | 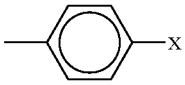 | —$(CH_2)_2C_6H_4$— —$Si(OMe)_3$ |
TABLE 20
| Compound | k | $Ar^1$ | $Ar^2$ | $Ar^3$ | $Ar^4$ | $Ar^5$ | X |
|---|---|---|---|---|---|---|---|
| 96 | 0 | 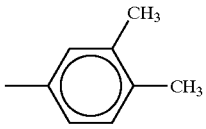 | 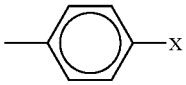 | — | — | 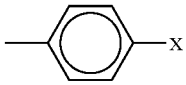 | —$(CH_2)_2C_6H_4$— —$(CH_2)_2Si(OMe)_3$ |
| 97 | 0 | 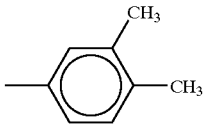 | 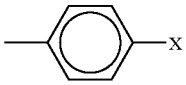 | — | — | 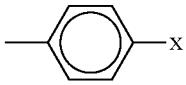 | —$(CH_2)_4Si(OMe)_3$ |
| 98 | 0 | 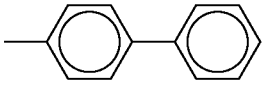 | 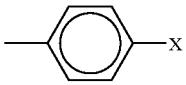 | — | — | 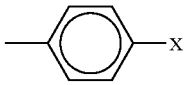 | —$(CH_2)_4Si(OMe)_3$ |
| 99 | 0 | 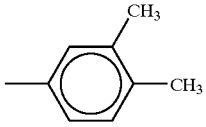 | 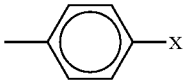 | — | — | 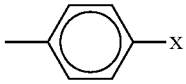 | —CH═CHSi$(OEt)_3$ |
| 100 | 0 | 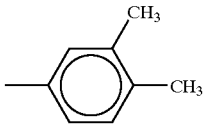 | 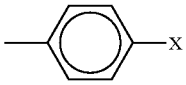 | — | — | 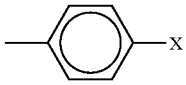 | —CH═$CHCH_2$— —$Si(OMe)_2Me$ |
TABLE 21
| Compound | k | $Ar^1$ | $Ar^2$ | $Ar^3$ | $Ar^4$ | $Ar^5$ | X |
|---|---|---|---|---|---|---|---|
| 101 | 0 | 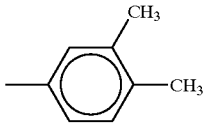 | 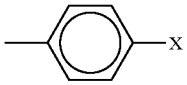 | — | — | 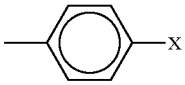 | —CH═$CH(CH_2)_2$— —$Si(OMe)_3$ |
| 102 | 0 | 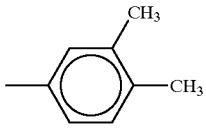 | 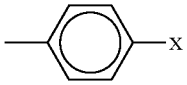 | — | — | 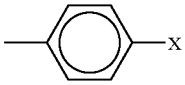 | —CH═$CH(CH_2)_2$— —$Si(OMe)_2Me$ |

TABLE 21-continued
| Compound | k | $Ar^1$ | $Ar^2$ | $Ar^3$ | $Ar^4$ | $Ar^5$ | X |
|---|---|---|---|---|---|---|---|
| 103 | 0 | 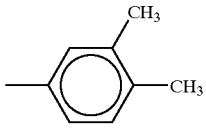 | 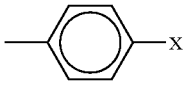 | — | — | 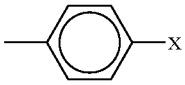 | —CH=CH$(CH_2)_2$— —$SiMe_2$(OMe) |
| 104 | 0 | 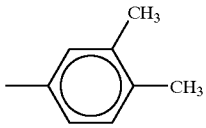 | 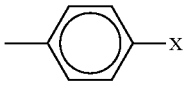 | — | — | 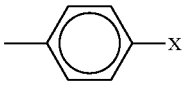 | —CH=CH$(CH_2)_2$— —Si$(OEt)_3$ |
| 105 | 0 | 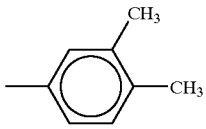 | 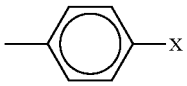 | — | — | 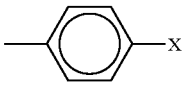 | —CH=CH$(CH_2)_{10}$— —Si$(OMe)_3$ |
TABLE 22
| Compound | k | $Ar^1$ | $Ar^2$ | $Ar^3$ | $Ar^4$ | $Ar^5$ | X |
|---|---|---|---|---|---|---|---|
| 106 | 0 | 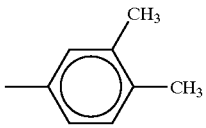 | 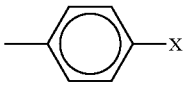 | — | — | 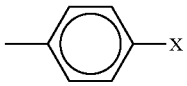 | —CH=CH$C_6H_4$— —Si$(OMe)_3$ |
| 107 | 0 | 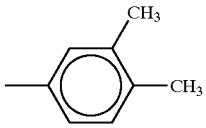 | 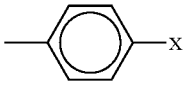 | — | — | 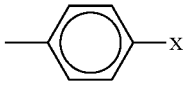 | —CH=CH$C_6H_4$— —$(CH_2)_2$Si$(OMe)_3$ |
| 108 | 0 | 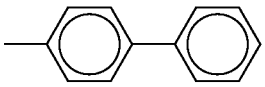 | 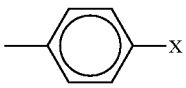 | — | — | 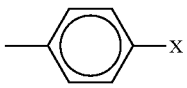 | —CH=CH$(CH_2)_2$— —Si$(OMe)_3$ |
| 109 | 0 | 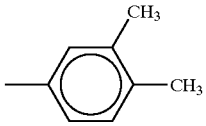 | 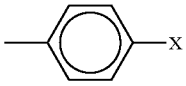 | — | — | 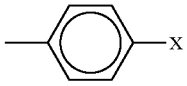 | —CH=N$(CH_2)_3$— —Si$(OMe)_3$ |
| 110 | 0 | 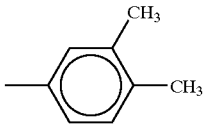 | 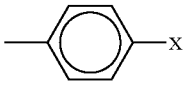 | — | — | 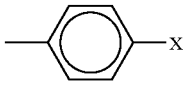 | —CH=N$(CH_2)_3$— —Si$(OEt)_3$ |

TABLE 23
| Compound | k | $Ar^1$ | $Ar^2$ | $Ar^3$ | $Ar^4$ | $Ar^5$ | X |
|---|---|---|---|---|---|---|---|
| 111 | 0 | 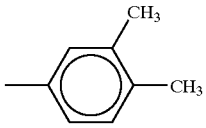 | 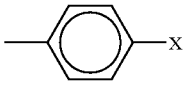 | — | — | 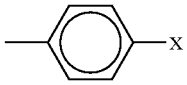 | —CH═NCH$_2$— —Si(OMe)$_2$Me |
| 112 | 0 | 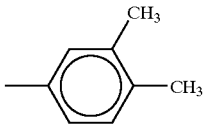 | 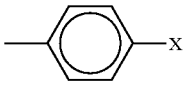 | — | — | 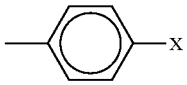 | —CH═NC$_6$H$_4$— —(CH$_2$)$_2$Si(OMe)$_3$ |
| 113 | 0 | 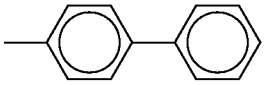 | 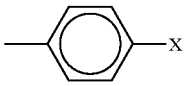 | — | — | 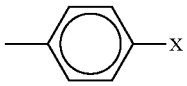 | —CH═N(CH$_2$)$_3$— —Si(OMe)$_3$ |
| 114 | 0 | 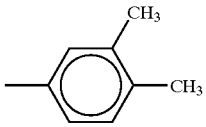 | 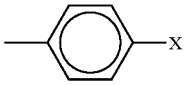 | — | — | 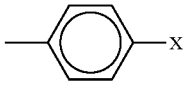 | —O(CH$_2$)$_3$Si(OMe)$_3$ |
| 115 | 0 | 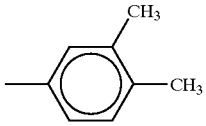 | 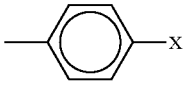 | — | — | 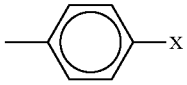 | —O(CH$_2$)$_3$Si(OEt)$_3$ |
TABLE 24
| Compound | k | $Ar^1$ | $Ar^2$ | $Ar^3$ | $Ar^4$ | $Ar^5$ | X |
|---|---|---|---|---|---|---|---|
| 116 | 0 | 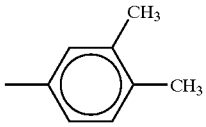 | 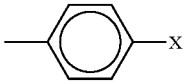 | — | — | 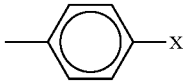 | —CH$_2$O(CH$_2$)$_3$— —Si(OMe)$_3$ |
| 117 | 0 | 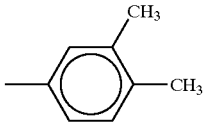 | 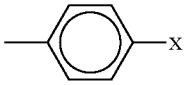 | — | — | 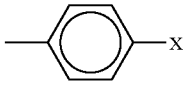 | —(CH$_2$)$_3$O(CH$_2$)$_3$— —Si(OMe)$_3$ |
| 118 | 0 | 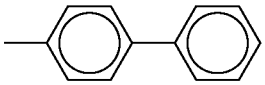 | 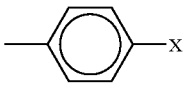 | — | — | 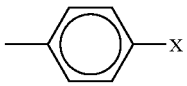 | —CH$_2$O(CH$_2$)$_3$— —Si(OMe)$_3$ |
| 119 | 0 | 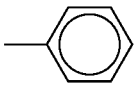 | 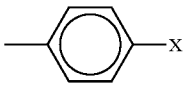 | — | — | 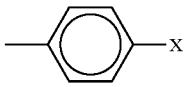 | —CH$_2$COO(CH$_2$)$_3$— —Si(OMe)$_3$ |
| 120 | 0 | 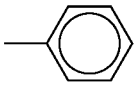 | 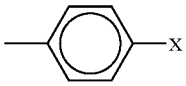 | — | — | 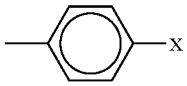 | —(CH$_2$)$_2$COO— —(CH$_2$)$_3$Si(OMe)$_3$ |

TABLE 25
| Compound | k | $Ar^1$ | $Ar^2$ | $Ar^3$ | $Ar^4$ | $Ar^5$ | X |
|---|---|---|---|---|---|---|---|
| 121 | 0 | 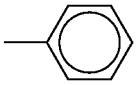 | 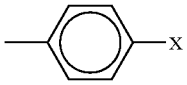 | — | — | 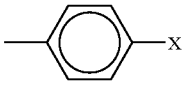 | —$(CH_2)_2$COO— —$CH_2C_6H_4(CH_2)_2$— —Si$(OMe)_3$ |
| 122 | 0 | 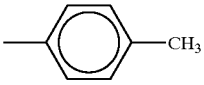 | 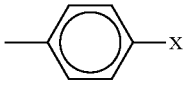 | — | — | 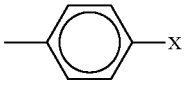 | —$CH_2$COO— —$CH_2C_6H_4(CH_2)_2$— —Si$(OMe)_3$ |
| 123 | 0 | 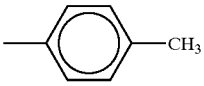 | 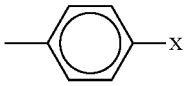 | — | — | 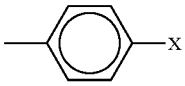 | —$(CH_2)_2$COO— —$(CH_2)_3$Si$(OMe)_3$ |
| 124 | 0 | 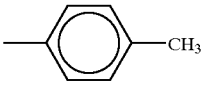 | 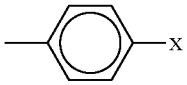 | — | — | 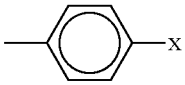 | —$(CH_2)_2$COO— —$CH_2C_6H_4(CH_2)_2$— —Si$(OMe)_3$ |
| 125 | 0 | 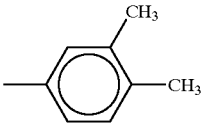 | 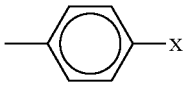 | — | — | 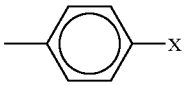 | —$CH_2$COO— —$CH_2C_6H_4(CH_2)_2$— —Si$(OMe)_3$ |
TABLE 26
| Compound | k | $Ar^1$ | $Ar^2$ | $Ar^3$ | $Ar^4$ | $Ar^5$ | X |
|---|---|---|---|---|---|---|---|
| 126 | 0 | 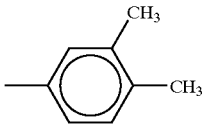 | 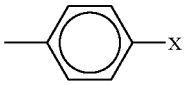 | — | — | 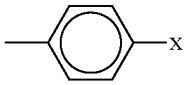 | —$(CH_2)_2$COO— —$(CH_2)_3$Si$(OMe)_3$ |
| 127 | 0 | 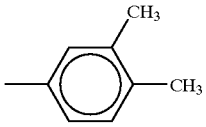 | 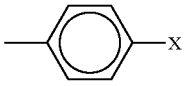 | — | — | 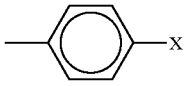 | —$(CH_2)_2$COO— —$CH_2C_6H_4$Si$(OMe)_3$ |
| 128 | 0 | 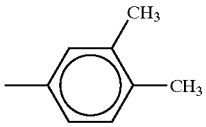 | 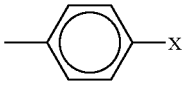 | — | — | 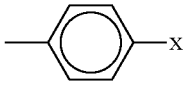 | —$(CH_2)_2$COO— —$CH_2C_6H_4(CH_2)_2$— —Si$(OMe)_3$ |
| 129 | 0 | 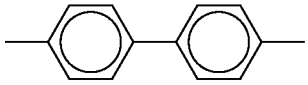 | 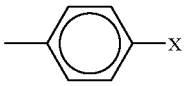 | — | — | 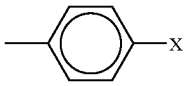 | —$CH_2$COO$(CH_2)_3$— —Si$(OMe)_3$ |
| 130 | 0 | 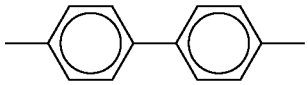 | 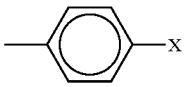 | — | — | 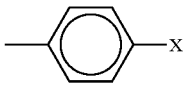 | —$(CH_2)_2$COO— —$(CH_2)_3$Si$(OMe)_3$ |

TABLE 27
| Compound | k | $Ar^1$ | $Ar^2$ |
|---|---|---|---|
| 131 | 0 | 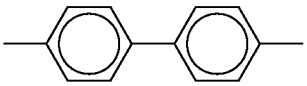 | 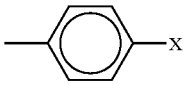 |
| 132 | 0 | 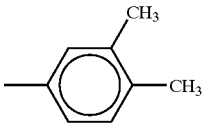 | 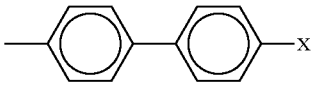 |
| 133 | 0 | 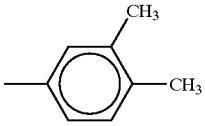 | 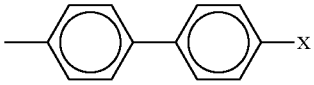 |
| 134 | 0 | 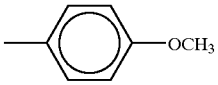 | 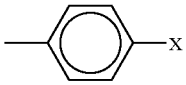 |
| 135 | 0 | 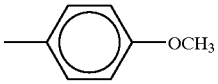 | 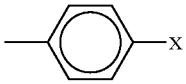 |
| Compound | k | $Ar^3$ | $Ar^4$ | $Ar^5$ | X |
|---|---|---|---|---|---|
| 131 | 0 | — | — | 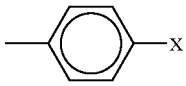 | —$(CH_2)_2COO$— —$CH_2C_6H_4(CH_2)_2$— —$Si(OMe)_3$ |
| 132 | 0 | — | — | 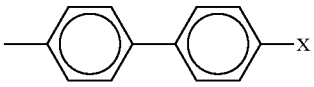 | —$COO(CH_2)_3$— —$Si(OMe)_3$ |
| 133 | 0 | — | — | 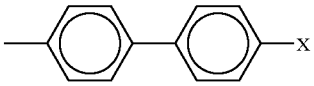 | —$COOCH_2C_6H_4$— —$(CH_2)_2Si(OMe)_3$ |
| 134 | 0 | — | — | 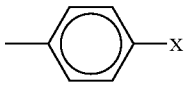 | —$CH_2COO$— —$CH_2C_6H_4(CH_2)_2$— —$Si(OMe)_3$ |
| 135 | 0 | — | — | 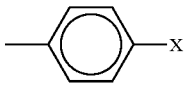 | —$(CH_2)_2COO$— —$(CH_2)_3Si(OMe)_3$ |
50
TABLE 28
| Compound | k | $Ar^1$ | $Ar^2$ | $Ar^3$ | $Ar^4$ | $Ar^5$ | X |
|---|---|---|---|---|---|---|---|
| 136 | 0 | 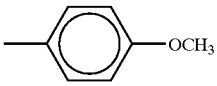 | 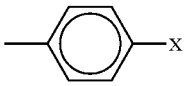 | — | — | 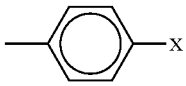 | —$(CH_2)_2COO$— —$CH_2C_6H_4(CH_2)_2$— —$Si(OMe)_3$ |
| 137 | 0 | 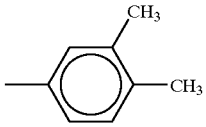 | 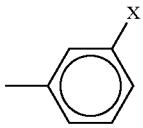 | — | — | 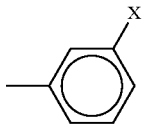 | —$(CH_2)_2COO$— —$(CH_2)_3Si(OMe)_3$ |

TABLE 28-continued
| Compound | k | $Ar^1$ | $Ar^2$ | $Ar^3$ | $Ar^4$ | $Ar^5$ | X |
|---|---|---|---|---|---|---|---|
| 138 | 0 | 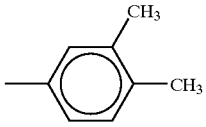 | 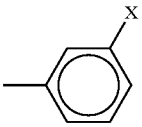 | — | — | 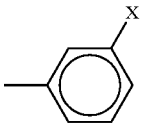 | —$(CH_2)_2COO$— —$CH_2C_6H_4Si(OMe)_3$ |
| 139 | 0 | 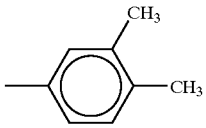 | 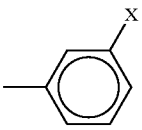 | — | — | 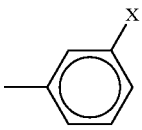 | —$(CH_2)_2COO$— —$CH_2C_6H_4(CH_2)_2$— —$Si(OMe)_3$ |
| 140 | 0 | 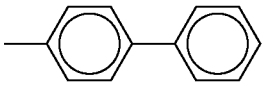 | 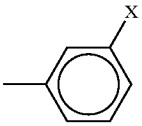 | — | — | 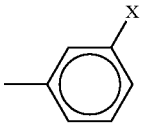 | —$CH_2COO(CH_2)_3$— —$Si(OMe)_3$ |
TABLE 29
| Compound | k | $Ar^1$ | $Ar^2$ | $Ar^3$ |
|---|---|---|---|---|
| 141 | 0 | 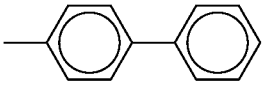 | 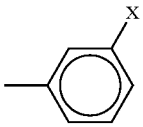 | — |
| 142 | 0 | 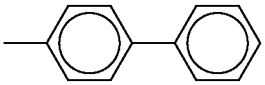 | 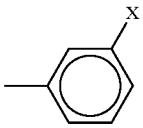 | — |
| 143 | 1 | 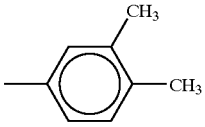 | 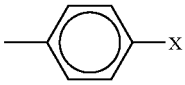 | 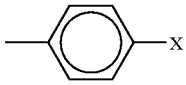 |
| 144 | 1 | 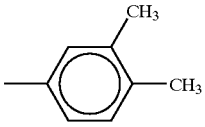 | 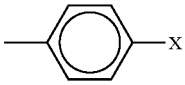 | 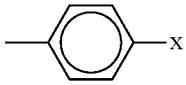 |
| 145 | 1 | 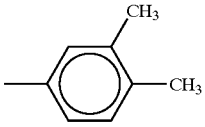 | 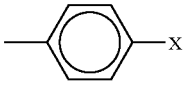 | 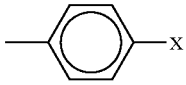 |
| Compound | k | $Ar^4$ | $Ar^5$ | X |
|---|---|---|---|---|
| 141 | 0 | — | 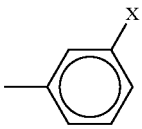 | —$(CH_2)_2COO$— —$(CH_2)_3Si(OMe)_3$ |

TABLE 29-continued
| | | | | |
|---|---|---|---|---|
| 142 | 0 | — | 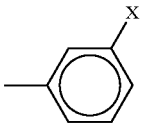 | —$(CH_2)_2COO$—<br>—$CH_2C_6H_4(CH_2)_2$—<br>—$Si(OMe)_3$ |
| 143 | 1 | 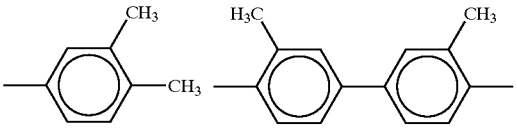 | | —$(CH_2)_2Si(OEt)_3$ |
| 144 | 1 | 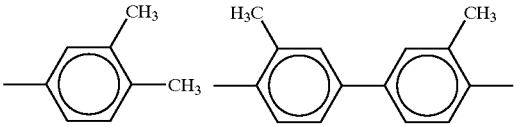 | | —$(CH_2)_3Si(OEt)_3$ |
| 145 | 1 | 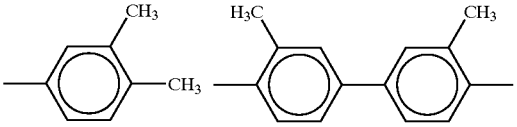 | | —$(CH_2)_4Si(OMe)_3$ |
TABLE 30
| Compound | k | $Ar^1$ | $Ar^2$ | $Ar^3$ |
|---|---|---|---|---|
| 146 | 1 | 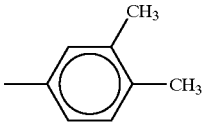 | 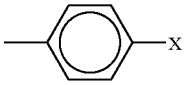 | 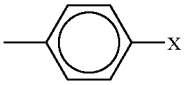 |
| 147 | 1 | 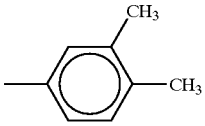 | 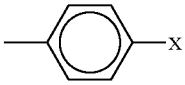 | 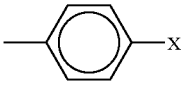 |
| 148 | 1 | 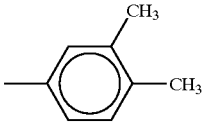 | 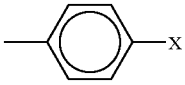 | 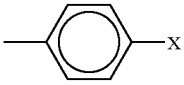 |
| 149 | 1 | 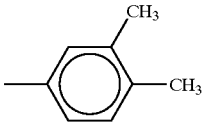 | 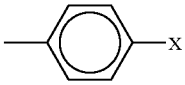 | 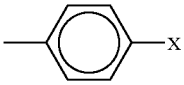 |
| 150 | 1 | 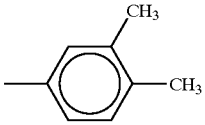 | 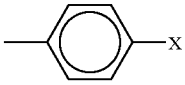 | 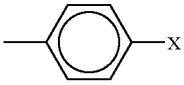 |
| Compound | k | $Ar^4$ | $Ar^5$ | X |

TABLE 30-continued
| | | | |
|---|---|---|---|
| 146 | 1 | 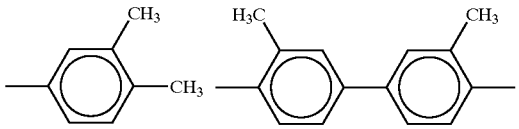 | —$(CH_2)_4$—<br>—$SiMe(OMe)_2$ |
| 147 | 1 | 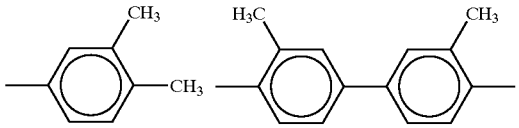 | —$(CH_2)_4$—<br>—$SiMe_2(OMe)$ |
| 148 | 1 | 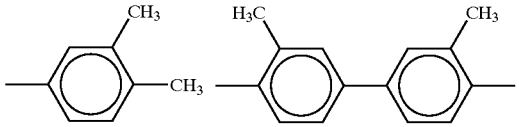 | —$(CH_2)_4Si(OEt)_3$ |
| 149 | 1 | 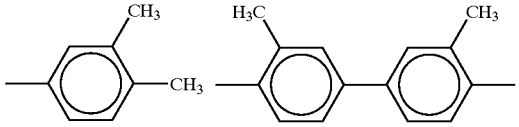 | —$(CH_2)_2C_6H_4$—<br>—$Si(OMe)_3$ |
| 150 | 1 | 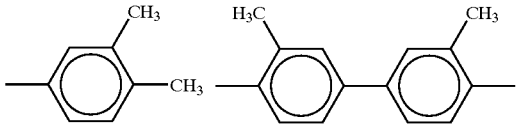 | —$(CH_2)_2C_6H_4$—<br>—$(CH_2)_2Si(OMe)_3$ |
TABLE 31
| Compound | k | $Ar^1$ | $Ar^2$ | $Ar^3$ |
|---|---|---|---|---|
| 151 | 1 | 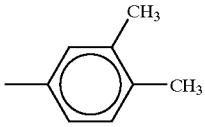 | 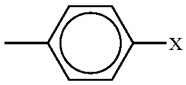 | 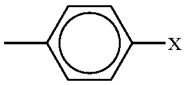 |
| 152 | 1 | 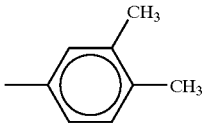 | 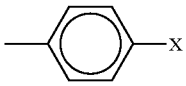 | 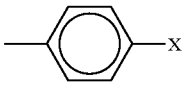 |
| 153 | 1 | 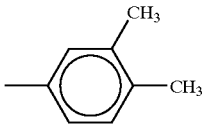 | 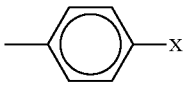 | 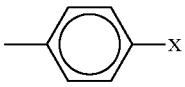 |
| 154 | 1 | 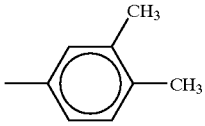 | 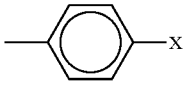 | 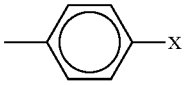 |
| 155 | 1 | 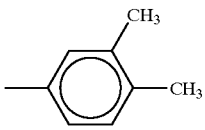 | 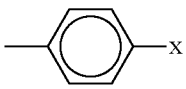 | 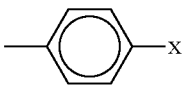 |

TABLE 31-continued
| Compound | k | $Ar^4$ | $Ar^5$ | X |
|---|---|---|---|---|
| 151 | 1 | 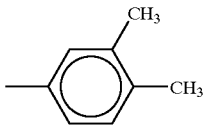 | 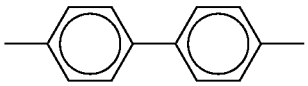 | —$(CH_2)_3$— —$Si(OMe)_2Me$ |
| 152 | 1 | 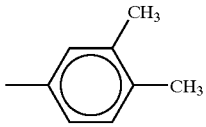 | 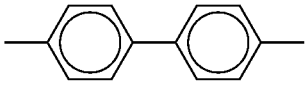 | —$(CH_2)_4Si(OMe)_3$ |
| 153 | 1 | 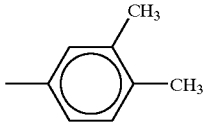 | 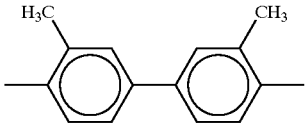 | —CH═CHSi$(OEt)_3$ |
| 154 | 1 | 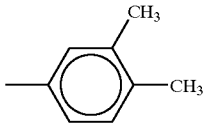 | 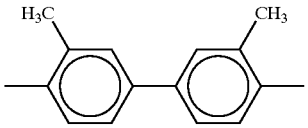 | —CH═$CHCH_2$— —$Si(OMe)_2Me$ |
| 155 | 1 | 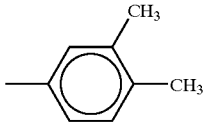 | 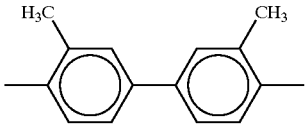 | —CH═$CH(CH_2)_2$— —$Si(OMe)_3$ |
TABLE 32
| Compound | k | $Ar^1$ | $Ar^2$ | $Ar^3$ |
|---|---|---|---|---|
| 156 | 1 | 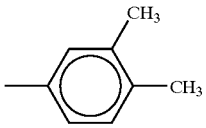 | 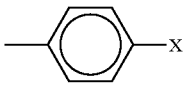 | 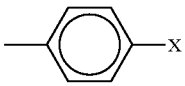 |
| 157 | 1 | 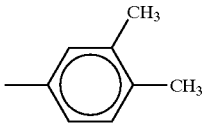 | 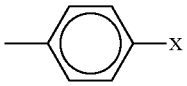 | 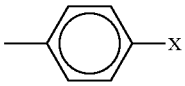 |
| 158 | 1 | 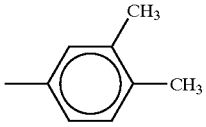 | 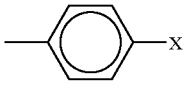 | 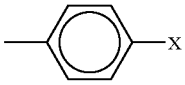 |
| 159 | 1 | 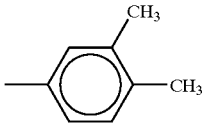 | 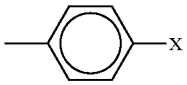 | 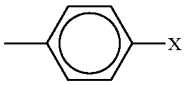 |

TABLE 32-continued
| | | | | |
|---|---|---|---|---|
| 160 | 0 | 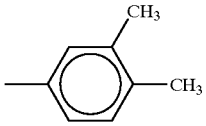 | 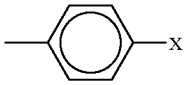 | 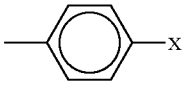 |
| Compound | k | $Ar^4$ | $Ar^5$ | X |
|---|---|---|---|---|
| 156 | 1 | 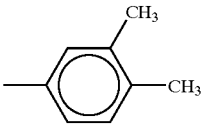 | 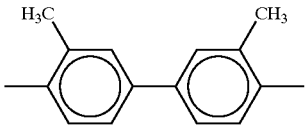 | —CH═CH$(CH_2)_2$— —SiMe$(OMe)_2$ |
| 157 | 1 | 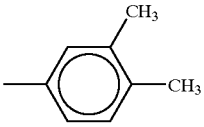 | 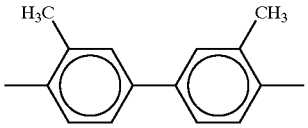 | —CH═CH$(CH_2)_2$— —SiM$e_2$(OMe) |
| 158 | 1 | 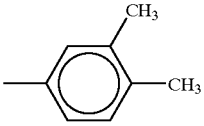 | 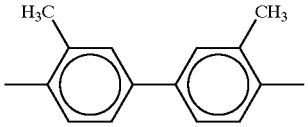 | —CH═CH$(CH_2)_2$— —Si$(OEt)_3$ |
| 159 | 1 | 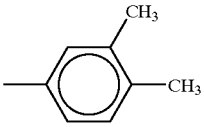 | 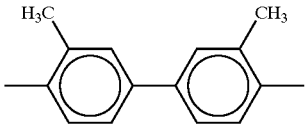 | —CH═CH$C_6H_4$— —Si$(OMe)_3$ |
| 160 | 0 | 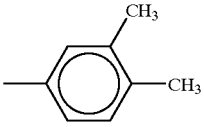 | 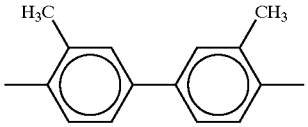 | —CH═CH$C_6H_4$— —$(CH_2)_2$Si$(OMe)_3$ |
TABLE 33
| Compound | k | $Ar^1$ | $Ar^2$ | $Ar^3$ |
|---|---|---|---|---|
| 161 | 1 | 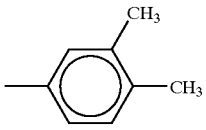 | 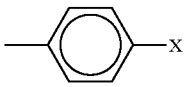 | 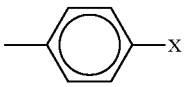 |
| 162 | 1 | 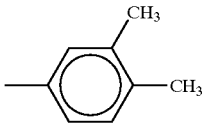 | 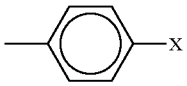 | 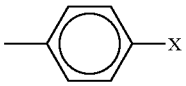 |
| 163 | 1 | 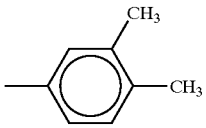 | 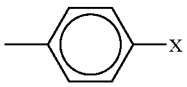 | 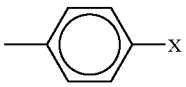 |

TABLE 33-continued
| | | | | |
|---|---|---|---|---|
| 164 | 1 | 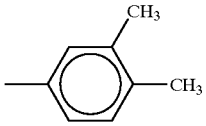 | 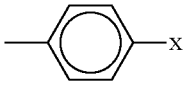 | 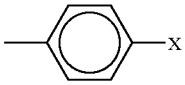 |
| 165 | 1 | 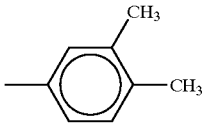 | 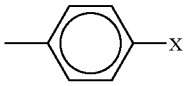 | 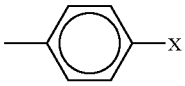 |
| Compound | k | $Ar^4$ | $Ar^5$ | X |
|---|---|---|---|---|
| 161 | 1 | 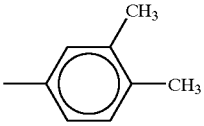 | 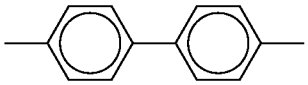 | —CH═CHCH$_2$— —Si(OMe)$_2$Me |
| 162 | 1 | 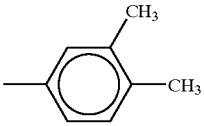 | 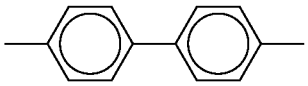 | —CH═CH(CH$_2$)$_2$— —Si(OMe)$_3$ |
| 163 | 1 | 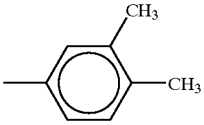 | 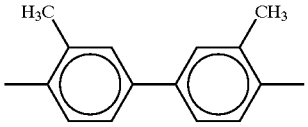 | —CH═NCH$_2$— —Si(OMe)$_2$Me |
| 164 | 1 | 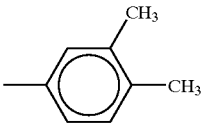 | 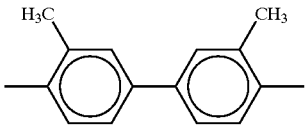 | —CH═N(CH$_2$)$_2$— —Si(OEt)$_3$ |
| 165 | 1 | 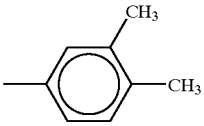 | 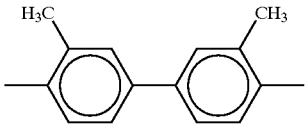 | —CH═N(CH$_2$)$_3$— —Si(OMe)$_3$ |
TABLE 34
| Compound | k | $Ar^1$ | $Ar^2$ | $Ar^3$ | $Ar^4$ |
|---|---|---|---|---|---|
| 166 | 1 | 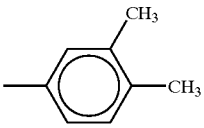 | 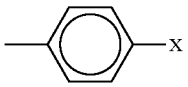 | 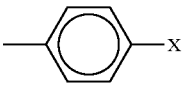 | 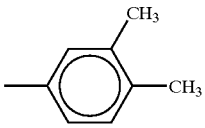 |
| 167 | 1 | 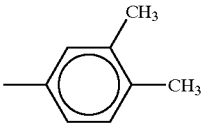 | 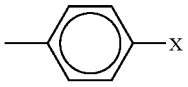 | 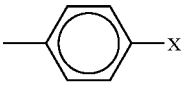 | 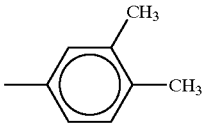 |

TABLE 34-continued
| | | | | |
|---|---|---|---|---|
| 168 | 1 | 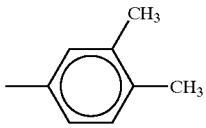 | 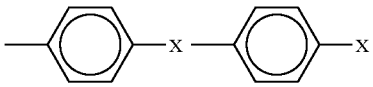 | 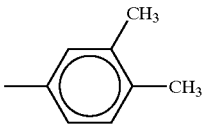 |
| 169 | 1 | 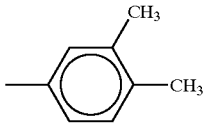 | 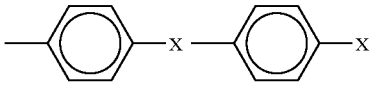 | 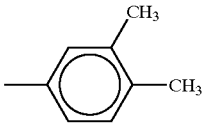 |
| 170 | 1 | 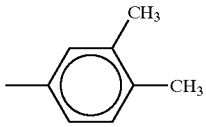 | 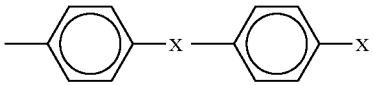 | 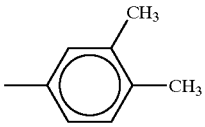 |
| Compound | k | $Ar^5$ | X |
|---|---|---|---|
| 166 | 1 | 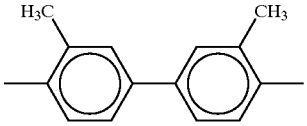 | 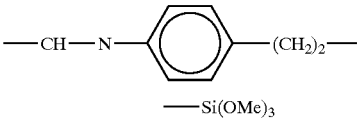 |
| 167 | 1 | 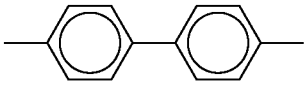 | —CH═NCH$_2$— —Si(OMe)$_2$Me |
| 168 | 1 | 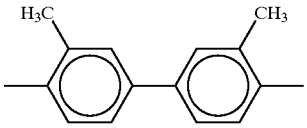 | —O(CH$_2$)$_3$Si(OMe)$_3$ |
| 169 | 1 | 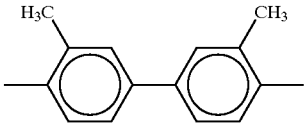 | —O(CH$_2$)$_3$— —SiMe(OMe)$_2$ |
| 170 | 1 | 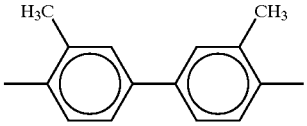 | —O(CH$_2$)$_3$Si(OEt)$_3$ |
TABLE 35
| Compound | k | $Ar^1$ | $Ar^2$ | $Ar^3$ |
|---|---|---|---|---|
| 171 | 1 | 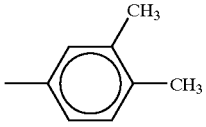 | 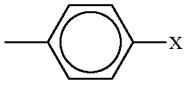 | 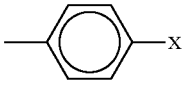 |
| 172 | 1 | 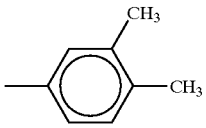 | 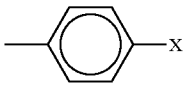 | 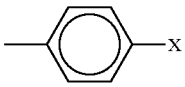 |

TABLE 35-continued
| | | | | |
|---|---|---|---|---|
| 173 | 1 | 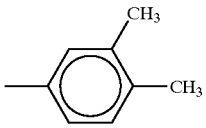 | 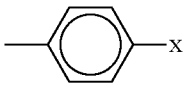 | 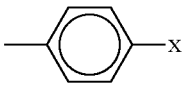 |
| 174 | 1 | 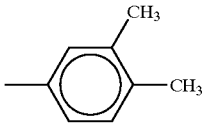 | 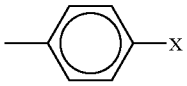 | 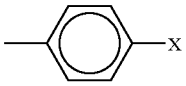 |
| 175 | 1 | 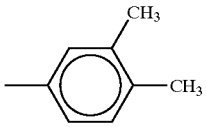 | 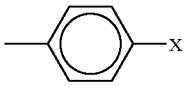 | 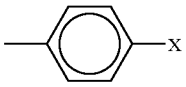 |
| Compound | k | $Ar^4$ | $Ar^5$ | X |
|---|---|---|---|---|
| 171 | 1 | 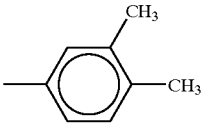 | 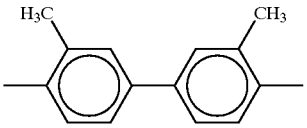 | —$CH_2O(CH_2)_3$—<br>—$Si(OMe)_3$ |
| 172 | 1 | 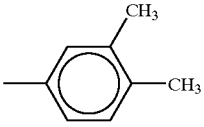 | 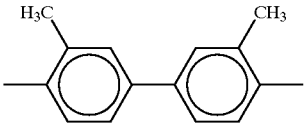 | —$(CH_2)_3O(CH_2)_3$—<br>—$Si(OMe)_3$ |
| 173 | 1 | 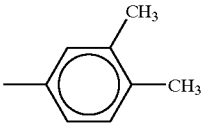 | 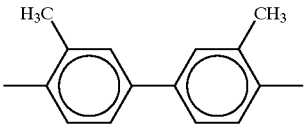 | —$COO(CH_2)_3$—<br>—$Si(OMe)_3$ |
| 174 | 1 | 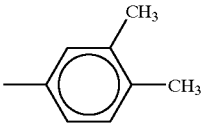 | 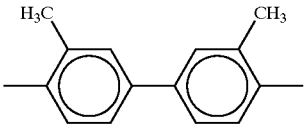 | —$COOCH_2C_6H_4$—<br>—$(CH_2)_2Si(OMe)_3$ |
| 175 | 1 | 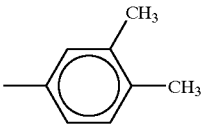 | 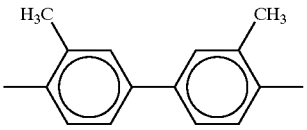 | —$CH_2COO(CH_2)_3$—<br>—$Si(OMe)_3$ |
50
TABLE 36
| Compound | k | $Ar^1$ | $Ar^2$ | $Ar^3$ |
|---|---|---|---|---|
| 176 | 1 | 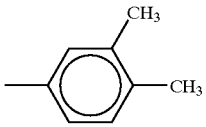 | 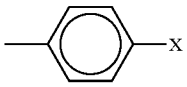 | 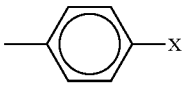 |

TABLE 36-continued
| | | | | |
|---|---|---|---|---|
| 177 | 1 | 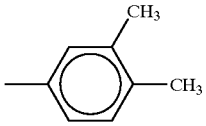 | 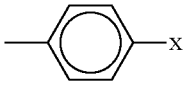 | 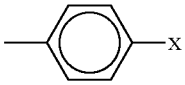 |
| 178 | 1 | 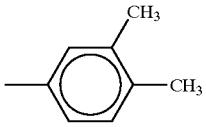 | 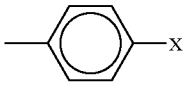 | 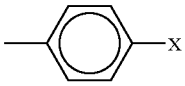 |
| 179 | 1 | 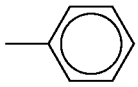 | 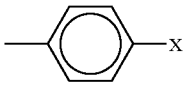 | 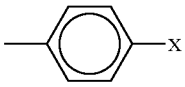 |
| 180 | 1 | 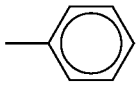 | 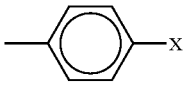 | 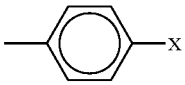 |
| Compound | k | $Ar^4$ | $Ar^5$ | X |
|---|---|---|---|---|
| 176 | 1 | 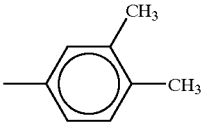 | 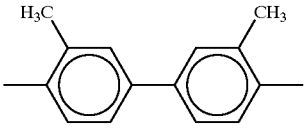 | —$CH_2COO$—<br>—$CH_2C_6H_4(CH_2)_2$—<br>—$Si(OMe)_3$ |
| 177 | 1 | 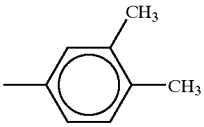 | 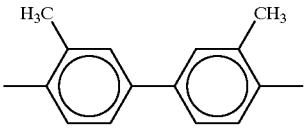 | —$(CH_2)_2COO$—<br>—$(CH_2)_3Si(OMe)_3$ |
| 178 | 1 | 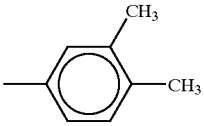 | 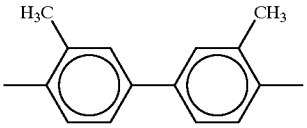 | —$(CH_2)_2COO$—<br>—$CH_2C_6H_4(CH_2)_2$—<br>—$Si(OMe)_3$ |
| 179 | 1 | 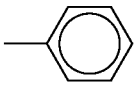 | 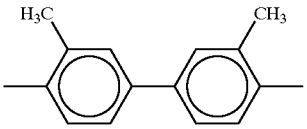 | —$COOCH_2C_6H_4$—<br>—$(CH_2)_2Si(OMe)_3$ |
| 180 | 1 | 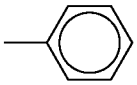 | 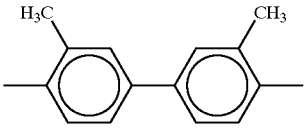 | —$CH_2COO(CH_2)_3$—<br>—$Si(OMe)_3$ |
TABLE 37
| Compound | k | $Ar^1$ | $Ar^2$ | $Ar^3$ |
|---|---|---|---|---|
| 181 | 1 | 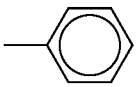 | 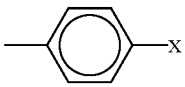 | 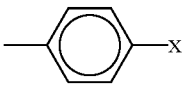 |

TABLE 37-continued
| | | | | |
|---|---|---|---|---|
| 182 | 1 | 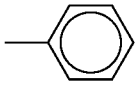 | 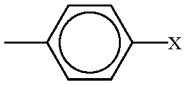 | 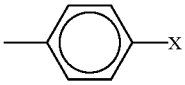 |
| 183 | 1 | 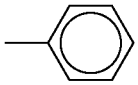 | 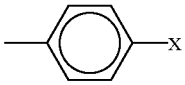 | 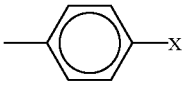 |
| 184 | 1 | 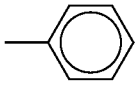 | 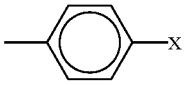 | 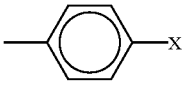 |
| 185 | 1 | 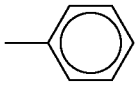 | 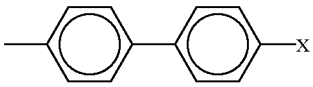 | 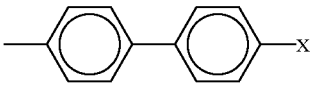 |
| Compound | k | $Ar^4$ | $Ar^5$ | X |
| 181 | 1 | 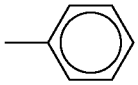 | 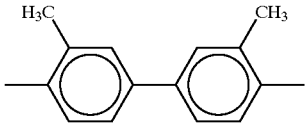 | —$CH_2COOCH_2$—<br>—$C_6H_4Si(OMe)_3$ |
| 182 | 1 | 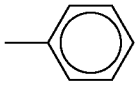 | 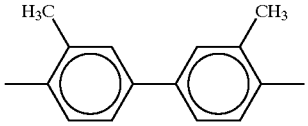 | —$CH_2COO$—<br>—$CH_2C_6H_4(CH_2)_2$—<br>—$Si(OMe)_3$ |
| 183 | 1 | 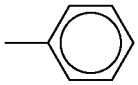 | 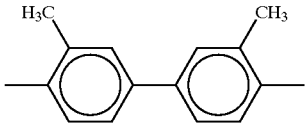 | —$(CH_2)_2COO$—<br>—$(CH_2)_3Si(OMe)_3$ |
| 184 | 1 | 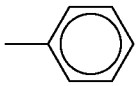 | 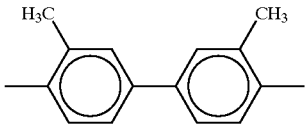 | —$(CH_2)_2COO$—<br>—$CH_2C_6H_4(CH_2)_2$—<br>—$Si(OMe)_3$ |
| 185 | 1 | 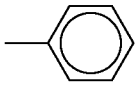 | 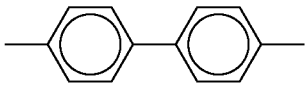 | —$COO(CH_2)_3$—<br>—$Si(OMe)_3$ |
TABLE 38
| Compound | k | $Ar^1$ | $Ar^2$ | $Ar^3$ |
|---|---|---|---|---|
| 186 | 1 | 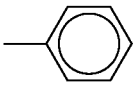 | 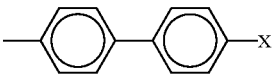 | 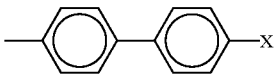 |
| 187 | 1 | 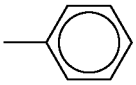 | 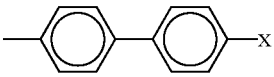 | 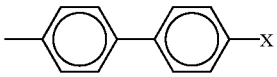 |

TABLE 38-continued
| | | | | |
|---|---|---|---|---|
| 188 | 1 | 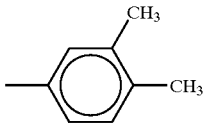 | 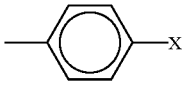 | 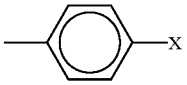 |
| 189 | 1 | 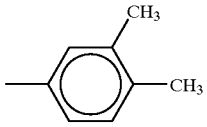 | 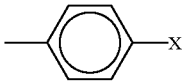 | 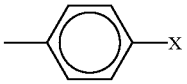 |
| 190 | 1 | 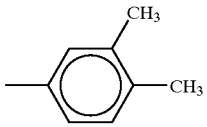 | 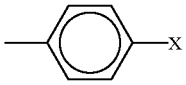 | 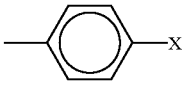 |
| Compound | k | $Ar^4$ | $Ar^5$ | X |
|---|---|---|---|---|
| 186 | 1 | 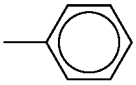 | 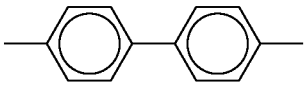 | —$COOCH_2C_6H_4$—<br>—$Si(OMe)_3$ |
| 187 | 1 | 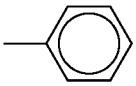 | 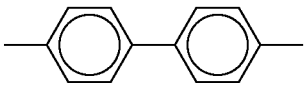 | —$COOCH_2C_6H_4$—<br>—$(CH_2)_2Si(OMe)_3$ |
| 188 | 1 | 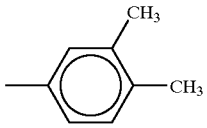 | 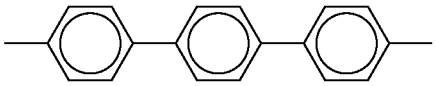 | —$COO(CH_2)_3$—<br>—$Si(OMe)_3$ |
| 189 | 1 | 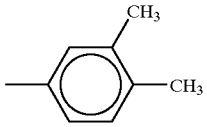 | 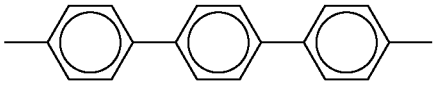 | —$COOCH_2C_6H_4$—<br>—$Si(OMe)_3$ |
| 190 | 1 | 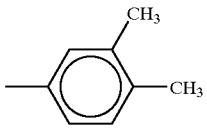 | 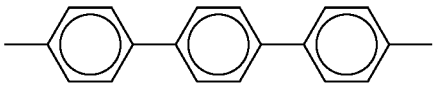 | —$COOCH_2C_6H_4$—<br>—$(CH_2)_2Si(OMe)_3$ |
TABLE 39
| Compound | k | $Ar^1$ | $Ar^2$ | $Ar^3$ |
|---|---|---|---|---|
| 191 | 1 | 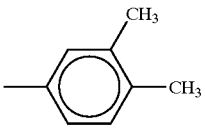 | 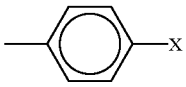 | 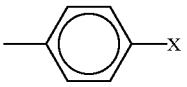 |
| 192 | 1 | 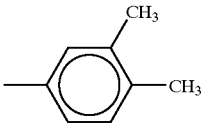 | 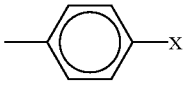 | 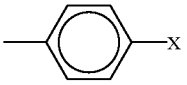 |

TABLE 39-continued
| | | | | |
|---|---|---|---|---|
| 193 | 1 | 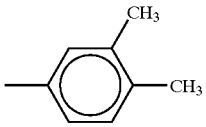 | 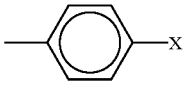 | 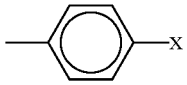 |
| 194 | 0 | 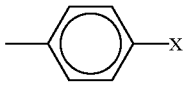 | 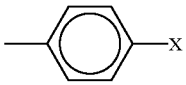 | — |
| 195 | 0 | 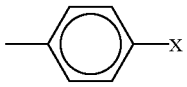 | 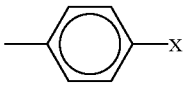 | — |
| Compound | k | $Ar^4$ | $Ar^5$ | X |
|---|---|---|---|---|
| 191 | 1 | 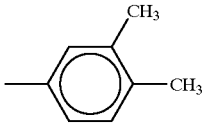 | 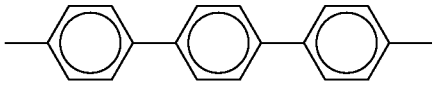 | —$CH_2COO(CH_2)_3$—<br>—$Si(OMe)_3$ |
| 192 | 1 | 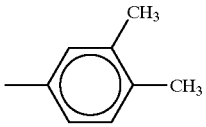 | 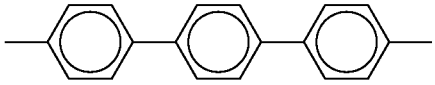 | —$(CH_2)_2COO$—<br>—$(CH_2)_3Si(OMe)_3$ |
| 193 | 1 | 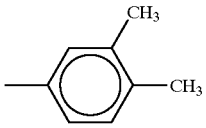 | 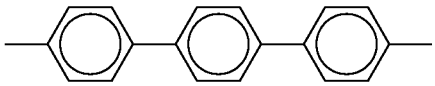 | —$(CH_2)_2COO$—<br>—$CH_2C_6H_4(CH_2)_2$—<br>—$Si(OMe)_3$ |
| 194 | 0 | — | 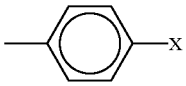 | —$(CH_2)_3$—<br>—$Si(OMe)_2Me$ |
| 195 | 0 | — | 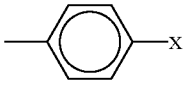 | —$(CH_2)_3Si(OEt)_3$ |
TABLE 40
| Compound | k | $Ar^1$ | $Ar^2$ | $Ar^3$ | $Ar^4$ | $Ar^5$ | X |
|---|---|---|---|---|---|---|---|
| 196 | 0 | 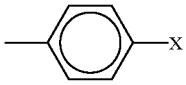 | 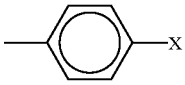 | — | — | 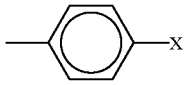 | —$(CH_2)_4Si(OMe)_3$ |
| 197 | 0 | 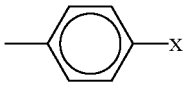 | 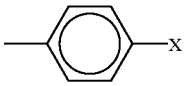 | — | — | 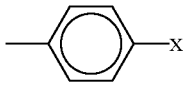 | —$(CH_2)_4$—<br>—$Si(OMe)_2Me$ |
| 198 | 0 | 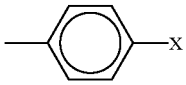 | 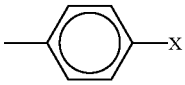 | — | — | 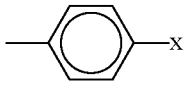 | —$(CH_2)_4SiMe_2(OMe)$ |
| 199 | 0 | 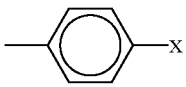 | 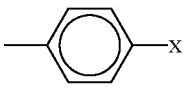 | — | — | 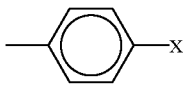 | —$(CH_2)_4Si(OEt)_3$ |

TABLE 40-continued
| Compound | k | $Ar^1$ | $Ar^2$ | $Ar^3$ | $Ar^4$ | $Ar^5$ | X |
|---|---|---|---|---|---|---|---|
| 200 | 0 | 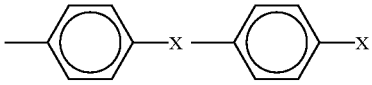 | | — | — | 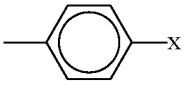 | $—(CH_2)_2Si(OMe)_3$ |
TABLE 41
| Compound | k | $Ar^1$ | $Ar^2$ | $Ar^3$ | $Ar^4$ | $Ar^5$ | X |
|---|---|---|---|---|---|---|---|
| 201 | 0 | 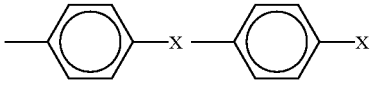 | | — | — | 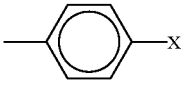 | $—(CH_2)_2C_6H_4—$ $—Si(OMe)_3$ |
| 202 | 0 | 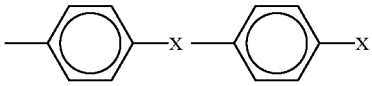 | | — | — | 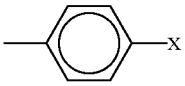 | $—(CH_2)_2C_6H_4—$ $—(CH_2)_2Si(OMe)_3$ |
| 203 | 0 | 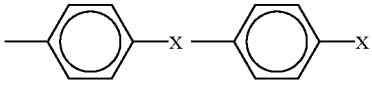 | | — | — | 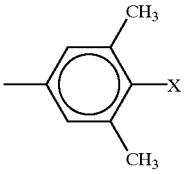 | $—(CH_2)_4Si(OMe)_3$ |
| 204 | 0 | 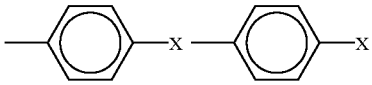 | | — | — | 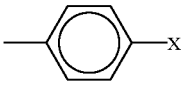 | $—CH=CHSi(OMe)_3$ |
| 205 | 0 | 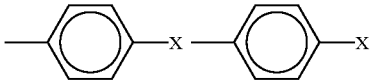 | | — | — | 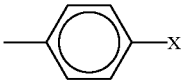 | $—CH=CHCH_2—$ $—Si(OMe)_2Me$ |
TABLE 42
| Compound | k | $Ar^1$ | $Ar^2$ | $Ar^3$ | $Ar^4$ | $Ar^5$ | X |
|---|---|---|---|---|---|---|---|
| 206 | 0 | 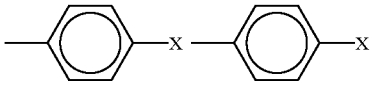 | | — | — | 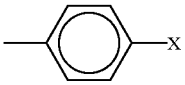 | $—CH=CH(CH_2)_2—$ $—Si(OMe)_3$ |
| 207 | 0 | 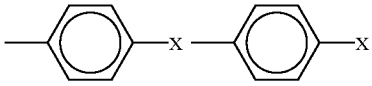 | | — | — | 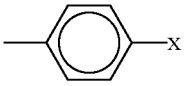 | $—CH=CH(CH_2)_2—$ $—SiMe(OMe)_2$ |
| 208 | 0 | 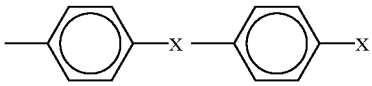 | | — | — | 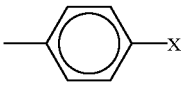 | $—CH=CH(CH_2)_2—$ $—SiMe_2(OMe)$ |
| 209 | 0 | 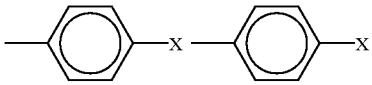 | | — | — | 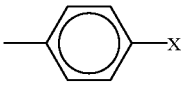 | $—CH=CH(CH_2)_2—$ $—Si(OEt)_3$ |

TABLE 42-continued
| Compound | k | $Ar^1$ | $Ar^2$ | $Ar^3$ | $Ar^4$ | $Ar^5$ | X |
|---|---|---|---|---|---|---|---|
| 210 | 0 | 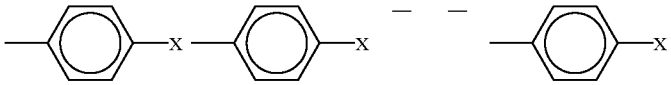 | | — | — | | —CH═CH$(CH_2)_{10}$— —Si$(OMe)_3$ |
TABLE 43
| Compound | k | $Ar^1$ | $Ar^2$ | $Ar^3$ | $Ar^4$ | $Ar^5$ | X |
|---|---|---|---|---|---|---|---|
| 211 | 0 | 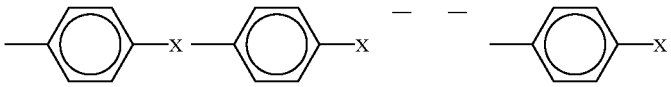 | | — | — | | —CH═CH$C_6H_4$— —Si$(OMe)_3$ |
| 212 | 0 | 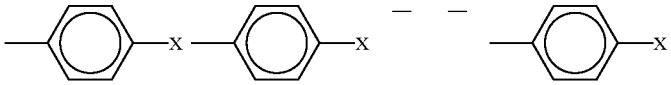 | | — | — | | —CH═$CH_6H_4$— —$(CH_2)_2$Si$(OMe)_3$ |
| 213 | 0 | 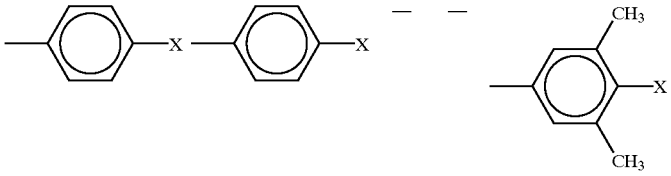 | | — | — | | —CH═CH$(CH_2)_2$— —Si$(OMe)_3$ |
| 214 | 0 | 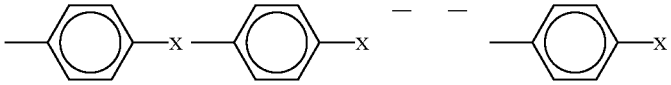 | | — | — | | —CH═N$(CH_2)_3$— —Si$(OMe)_3$ |
| 215 | 0 | 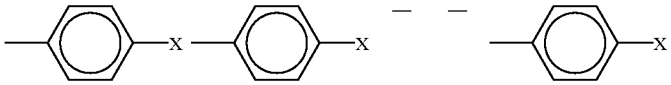 | | — | — | | —CH═N$(CH_2)_3$— —Si$(OEt)_3$ |
TABLE 44
| Compound | k | $Ar^1$ | $Ar^2$ | $Ar^3$ | $Ar^4$ | $Ar^5$ | X |
|---|---|---|---|---|---|---|---|
| 216 | 0 | 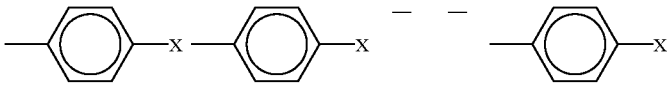 | | — | — | | —CH═N$CH_2$— —Si$(OMe)_2$Me |
| 217 | 0 | 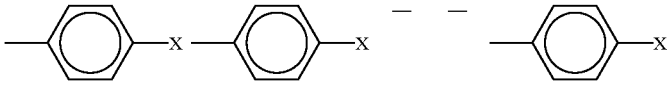 | | — | — | | —CH═N$C_6H_4$— —$(CH_2)_2$Si$(OMe)_3$ |
| 218 | 0 | 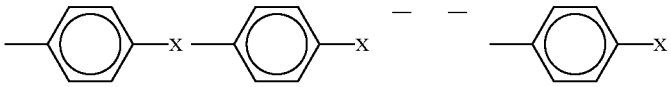 | | — | — | | —CH═N$(CH_2)_2$— —Si$(OMe)_3$ |
| 219 | 0 | 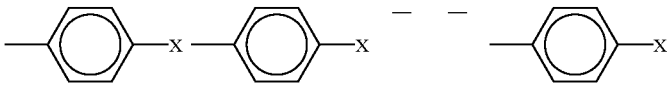 | | — | — | | —O$(CH_2)_3$Si$(OMe)_3$ |

TABLE 44-continued
| Compound | k | $Ar^1$ | $Ar^2$ | $Ar^3$ | $Ar^4$ | $Ar^5$ | X |
|---|---|---|---|---|---|---|---|
| 220 | 0 | 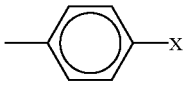 | 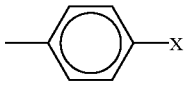 | — | — | 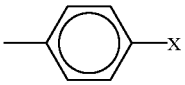 | —O(CH$_2$)$_3$—<br>—Si(OMe)$_2$Me |
TABLE 45
| Compound | k | $Ar^1$ | $Ar^2$ | $Ar^3$ |
|---|---|---|---|---|
| 221 | 0 | 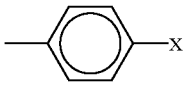 | 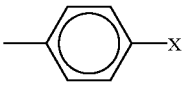 | — |
| 222 | 0 | 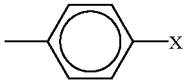 | 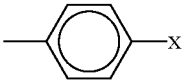 | — |
| 223 | 0 | 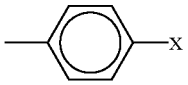 | 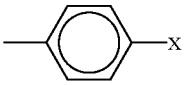 | — |
| 224 | 1 | 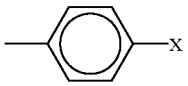 | 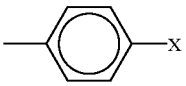 | 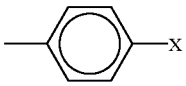 |
| 225 | 1 | 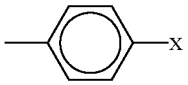 | 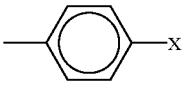 | 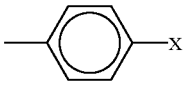 |
| Compound | k | $Ar^4$ | $Ar^5$ | X |
|---|---|---|---|---|
| 221 | 0 | — | 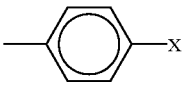 | —O(CH$_2$)$_3$Si(OEt)$_3$ |
| 222 | 0 | — | 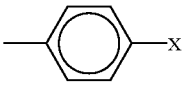 | —CH$_2$O(CH$_2$)$_3$—<br>—Si(OMe)$_3$ |
| 223 | 0 | — | 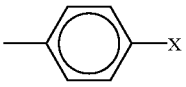 | —(CH$_2$)$_3$O(CH$_2$)$_3$—<br>—Si(OMe)$_2$Me |
| 224 | 1 | 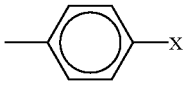 | 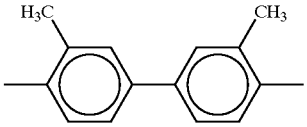 | —(CH$_2$)$_4$Si(OMe)$_3$ |
| 225 | 1 | 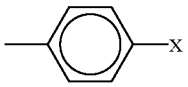 | 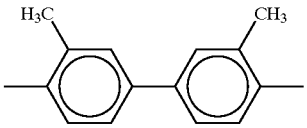 | —(CH$_2$)$_3$Si(OEt)$_3$ |

TABLE 46
| Compound | k | $Ar^1$ | $Ar^2$ | $Ar^3$ |
|---|---|---|---|---|
| 226 | 1 | 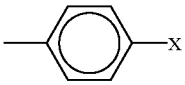 | 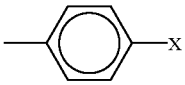 | 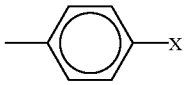 |
| 227 | 1 | 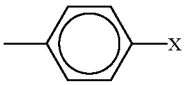 | 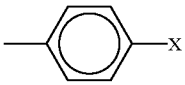 | 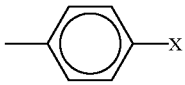 |
| 228 | 1 | 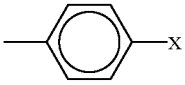 | 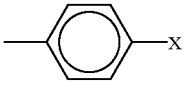 | 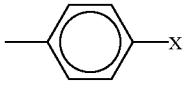 |
| 229 | 1 | 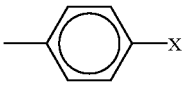 | 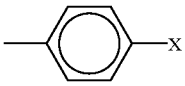 | 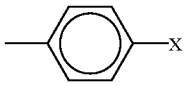 |
| 230 | 1 | 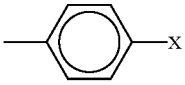 | 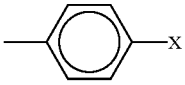 | 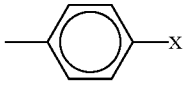 |
| Compound | k | $Ar^4$ | $Ar^5$ | X |
|---|---|---|---|---|
| 226 | 1 | 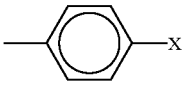 | 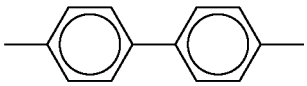 | —$CH_2CH_2$—$(CH_2)_2$— —$Si(OMe)_3$ |
| 227 | 1 | 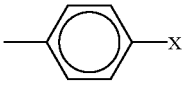 | 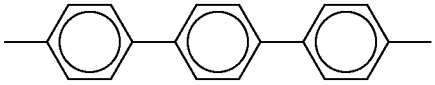 | —$CH_2CH_2$—$(CH_2)_2$— —$Si(OMe)_3$ |
| 228 | 1 | 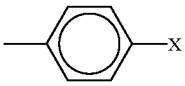 | 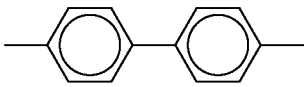 | —$CH_2CH_2$—$CH_2$— —$Si(OMe)_2Me$ |
| 229 | 1 | 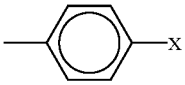 | 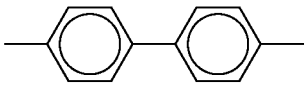 | —$CH_2CH_2$—$C_6H_4$— —$Si(OMe)_2Me$ |
| 230 | 1 | 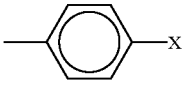 | 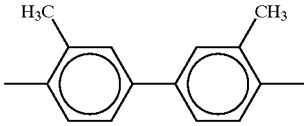 | —CH═CH$(CH_2)_2$— —$Si(OMe)_3$ |
TABLE 47
| Compound | k | $Ar^1$ | $Ar^2$ | $Ar^3$ |
|---|---|---|---|---|
| 231 | 1 | 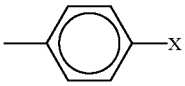 | 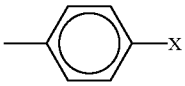 | 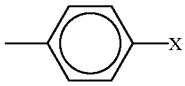 |
| 232 | 1 | 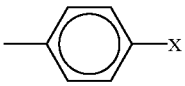 | 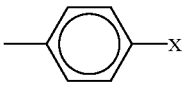 | 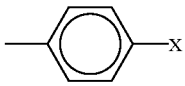 |

TABLE 47-continued
| | | | | |
|---|---|---|---|---|
| 233 | 1 | 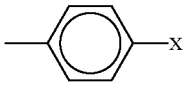 | 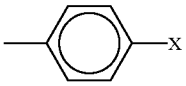 | 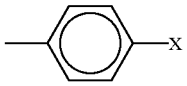 |
| 234 | 1 | 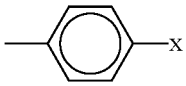 | 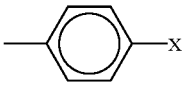 | 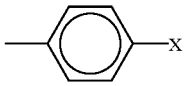 |
| 235 | 1 | 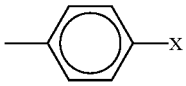 | 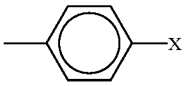 | 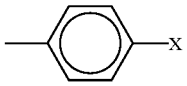 |
| Compound | k | $Ar^4$ | $Ar^5$ | X |
| 231 | 1 | 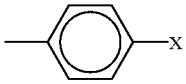 | 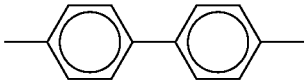 | —CH═CH$(CH_2)_2$— —Si$(OMe)_3$ |
| 232 | 1 | 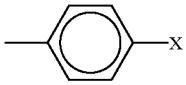 | 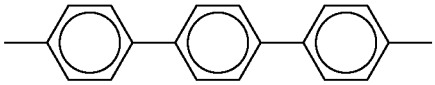 | —CH═CH$(CH_2)_2$— —Si$(OMe)_3$ |
| 233 | 1 | 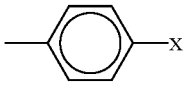 | 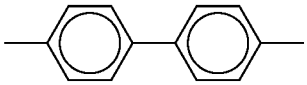 | —CH═CH$CH_2$— —Si$(OMe)_2$Me |
| 234 | 1 | 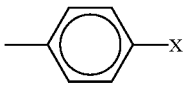 | 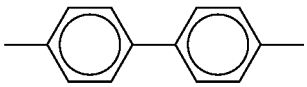 | —CH═CH$C_6H_4$— —Si$(OMe)_3$ |
| 235 | 1 | 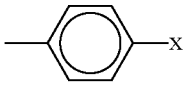 | 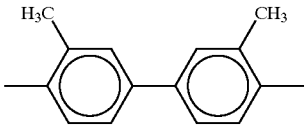 | —CH═N$(CH_2)_3$— —Si$(OMe)_3$ |
TABLE 48
| Compound | k | $Ar^1$ | $Ar^2$ | $Ar^3$ |
|---|---|---|---|---|
| 236 | 1 | 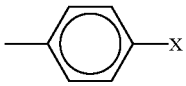 | 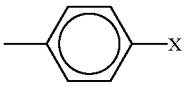 | 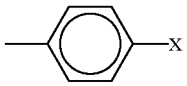 |
| 237 | 1 | 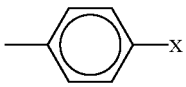 | 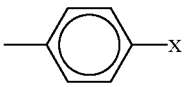 | 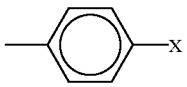 |
| 238 | 1 | 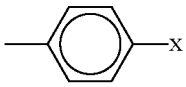 | 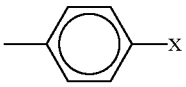 | 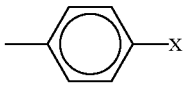 |
| 239 | 1 | 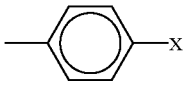 | 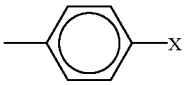 | 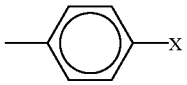 |
| 240 | 1 | 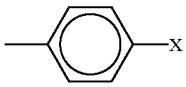 | 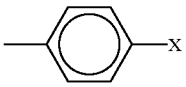 | 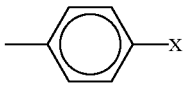 |

TABLE 48-continued
| Compound | k | $Ar^4$ | $Ar^5$ | X |
|---|---|---|---|---|
| 236 | 1 | 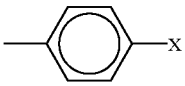 | 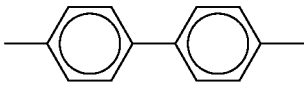 | —CH═N$(CH_2)_3$— —Si$(OMe)_3$ |
| 237 | 1 | 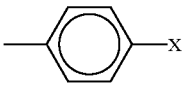 | 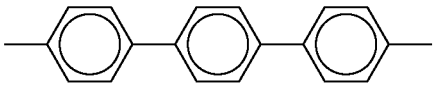 | —CH═N$(CH_2)_3$— —Si$(OMe)_3$ |
| 238 | 1 | 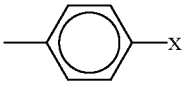 | 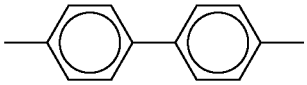 | —CH═N$CH_2$— —Si$(OMe)_2$Me |
| 239 | 1 | 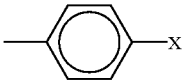 | 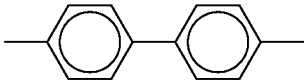 | —CH═N$C_6H_4$— —$(CH_2)_2$Si$(OMe)_3$ |
| 240 | 1 | 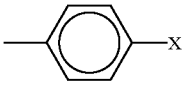 | 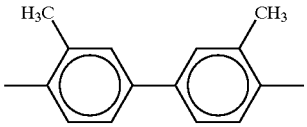 | —O$(CH_2)_3$Si$(OMe)_3$ |
TABLE 49
| Compound | k | $Ar^1$ | $Ar^2$ | $Ar^3$ |
|---|---|---|---|---|
| 241 | 1 | 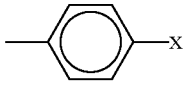 | 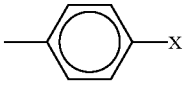 | 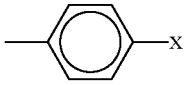 |
| 242 | 1 | 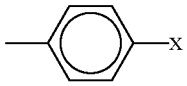 | 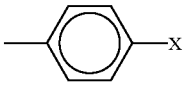 | 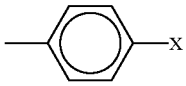 |
| 243 | 1 | 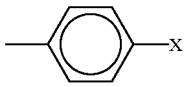 | 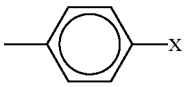 | 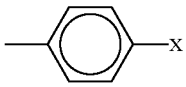 |
| 244 | 1 | 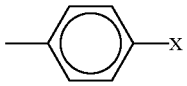 | 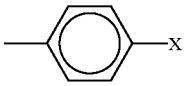 | 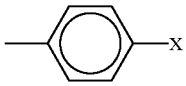 |
| 245 | 0 | 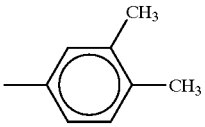 | 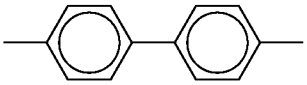 | — |
| Compound | k | $Ar^4$ | $Ar^5$ | X |
|---|---|---|---|---|
| 241 | 1 | 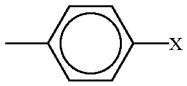 | 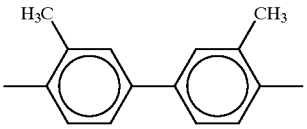 | —O$(CH_2)_3$Si$(OEt)_3$ |

TABLE 49-continued

| | | | | |
|---|---|---|---|---|
| 242 | 1 | 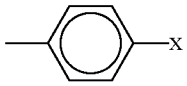 | 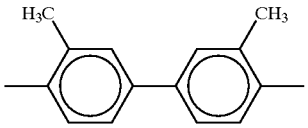 | —$CH_2O(CH_2)_3$—<br>—$Si(OMe)_3$ |
| 243 | 1 | 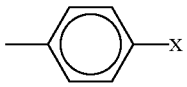 | 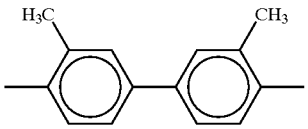 | —$CH_2O(CH_2)_3$—<br>—$Si(OEt)_3$ |
| 244 | 1 | 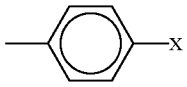 | 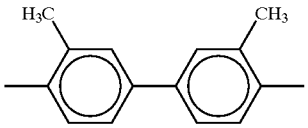 | —$(CH_2)_3O(CH_2)_3$—<br>—$Si(OMe)_3$ |
| 245 | 0 | — | 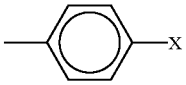 | —$COO(CH_2)_3$—<br>—$Si(O\text{-}i\text{-}Pr)_3$ |

25

TABLE 50

| Compound | k | $Ar^1$ | $Ar^2$ | $Ar^3$ | $Ar^4$ | $Ar^5$ | X |
|---|---|---|---|---|---|---|---|
| 246 | 0 | 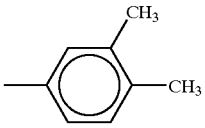 | 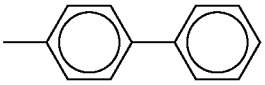 | — | — | 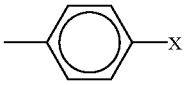 | —$COOCH_2C_6H_4$—<br>—$(CH_2)_2$—<br>—$Si(O\text{-}i\text{-}Pr)_3$ |
| 247 | 0 | 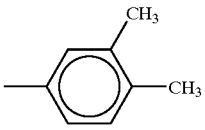 | 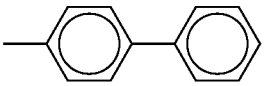 | — | — | 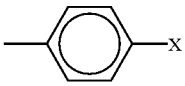 | —$CH_2COO(CH_2)_3$—<br>—$Si(O\text{-}i\text{-}Pr)_3$ |
| 248 | 0 | 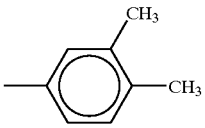 | 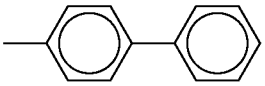 | — | — | 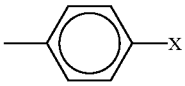 | —$CH_2COOCH_2$—<br>—$C_6H_4(CH_2)_2$—<br>—$Si(O\text{-}i\text{-}Pr)_3$ |
| 249 | 0 | 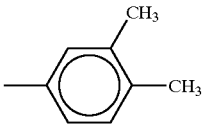 | 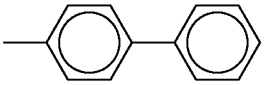 | — | — | 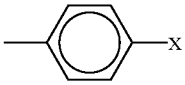 | —$(CH_2)_2COO$—<br>—$(CH_2)_3$—<br>—$Si(O\text{-}i\text{-}Pr)_3$ |
| 250 | 0 | 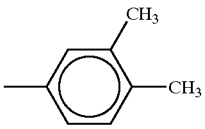 | 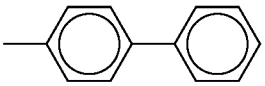 | — | — | 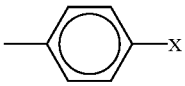 | —$(CH_2)_2COOCH_2$—<br>—$C_6H_4(CH_2)_2$—<br>—$Si(O\text{-}i\text{-}Pr)_3$ |

TABLE 51
| Compound | k | $Ar^1$ | $Ar^2$ | $Ar^3$ |
|---|---|---|---|---|
| 251 | 1 | 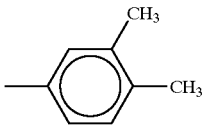 | 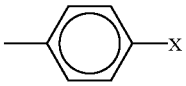 | 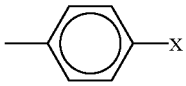 |
| 252 | 1 | 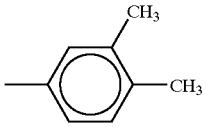 | 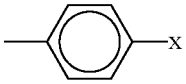 | 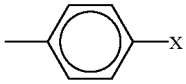 |
| 253 | 1 | 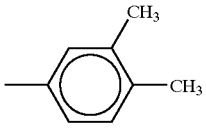 | 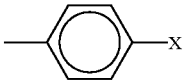 | 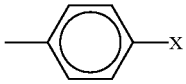 |
| 254 | 1 | 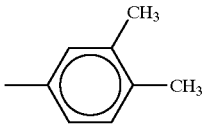 | 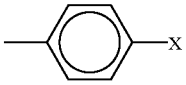 | 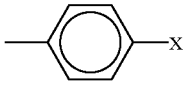 |
| 255 | 1 | 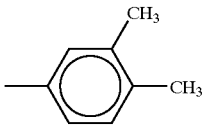 | 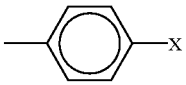 | 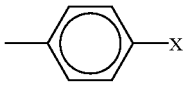 |
| Compound | k | $Ar^4$ | $Ar^5$ | X |
|---|---|---|---|---|
| 251 | 1 | 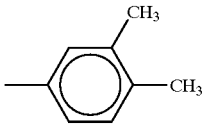 | 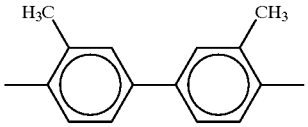 | —COO$(CH_2)_3$—<br>—Si(O-i-Pr)$_3$ |
| 252 | 1 | 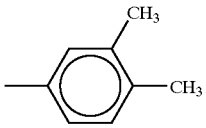 | 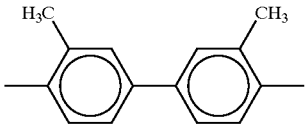 | —COO$CH_2C_6H_4$—<br>—$(CH_2)_2$—<br>—Si(O-i-Pr)$_3$ |
| 253 | 1 | 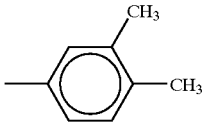 | 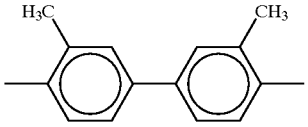 | —$CH_2$COO$(CH_2)_3$—<br>—Si(O-i-Pr)$_3$ |
| 254 | 1 | 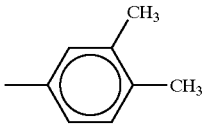 | 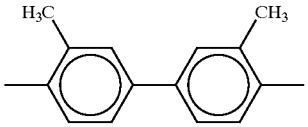 | —$CH_2$COO$CH_2$—<br>—$C_6H_4(CH_2)_2$—<br>—Si(O-i-Pr)$_3$ |
| 255 | 1 | 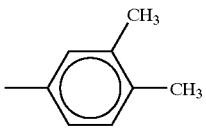 | 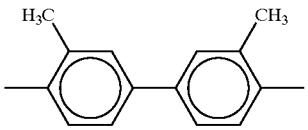 | —$(CH_2)_2$COO—<br>—$(CH_2)_3$—<br>—Si(O-i-Pr)$_3$ |

TABLE 52
| Compound | k | $Ar^1$ | $Ar^2$ | $Ar^3$ |
|---|---|---|---|---|
| 256 | 1 | 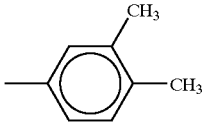 | 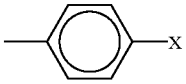 | 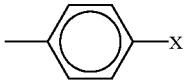 |
| 257 | 0 | 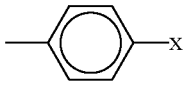 | 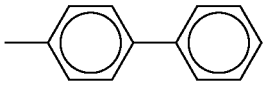 | — |
| 258 | 0 | 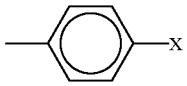 | 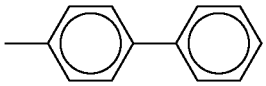 | — |
| 259 | 0 | 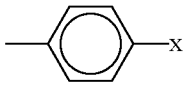 | 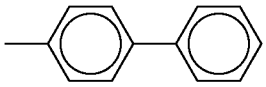 | — |
| 260 | 0 | 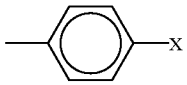 | 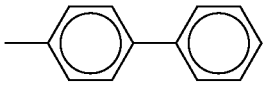 | — |
| Compound | k | $Ar^4$ | $Ar^5$ | X |
|---|---|---|---|---|
| 256 | 1 | 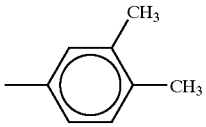 | 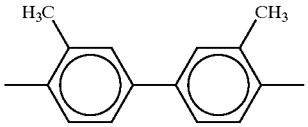 | —$(CH_2)_2COOCH_2$—<br>—$C_6H_4(CH_2)_2$—<br>—Si(O-i-Pr)$_3$ |
| 257 | 0 | — | 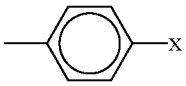 | —$COO(CH_2)_3$—<br>—Si(O-i-Pr)$_3$ |
| 258 | 0 | — | 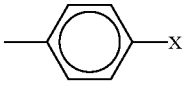 | —$COOCH_2C_6H_4$—<br>—$(CH_2)_2$—<br>—Si(O-i-Pr)$_3$ |
| 259 | 0 | — | 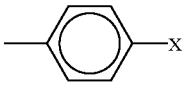 | —$CH_2COO(CH_2)_3$—<br>—Si(O-i-Pr)$_3$ |
| 260 | 0 | — | 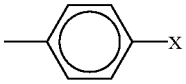 | —$CH_2COOCH_2$—<br>—$C_6H_4(CH_2)_2$—<br>—Si(O-i-Pr)$_3$ |
TALBE 53
| Compound | k | $Ar^1$ | $Ar^2$ | $Ar^3$ |
|---|---|---|---|---|
| 261 | 0 | 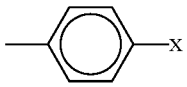 | 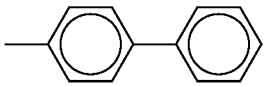 | — |
| 262 | 0 | 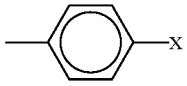 | 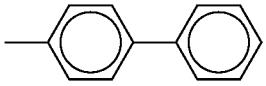 | — |

TALBE 53-continued
| | | | | |
|---|---|---|---|---|
| 263 | 1 | 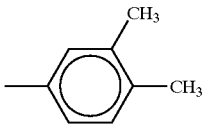 | 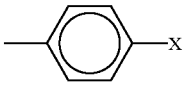 | 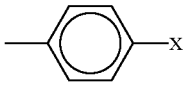 |
| 264 | 1 | 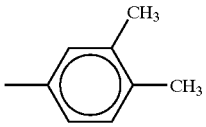 | 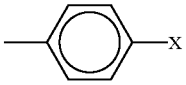 | 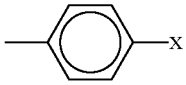 |
| 265 | 1 | 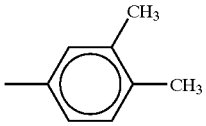 | 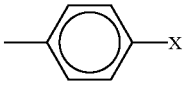 | 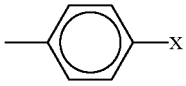 |
| Compound | k | $Ar^4$ | $Ar^5$ | X |
|---|---|---|---|---|
| 261 | 0 | — | 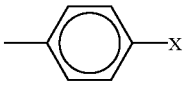 | —$(CH_2)_2COO$—<br>—$(CH_2)_3$—<br>—$Si(O\text{-}i\text{-}Pr)_3$ |
| 262 | 0 | — | 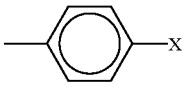 | —$(CH_2)_2COOCH_2$—<br>—$C_6H_4(CH_2)_2$—<br>—$Si(O\text{-}i\text{-}Pr)_3$ |
| 263 | 1 | 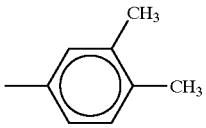 | 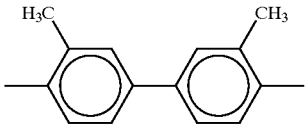 | —$COO(CH_2)_3$—<br>—$SiMe(O\text{-}i\text{-}Pr)_2$ |
| 264 | 1 | 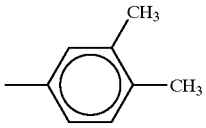 | 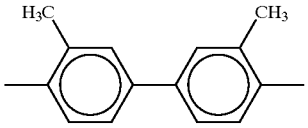 | —$COOCH_2C_6H_4$—<br>—$(CH_2)_2$—<br>—$SiMe(O\text{-}i\text{-}Pr)_2$ |
| 265 | 1 | 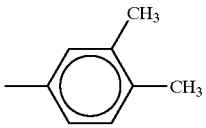 | 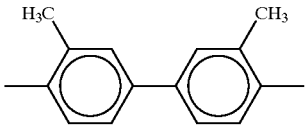 | —$CH_2COO(CH_2)_3$—<br>—$SiMe(O\text{-}i\text{-}Pr)_2$ |
TABLE 54
| Compound | k | $Ar^1$ | $Ar^2$ | $Ar^3$ |
|---|---|---|---|---|
| 266 | 1 | 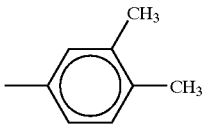 | 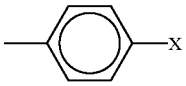 | 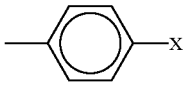 |
| 267 | 1 | 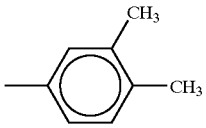 | 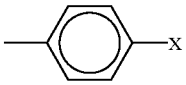 | 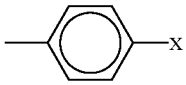 |

TABLE 54-continued
| | | | | |
|---|---|---|---|---|
| 268 | 1 | 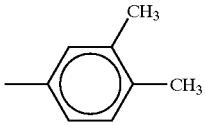 | 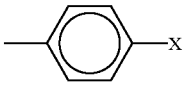 | 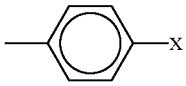 |
| 269 | 0 | 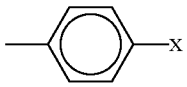 | 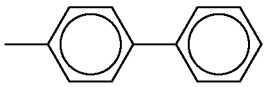 | — |
| 270 | 0 | 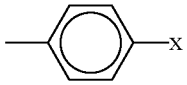 | 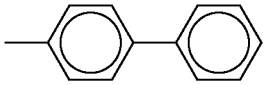 | — |
| Compound | k | $Ar^4$ | $Ar^5$ | X |
|---|---|---|---|---|
| 266 | 1 | 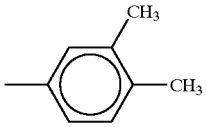 | 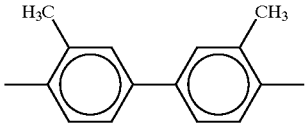 | —$CH_2COOCH_2$—<br>—$C_6H_4(CH_2)_2$—<br>—SiMe(O-i-Pr)$_2$ |
| 267 | 1 | 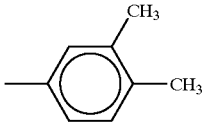 | 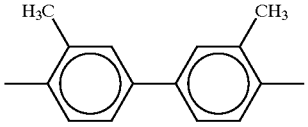 | —$(CH_2)_2COO$—<br>—$(CH_2)_3$—<br>—SiMe(O-i-Pr)$_2$ |
| 268 | 1 | 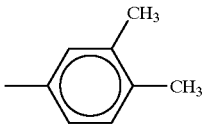 | 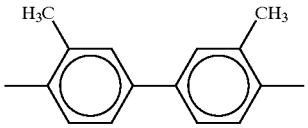 | —$(CH_2)_2COOCH_2$—<br>—$C_6H_4(CH_2)_2$—<br>—SiMe(O-i-Pr)$_2$ |
| 269 | 0 | — | 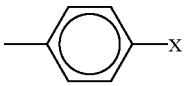 | —$COO(CH_2)_3$—<br>—SiMe(O-i-Pr)$_2$ |
| 270 | 0 | — | 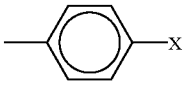 | —$COOCH_2C_6H_4$—<br>—$(CH_2)_2$—<br>—SiMe(O-i-Pr)$_2$ |
TABLE 55
| Compound | k | $Ar^1$ | $Ar^2$ | $Ar^3$ | $Ar^4$ | $Ar^5$ | X |
|---|---|---|---|---|---|---|---|
| 271 | 0 | 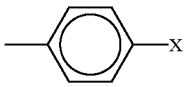 | 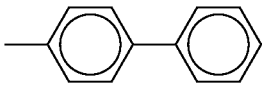 | — | — | 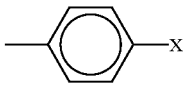 | —$CH_2COO(CH_2)_3$—<br>—SiMe(O-i-Pr)$_2$ |
| 272 | 0 | 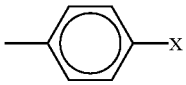 | 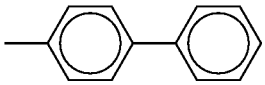 | — | — | 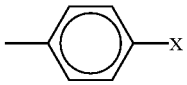 | —$CH_2COOCH_2$—<br>—$C_6H_4(CH_2)_2$—<br>—SiMe(O-i-Pr)$_2$ |
| 273 | 0 | 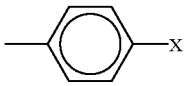 | 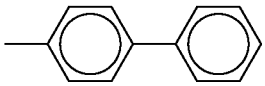 | — | — | 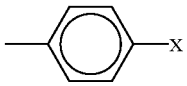 | —$(CH_2)_2COO$—<br>—$(CH_2)_3$—<br>—SiMe(O-i-Pr)$_2$ |

TABLE 55-continued

| Compound | k | $Ar^1$ | $Ar^2$ | $Ar^3$ | $Ar^4$ | $Ar^5$ | X |
|---|---|---|---|---|---|---|---|
| 274 | 0 | 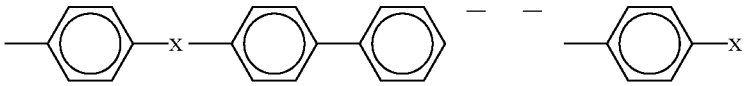 | | — | — | | —$(CH_2)_2COOCH_2$—<br>—$C_6H_4(CH_2)_2$—<br>—$SiMe(O\text{-}i\text{-}Pr)_2$ |

The photofunctional organic silicon compound represented by the general formula (I) may be used alone or in combination of more than one compound with the same general formula.

At the time of forming the surface layer, for the purpose to further improve the mechanical strength of the cured film, at least one kind of compounds having groups possible to be bonded with the compound represented by the general formula (I) is preferably added.

The group possible to be bonded with the compound represented by the general formula (I) represents a group possible to be bonded with silanol groups generated at the time of hydrolysis of the compound represented by the general formula (I) and practically, the group is a group represented by —$Si(R_1)_{(3-a)}Q_a$, epoxy group, isocyanate group, carboxyl, hydroxyl, a halogen and the like. Among them, compounds having a hydrolyzable group represented by $Si(R_1)_{(3-a)}Q_a$, epoxy group, or isocyanate group are preferable since they have higher mechanical strength. Further as the compound having the group possible to be bonded with the compound represented by the general formula (I), those having at least two of these groups in the molecule are preferable since they are capable of making the cross-linking structure three-dimensional and providing higher mechanical strength to the film. Among them, most preferable examples of the compounds are those represented by the general formula (III):

$$B\text{—}[\text{—}A']_n \qquad \text{General formula (III)}$$

(wherein, the reference character A' represents a substituent silicon group having a hydrolyzable group represented by —$Si(R_1)_{(3-a)}Q_a$; and the reference character B represents at least one group selected from an n-valent hydrocarbon group optionally comprising branches; an n-valent phenyl; —NH—; —O—Si—; or their combination. The reference character a represents an integer of 1 to 3, and the reference character n represents an integer of not less than 2.).

The compound represented by the general formula (III) is a compound having more than one substituent silicon groups A' having the hydrolyzable group represented by $Si(R_1)_{(3-a)}Q_a$. The portion of Si group contained in A' is reacted with the compound represented by the general formula (I) or the compound (III) itself to form Si—O—Si bonds and form a three-dimensional cross-linked cured film. Since the compound represented by the general formula (I) has the similar Si group, it is possible for the compound to form a cured film by itself, and since the compound (III) contains more than one groups A', the cross-linked structure of the resulting cured film is supposed to become three-dimensional and the film is supposed to be provided with higher mechanical strength. Further, similar to the D portion in the compound represented by the general formula (I), the compound has a function of giving proper flexibility to the cross-linked cured film. As the compound (III), those among the following structure group 5 are preferable.

Structure group 5

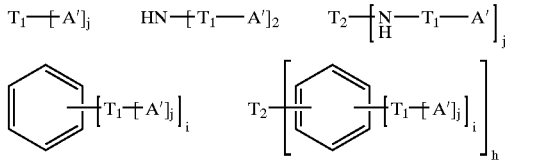

In the structure group 5, the reference characters $T_1$ and $T_2$ each independently represent a divalent or trivalent hydrocarbon group optionally having branches; and the reference character A' represents the above-described substituent. The reference characters h, i, j each independently represent an integer of 1 to 3 and are so selected as to keep the number of A' in a molecule to be more than 1.

The practical examples of the compounds with the general formula (III) represented by the above-described formulae are as follows, and the compounds are not restricted only to the following examples.

III-1 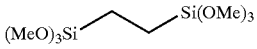

III-2 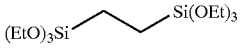

III-3 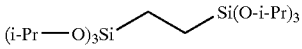

III-4 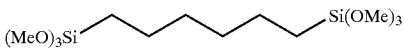

III-5 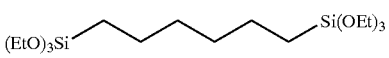

-continued

III-6 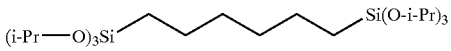

III-7 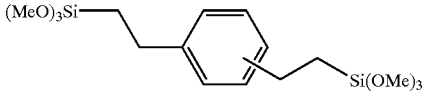

III-8 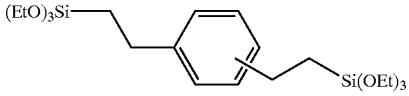

III-9 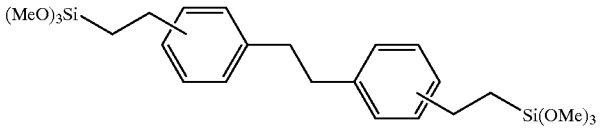

III-10 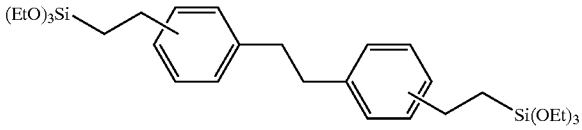

III-11 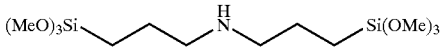

III-12 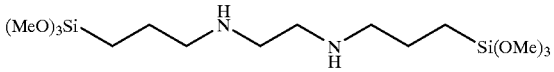

III-13 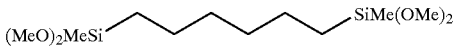

III-14 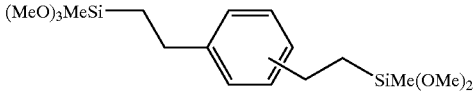

III-15 $(MeO)_3SiC_3H_6—O—CH_2CH\{—O—C_3H_6Si(OMe)_3\}—CH_2\{—O—C_3H_6Si(OMe)_3\}$

The compound represented by the general formula (I) may be used alone and may be used by being mixed with the compound represented by the general formula (III) and other coupling agents, fluoro-compounds and the like, for the purpose of adjusting the film formability and flexibility and the like. As such compounds, a variety of silane coupling agents, commercialized silicone type hard coating agents may be employed.

As the above-described silane coupling agents, those usable are vinyltrichlorosilane, vinyltrimethoxysilane, vinyltriethoxysilane, γ-glycidoxypropylmethyldiethoxysilane, γ-glycidoxypropyltrimethoxysilane, γ-aminopropyltriethoxysilane, γ-aminopropyltrimethoxysilane, γ-aminopropylmethyldimethoxysilane, N-β(aminoethyl)γ-aminopropyltriethoxysilane, tetramethoxysilane, methyltrimethoxysilane, dimethyldimethoxysilane, and the like. As the commercialized silicone type hard coating agents, usable examples are KP-85, X-40-9740, X-40-2239 (the foregoing are all produced by Shin-Etsu Silicone Co., Ltd.), and AY42-440, AY42-441, AY49-208 (the foregoing are all produced by Dow Corning Toray Silicone Co., Ltd.). Further, in order to give water-repelling property, the following fluorine-containing compounds may be added; (tridecafluoro-1,1,2,2-tetrahydrooctyl)triethoxysilane, (3,3,3-trifluoropropyl)trimethoxysilane, 3-(heptafluoroisopropoxy)propyltriethoxysilane, 1H,1H,2H,2H-perfluoroalkyltriethoxysilane, 1H,1H,2H,2H-perfluorodecyltriethoxysilane, 1H,1H,2H,2H-perfluorooctyltriethoxysilane and the like.

The silane coupling agents may be used in an optional amount, and the amount of the fluorine-containing compounds is preferably kept to not more than 25% by mass to the compounds containing no fluorine. If the amount exceeds the ratio, film formability of the cross-linked film sometimes becomes problematic.

In the case of a cross-linked film is formed as the surface protective layer, it is preferable to add an organometal compound or a curing type matrix.

As the organometal compound, preferable examples are organo-zirconium compounds such as a zirconium chelate compound, a zirconium alkoxide, a zirconium coupling agent and the like; organo-titanium compounds such as a titanium chelate compound, a titanium alkoxide, a titanate coupling agent and the like; and organo-aluminum compounds such as an aluminum chelate compound, an aluminum coupling agent and the like; and other than them, the preferable examples also include organometal compounds such as an antimony alkoxide compound, a germanium alkoxide compound, an indium alkoxide compound, an indium chelate compound, a manganese alkoxide compound, a manganese chelate compound, a tin alkoxide compound, a tin chelate compound, an aluminum silicon alkoxide compound, an aluminum titanium alkoxide compound, an aluminum zirconium alkoxide compound, and the like. Especially, the organo-zirconium compounds, organo titanyl compounds, and the organo-aluminum compounds have low residual potential and excellent electrophotographic characteristics and therefore they are preferably employed.

As the curing type matrix, examples to be used are silane coupling agents such as vinyltrichlorosilane, vinyltrimethoxysilane, vinyltriethoxysilane, vinyltri-2-methoxyethoxysilane, vinyltriacetoxysilane, γ-glycidoxypropyltrimethoxysilane, γ-methacryloxypropyltrimethoxysilane, γ-aminopropyltriethoxysilane, γ-chloropropyltrimethoxysilane, γ-2-aminoethylaminopropyltrimethoxysilane, γ-mercapropropyltrimethoxysilane, γ-ureidopropyltriethoxysilane, (β-3,4-epoxycyclohexyltrimethoxysilane, and the like.

The preparation of these coating solutions may be carried out using no solvent or if necessary the following are usable; alcohols such as methanol, ethanol, propanol, butanol and the like; ketones such as acetone, methyl ethyl ketone, and the like; ethers such as tetrahydrofuran, diethyl ether, dioxane and the like; and preferable ones are those with a boiling point of not more than 100° C. and they may be used by being mixed optionally. The solvent amount may be set optionally, and if it is too little, the compound represented by the general formula (I) is easy to be precipitated, the amount is controlled to be 0.5 to 30 parts by mass, preferably 1 to 20 parts by mass, to 1 parts by mass of the compound the general formula (I).

In the coating solution preparation, the compound represented by the general formula (I) and other compounds as necessary are reacted by being brought into contact with a solid catalyst, and the reaction temperature and time differ depending on the types of the raw materials and the reaction is carried out at a temperature generally of 0 to 100° C., preferably 0 to 70° C., and especially preferably 10 to 35° C. There is no specific restriction for the reaction time, and if the reaction time is long, gelling easily takes place, so that the time is preferably in a range of 10 minutes to 100 hours.

In the case a polymer having the group possible to be bonded with the compound represented by the general formula (I) is added, since gelling is significantly promoted to make coating difficult in some cases if the solid catalyst and the above-described polymer exist simultaneously, the polymer is preferably added after the solid catalyst is removed. Such a solid catalyst is not particularly restricted to be employed if the catalyst component is insoluble in any of the solution of the compound represented by the general formula (I), other compounds, the solvents and the like. As the solid catalyst insoluble in the system, the following catalysts can be used to previously carry out hydrolysis.

Cation exchange resins: AMBERLYTE 15, AMBERLYTE 200C, AMBERLYST 15 (the foregoing are all produced by Rohm & Haas Co.); DOWEX MWC-1-H, DOWEX 88, DOWEX HCR-W2 (the foregoing are all produced by Dow Chemical Co.); LEVATIT SPC-108, LEVATIT SPC-118 (the foregoing are all produced by Bayer A.G.); DIANON RCP-150H (produced by Mitsubishi Kasei Corporation); SUMIKAION KC-470, DUOLITE C26-C, DUOLITE C-433, and DUOLITE-464 (the foregoing are all produced by Sumitomo Chemical Co., Ltd.); NAFION-H (produced by Du Pont (E.I) de Nemours & Co. and the like;

Anion exchange resins: AMBERLYTE IRA-400, AMBERLYST IRA-15 (the foregoing are all produced by Rohm & Haas Co.), and the like;

Inorganic solids bonded with groups containing proton acid groups in the surface: $Zr(O_3PCH_2CH_2SO_3H)_2$, $Th(O_3PCH_2CH_2COOH)_2$, and the like;

Polyorganosiloxanes containing proton acids: polyorganosiloxanes having sulfonic acid groups and the like;

Heteropolyacids: cobalt tungstic acid, phosphomolybdic acid and the like;

Isopolyacids: niobic acid, tantalic acid, molybdic acid and the like;

Single system metal oxides: silica gel, alumina, chromia, zirconia, CaO, MgO and the like;

Composite type metal oxides: silica-alumina, silica-magnesia, silica-zirconia, zeolites and the like;

Clay minerals: acid clay, activated clay, montmorillonite, kaolinite and the like;

Metal sulfates: $LiSO_4$, $MgSO_4$ and the like;

Metal phosphates: zirconium phosphate, lanthanum phosphate and the like;

Metal nitrates: $LiNO_3$. $Mn(NO_3)_2$ and the like;

Inorganic solids bonded with groups containing amino groups in the surface: a solid obtained by reaction of silica gel with aminopropyltriethoxysilane and the like;

Polyorganosiloxanes containing amino groups: amino-modified silicone resins and the like.

Using at least one of these catalysts, the hydrolysis condensation reaction is carried out. These catalysts can be set in a fixed bed and the reaction may be carried out in a continuous manner or a batch manner. The use amount of the catalysts is not particularly restricted, and it is preferably 0.1 to 100% by mass to the total amount of the materials containing hydrolyzable silicon substituents.

The addition amount of water at the time of hydrolysis condensation is not particularly restricted, and since it affects the storage stability of the produced product and the gelling suppression at the time of polymerization, it is generally 30 to 500%, preferably 50 to 300%, to the theoretically necessary amount for the hydrolysis of all of the hydrolyzable groups of the compound represented by the general formula (I). If the water amount is more than 500%, the produced product sometimes becomes inferior in the storage stability or easy to be precipitated. On the other hand, if the water amount is less than 30%, unreacted substances increase to result in possibility of phase separation at the time of applying or curing the coating solution and strength decrease of the coating film.

Further as the curing catalyst, usable examples are proton acids such as hydrochloric acid, acetic acid, phosphoric acid, sulfuric acid and the like; bases such as ammonia, triethylamine and the like; organotin compounds such as dibutyl tin diacetate, dibutyl tin dioctanate, stannous octanate and the like; organotitanium compounds such as tetra-n-butyl titanate, tetraisopropyl titanate and the like; organoaluminum compounds such as aluminum tributoxide, aluminum triacetylacetonate and the like; and organic carboxylic acid salts of iron, manganese, cobalt, zinc, zirconium and the like, and in terms of the storage stability, the metal compounds are preferable and more particularly metal acetyl acetonates or acetyl acetates are preferable.

The use amount of the curing catalyst can be set optionally, and in consideration of the storage stability, the characteristics, and the strength, it is preferably 0.1 to 20% by mass, more preferably 0.3 to 10% by mass, to the total amount of the materials containing the hydrolyzable silicon substituents.

The curing temperature can be set optionally, and in order to obtain a desired strength, it is preferably set at not less than 60° C., more preferably not less than 80° C. The curing time can be set optionally, and it is preferably 10 minutes to 5 hours. Further, after the curing reaction, it is also effective to keep the products in highly humid state in order to stabilize the characteristics. Further, depending on the uses, the surface treatment with hexamethyl disilazane and trimethylchlorosilane may be carried out to make the surface hydrophobic.

For the purpose to prevent the deterioration with acidic gases such as ozone and the like generated in the charger, it is preferable to add an anti-oxidation agent to the surface cross-linked cured film of the photoreceptor. If the mechanical strength of the photoreceptor surface is improved and the life of the photoreceptor is prolonged, the photoreceptor is to be brought into contact with the acidic gases for a long time, so that oxidation resistance higher than conventionally is required.

As the anti-oxidation agent, hindered phenol-based ones or hindered amine-based ones are preferable and the following well-known anti-oxidation agents may be used; an organic sulfur-based anti-oxidation agent, a phosphite-based anti-oxidation agent, a dithiocarbamic acid salt-based anti-oxidation agent, a thiourea-based anti-oxidation agent, a benzimidazole-based anti-oxidation agent, and the like. The addition amount of the anti-oxidation agent is preferably not more than 15% by mass, more preferably 10% by mass, to the entire cured film.

As the hindered phenol-based anti-oxidation agent, practical examples are 2,6-di-tert-butyl-4-methylphenol, 2,5-di-tertbutylhydroquinone, N,N'-hexamethylenebis(3,5-di-tert-butyl-4-hydoxyhydrocinnamide), 3,5-di-tert-butyl-4-hydroxy-benzylphosphonate diethyl ester, 2,4-bis[(octylthio)methyl]-o-cresol, 2,6-di-tert-butyl-4-ethylphenol, 2,2-methylenebis(4-methyl-6-tert-butylphenol), 2,2'-methylenebis(4-ethyl-6-tert-butylphenol), 4,4'-butylidenebis(3-methyl-6-tert-butylphenol), 2,5-di-tert-amylhydroquinone, 2-tert-butyl-6-(3-butyl-2-hydroxy-5-methylbenzyl)-4-methylphenyl acrylate, 4,4'-butylidenebis(3-methyl-6-tert-butylphenol) and the like.

As the coating method, the following common methods are applicable; a blade coating method, a wire bar coating method, a spray coating method, a dip coating method, a bead coating method, an air knife coating method, a curtain coating method and the like. Incidentally, in the case a needed film thickness is not obtained by one time coating, coating may be repeated a plurality of times to obtain the needed film thickness. In the case of repeating the coating a plurality of times, heating may be carried out after every coating or after repeating coating a plurality of times.

The degree of the cross-linking of the surface layer can be known based on the hardness of the surface layer and the hardness can be measured as the hardness of the photoreceptor. The hardness of the photoreceptor is preferably in a range of 15 to 35 $mN/\mu m^2$. Incidentally, the dynamic hardness can be measured by Dynamic Hardness Meter DUH-201 manufactured Shimadzu Corporation.

(Underlayer)

An underlayer may be formed between a desired substrate and a photosensitive layer in a photoreceptor to be employed for the present invention as necessary. As the materials to be employed for the formation of the underlayer, known binder resin conventionally used for the underlayer can be used and also the materials composing the above-described surface layer may be used for the formation. In this case, as necessary, the following other materials may be added. Other materials to be employed are organozirconium compounds such as a zirconium chelate compound, a zirconium alkoxide compound, a zirconium coupling agent and the like; organotitanium compounds such as a titanium chelate compound, a titanium alkoxide compound, a titanate coupling agent and the like; organoaluminum compounds such as an aluminum chelate compound, an aluminum coupling agent and the like; and the materials are further organometal compounds such as an antimony alkoxide compound, a germanium alkoxide compound, an indium alkoxide compound, an indium chelate compound, a manganese alkoxide compound, a manganese chelate compound, a tin alkoxide compound, a tin chelate compound, an aluminum silicon alkoxide compound, an aluminum titanium alkoxide compound, an aluminum zirconium alkoxide compound and the like. Especially, organozirconium compounds, organotitanyl compounds, and organoaluminum compounds are preferably employed since they have low residual potential and excellent electrophotographic characteristics.

Further, the following silane coupling agent may be added to be used; vinyltrichlorosilane, vinyltrimethoxysilane, vinyltriethoxysilane, vinyltris(2-methoxyethoxy)silane, vinyltriacetoxysilane, γ-glycidoxypropyltrimethoxysilane, γ-methacryloxypropyltrimethoxysilane, γ-aminopropyltriethoxysilane, γ-chloropropyltrimethoxysilane, γ-2-aminoethylaminopropyltrimethoxysilane, γ-mercapropropyltrimethoxysilane, γ-ureidopropyltriethoxysilane, β-(3,4-epoxycyclohexyl) trimethoxysilane, and the like.

Further, the following known binder resins which have conventionally been used for the underlayer may also be used; polyvinyl alcohol, polyvinyl methyl ether, poly(N-vinylimidazole), polyoxyethylene, ethyl cellulose, methyl cellulose, ethylene-acrylic acid copolymer, a polyamide, a polyimide, casein, gelatin, polyethylene, a polyester, a phenol resin, a vinyl chloride-vinyl acetate copolymer, an epoxy resin, polyvinylpyrrolidone, polyvinylpyridine, a polyurethane, polyglutamic acid, polyacrylic acid and the like. The mixing ratio of them may properly be set as necessary.

Further, an electron transporting pigment may be mixed with and dispersed in the underlayer. As the electron transporting pigment, examples usable are organic pigments disclosed in JP-A No. 47-30330 such as perillene pigments, bisbenzimidasole perillene pigments, polycyclic quinone pigments, indigo pigments, quinacridone pigments, and the like; organic pigments such as bisazo pigments and phthalocyan pigments, and the like having electron attractive substituents such as a cyano group, a nitro group, a nitroso group, a halogen atom and the like; and inorganic pigments such as zinc oxide, titanium oxide and the like. Among them, perillene pigments, bisbenzimidasole perillene pigments, and polycyclic quinone pigments are preferably used since they have high electron transporting property.

If the addition amount of the electron transporting pigment is too much, the strength of the underlayer is decreased and coating defects are caused, the amount is controlled to be not more than 95% by mass, preferably not more than 90% by mass, in the entire underlayer.

As the mixing and dispersing method, a common method using a ball mill, a roll mill, a sand mill, an attriter, an ultrasonic dispersion apparatus and the like can be employed.

The mixing and dispersing is carried out using an organic solvent, and as the organic solvent, any solvent can be used if it can dissolve the organometal compounds and resins and does not promote gelling or flocculation when the electron transporting pigments are mixed and dispersed. For example, the following common organic solvents can be used alone or in form of a mixture of more than one of them: methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, toluene and the like.

The thickness of the underlayer is generally 0.1 to 20 $\mu$m, preferably 0.2 to 10 $\mu$m. As the coating method for forming the underlayer, the following common method is applicable: a blade coating method, a wire bar coating method, a spray coating method, a dip coating method, a bead coating method, an air knife coating method, a curtain coating method and the like. The underlayer is obtained by drying the applied solution and generally, the drying is carried out at a temperature at which solvents are evaporated and uniform film formation is made possible. Incidentally, a substrate subjected to the acidic solution treatment, boehmite treatment is easy to be insufficient in the defect shielding capability and therefore, the underlayer formation is especially preferable for the substrate.

As described above, the photoreceptor to be employed for the present invention dispensably comprises a cross-linked resin having the electron transporting function in the outermost layer, and as the layer structure of the photoreceptor, the surface protective layer may or may not be formed. Hereinafter, the case in which the surface protective layer is formed and the case in which no surface protective layer is formed are separately described.

[Photosensitive Layer in the Case Surface Protective Layer is Formed]

In the case a surface protective layer is formed, the photosensitive layer to be formed under the layer may be any kind of photosensitive layers of any photoreceptor which has conventionally been known well and a layered type photoreceptor comprising a charge generating layer and a charge transporting layer and a monolayer type photoreceptor containing a charge generating material are both usable.

The layered type and the monolayer type will be described below.

1. Layered Type Photosensitive Layer

The charge generating layer of the layered type photosensitive layer contains at least a charge generating material and a binder resin.

As the charge generating material, already known materials, for example, azo pigments such as bisazo, trisazo, and the like; condensed cyclic aromatic pigments such as dibromoanthoanthrone and the like; perillene pigments; pyrrolopyrrole pigments; phthalocyanine pigments and the like are all usable, and especially, metal and non-metal phthalocyanine pigments are preferable. Among them, especially preferably used are hydroxygallium phthalocyanine, chlorogallium phthalocyanine, dichlorotin phthalocyanine, and titanyl phthalocyanine having specific crystals.

The chlorogallium phthalocyanine to be employed for the present invention can be produced, as described in JP-A No. 5-98181, by mechanically dry pulverizing chlorogallium phthalocyanine crystal, which is produced by a known method, by an automatic crucible, a satellite mill, a vibration mill, a CF mill, a roller mill, a sand mill, a kneader and the like or wet pulverizing the crystal together with a solvent by a ball mill, a crucible, a sand mill, a kneader and the like after the dry pulverization. The solvent to be used for the above-described treatment may be aromatic ones (toluene, chlorobenzene and the like), amides (dimethylformamide, N-methylpyrrolidone and the like), aliphatic alcohols (methanol, ethanol, butanol, and the like), aliphatic polyhydric alcohols (ethylene glycol, glycerin, polyethylene glycol and the like), aromatic alcohols (benzyl alcohol, phenetyl alcohol and the like), esters (acetic acid ester, butyl acetate and the like), ketones (acetone, methyl ethyl ketone, and the like), dimethyl sulfoxide, ethers (diethyl ether, tetrahydrofuran, and the like), further mixture systems of several types of solvents, and mixture systems of water and these solvents.

The solvent to be employed is controlled to be 1 to 200 parts by mass, preferably 10 to 100 parts by mass, to 10 parts by mass of chlorogallium phthalocyanine. The treatment temperature is in a range from 0° C. to the boiling point of the solvent, preferably 10 to 60° C. Further, at the time of pulverization, a pulverization assisting agent such as salt, glauber's salt and the like may be used. The pulverization assisting agent is used in 0.5 to 20, preferably 1 to 10 times as much as the weight of the pigment. Incidentally, the amount of the pulverization assisting agent to be used is same in the following phthalocyanine production.

Dichlorotin phthalocyanine can be obtained, as described in JP-A Nos. 5-140472 and 5-140473, by subjecting dichlorotin phthalocyanine crystal, which is produced by a known method, to the pulverization and solvent treatment in the same manner as that for the above-described chloro gallium phthalocyanine.

Hydroxygallium phthalocyanine can be produced, as disclosed in JP-A Nos. 5-263007 and 5-279591, by hydrolyzing or acid-pasting chlorogallium phthalocyanine crystal, which is produced by a known method, in an acidic or alkaline solution to obtain hydroxygallium phthalocyanine crystal, and either wet-pulverizing the obtained hydroxygallium phthalocyanine crystal together with a solvent by a ball mill, a crucible, a sand mill, a kneader and the like or dry-pulverizing the crystal without using a solvent and successively treating the resultant crystal with a solvent. The solvent usable for the above-described treatment is the same as those exemplified for the chlorogallium phthalocyanine production. The solvent to be used is controlled to be 1 to 200 parts by mass, preferably 10 to 100 parts by mass, to 10 parts by mass of hydroxygallium phthalocyanine. The solvent treatment is carried out at 0 to 150° C., preferably in a range from a room temperature to 100° C. Further, a pulverization assisting agent such as salt, glauber's salt and the like may be used.

Oxytitanyl phthalocyanine can be produced, as described in JP-A Nos. 4-198376 and 5-43813, by acid-pasting oxytitanyl phthalocyanine crystal, which is produced by a known method, or salt-milling the crystal with an inorganic salt using a ball mill, a crucible, a sand mill, a kneader and the like to obtain oxytitanyl phthalocyanine crystal with a relatively low crystallinity having a peak at 27.2° in the x-ray diffraction spectrum and then either subjecting the obtained crystal directly to solvent treatment or wet-pulverizing the crystal together with a solvent by a ball mill, a crucible, a sand mill, a kneader and the like. The acid to be used for the acid pasting is preferably concentrated sulfuric acid with a concentration of 70 to 100% by mass, preferably 95 to 100% by mass. The dissolution is carried out in a range of −20 to 100° C., preferably 0 to 60° C. The amount of concentrated sulfuric acid to be used is controlled to be 1 to 100 times, preferably 3 to 50 times as much as the weight of the oxytitanyl phthalocyanine crystal. The solvent to be used for precipitation may be water or a mixed solvent of water and an organic solvent in an optional amounts, and mixed solvents of water with alcohol-type solvents such as methanol, ethanol and the like or water with aromatic solvents such as benzene, toluene and the like are especially preferable. The temperature for precipitation is not particularly restricted, and, in order to prevent heat generation, it is preferable to carry out cooling with ice. The ratio of the oxytitanyl phthalocyanine crystal and the inorganic salt is controlled to be in a range of (1/0.1) to (1/20) by mass ratio, especially preferably in a range (1/0.5) to (1/5).

The solvent to be used for the above-described solvent treatment may be aromatic solvents (toluene, chlorobenzene, and the like); aliphatic alcohols (methanol, ethanol, butanol, and the like); halogen-type hydrocarbons (dichloromethane, chloroform, trichloroethane, and the like); and further mixture systems of some types of these solvents, mixture systems of water with these organic solvents and the like. The amount of the solvent to be used is in a range of 1 to 100 parts by mass, preferably 5 to 50 parts by mass to 10 parts by mass of oxytitanyl phthalocyanine. The solvent treatment is carried out in a range from a room temperature to 100° C., preferably in a range from 50 to 100° C.

The binder resin may be selected from a wide range of insulating resins. It may also be selected from organic photoelectric conductive polymers such as poly(N-vinylcarbazole), polyvinylanthracene, polyvinylpillene, polysilane and the like. As preferable binder resins, examples are insulating resins such as a polyvinyl butyral resin, a polyallylate resin (polymer condensates of bisphenol A and phthalic acid), a polycarbonate resin, a polyester resin, a phenoxy resin, a vinyl chloride-vinyl acetate copolymer, a polyamide resin, an acrylic resin, a polyacrylamide resin, a polyvinylpyridine resin, a cellulose resin, a urethane resin, an epoxy resin, casein, a polyvinyl alcohol resin, a polyvinyl pyrrolidone resin and the like, and they are not restricted to these resins. These binder resins may be used alone or as a mixture of more than one of them. The mixing ratio of the charge generating material and the binder resins is preferably in a range of (10:1) to (1:10).

Next, as the method for dispersing them, a common method such as a ball mill dispersion method, an attriter dispersion method, a sand mill dispersion method or the like is applicable and at the time, it is required for the crystal type of the charge generating material not to be changed by the dispersion. Incidentally, it has confirmed that any of the above-described dispersion methods carried out by inventors of the present invention did not cause the crystal type change before and after the dispersion. Further, at the time of dispersion, it is effective to control the particles of the charge generating material to be not more than 0.5 μm, preferably not more than 0.3 μm, further preferably not more than 0.15 μm, in the particle size. Further, in order to improve the dispersion stability and photosensitivity of pigments or in order to stabilize the electric properties, pigments treated using the compound represented by the general formula (I) may be used or the compound may be added to the dispersion solution of the pigment.

For the dispersion, common solvents such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, toluene and the like may be used alone or as a mixture of more than one of them.

The thickness of the charge generating layer is generally 0.1 to 5 μm and preferably 0.2 to 2.0 mm. As the coating method employed for the formation of the charge generating layer, a common method such as a blade coating method, a wire bar coating method, a spray coating method, a dip coating method, a bead coating method, an air knife coating method, a curtain coating method and the like may be employed.

As a charge transporting layer in the photoreceptor to be employed for the present invention, those formed by well-known techniques are usable. These charge transporting layers are formed while containing a charge transporting material and a binder resin or containing a polymer charge transporting material.

As the charge transporting material, examples usable are as follows: electron transporting compounds, e.g., quinone type compounds such as p-benzoquinone, chloranil, bromanil, anthraquinone, and the like; tetracyanoquinodimethane type compounds; fluorenone compounds such as 2,4,7-trinitrofluorenone and the like; xanthone type compounds; benzophenone type compounds; cyanovinyl type compounds; ethylene type compounds and the like; and positive hole transporting compounds, e.g., triarylamine type compounds, benzidine type compounds, arylalkane type compounds, aryl-substituted ethylene compounds, stilbene type compounds, anthracene type compounds, hydrazone type compounds, and the like. These charge transporting materials may be used alone or as a mixture of more than one of them, and they are not restricted to these examples.

As the charge transporting materials, triphenylamine type compounds represented by the general formula (IV) and benzidine type compounds represented by the general formula (V) have a high charge (positive hole) transporting function and excellent stability, so that they are especially preferably used.

(IV)

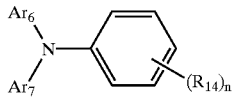

(wherein, the reference character $R_{14}$ represents hydrogen atom or methyl. Also, the reference character n represents 1 or 2. The reference characters $Ar_6$ and $Ar_7$ each independently represent a substituted or unsubstituted aryl and the substituent for them is a halogen atom, an alkyl of 1 to 5 carbon atoms, an alkoxyl of 1 to 5 carbon atoms, or amino group substituted with an alkyl of 1 to 3 carbon atoms.)

(V)

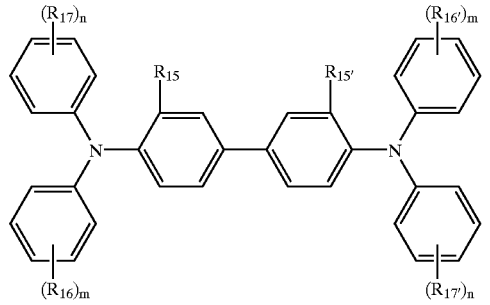

(wherein, the reference characters $R_{15}$, $R_{15}'$ each independently represent hydrogen atom, a halogen atom, an alkyl of 1 to 5 carbon atoms, an alkoxyl of 1 to 5 carbon atoms. The reference characters $R_{16}$, $R_{16}'$, $R_{17}$, $R_{17}'$ each independently represent hydrogen atom, a halogen atom, an alkyl of 1 to 5 carbon atoms, an alkoxyl of 1 to 5 carbon atoms, or amino group substituted with an alkyl of 1 to 2 carbon atoms. The reference characters m and n each independently represent an integer of 0 to 2.)

The respective compound examples are shown in Table 56 to Table 61.

TABLE 56

| Compound No. | $R_{14}$ | $Ar_6$ | $Ar_7$ |
|---|---|---|---|
| 1 | 4-$CH_3$ | 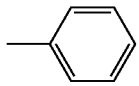 | 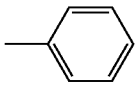 |
| 2 | 3,4-$CH_3$ | | |
| 3 | 4-$CH_3$ | 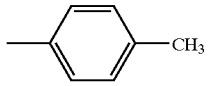 | 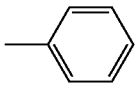 |
| 4 | 3,4-$CH_3$ | | |
| 5 | 4-$CH_3$ | 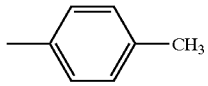 | 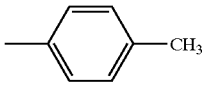 |
| 6 | 3,4-$CH_3$ | | |
| 7 | 4-$CH_3$ | 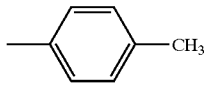 | 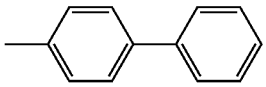 |
| 8 | 3,4-$CH_3$ | | |
| 9 | 4-$CH_3$ | 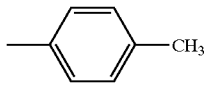 | 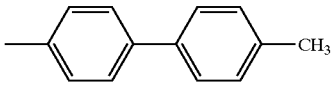 |
| 10 | 3,4-$CH_3$ | | |
| 11 | 4-$CH_3$ | 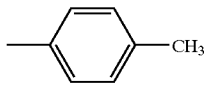 | 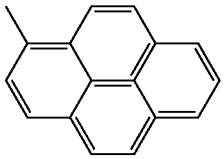 |
| 12 | 3,4-$CH_3$ | | |
| 13 | 4-$CH_3$ | 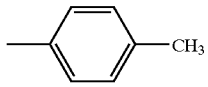 | 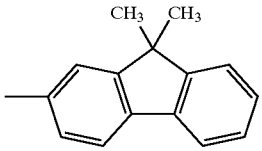 |
| 14 | 3,4-$CH_3$ | | |
| 15 | 4-$CH_3$ | 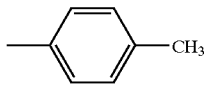 | 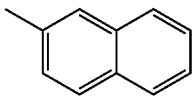 |
| 16 | 3,4-$CH_3$ | | |
| 17 | 4-$CH_3$ | 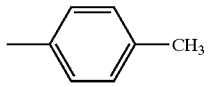 | 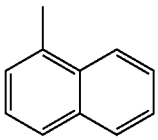 |
| 18 | 3,4-$CH_3$ | | |
| 19 | 4-$CH_3$ | 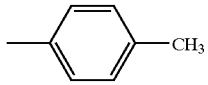 | 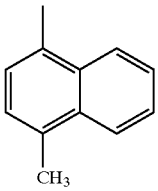 |
| 20 | 3,4-$CH_3$ | | |

TABLE 56-continued
| Compound No. | $R_{14}$ | $Ar_6$ | $Ar_7$ |
|---|---|---|---|
| 21<br>22 | 4-$CH_3$<br>3,4-$CH_3$ | 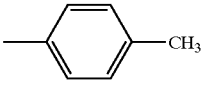 | 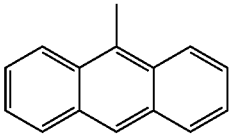 |
| 23<br>24 | 4-$CH_3$<br>3,4-$CH_3$ | 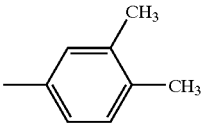 | 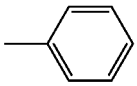 |
TABLE 57
| Compound No. | $R_{14}$ | $Ar_6$ | $Ar_7$ |
|---|---|---|---|
| 25<br>26 | 4-$CH_3$<br>3,4-$CH_3$ | 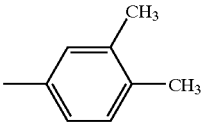 | 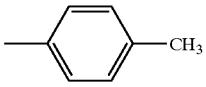 |
| 27<br>28 | 4-$CH_3$<br>3,4-$CH_3$ | 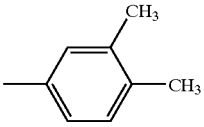 | 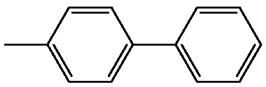 |
| 29<br>30 | 4-$CH_3$<br>3,4-$CH_3$ | 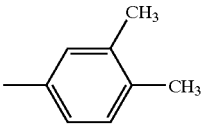 | 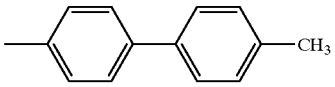 |
| 31<br>32 | 4-$CH_3$<br>3,4-$CH_3$ | 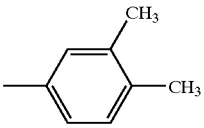 | 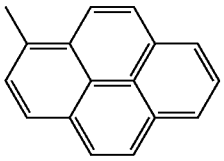 |
| 33<br>34 | 4-$CH_3$<br>3,4-$CH_3$ | 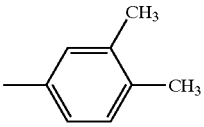 | 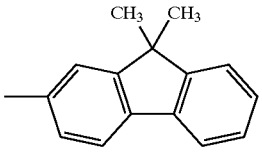 |
| 35<br>36 | 4-$CH_3$<br>3,4-$CH_3$ | 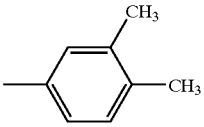 | 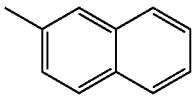 |

TABLE 57-continued
| Compound No. | $R_{14}$ | $Ar_6$ | $Ar_7$ |
|---|---|---|---|
| 37<br>38 | 4-$CH_3$<br>3,4-$CH_3$ | 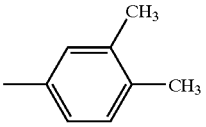 | 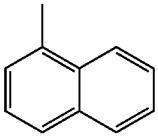 |
| 39<br>40 | 4-$CH_3$<br>3,4-$CH_3$ | 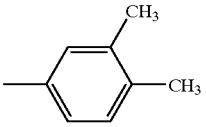 | 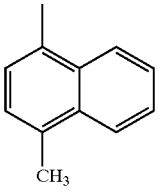 |
| 41<br>42 | 4-$CH_3$<br>3,4-$CH_3$ | 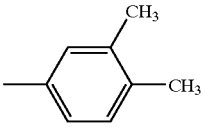 | 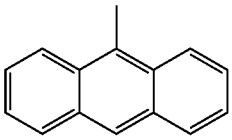 |
| 43<br>44 | 4-$CH_3$<br>3,4-$CH_3$ | 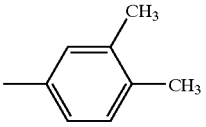 | 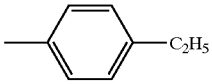 |
| 45<br>46 | 4-$CH_3$<br>3,4-$CH_3$ | 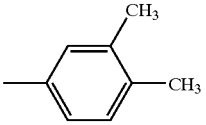 | 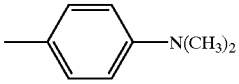 |
| 47<br>48 | 4-$CH_3$<br>3,4-$CH_3$ | 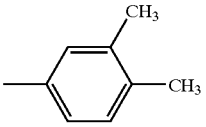 | 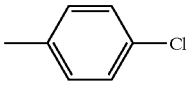 |
TABLE 58
| Compound No. | $R_{14}$ | $Ar_6$ | $Ar_7$ |
|---|---|---|---|
| 49<br>50 | 4-$CH_3$<br>3,4-$CH_3$ | 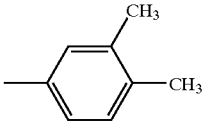 | 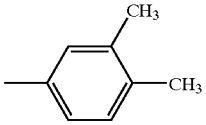 |
| 51<br>52 | 4-$CH_3$<br>3,4-$CH_3$ | 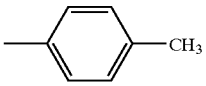 | 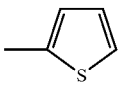 |
| 53<br>54 | 4-$CH_3$<br>3,4-$CH_3$ | 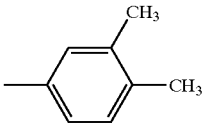 | 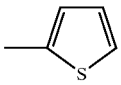 |

TABLE 58-continued

| Compound No. | $R_{14}$ | $Ar_6$ | $Ar_7$ |
|---|---|---|---|
| 55 | 4-$CH_3$ | | |
| 56 | 3,4-$CH_3$ | | |
| 57 | 4-$CH_3$ | | |
| 58 | 3,4-$CH_3$ | | |
| 59 | 4-$CH_3$ | | |
| 60 | 3,4-$CH_3$ | | |
| 61 | 4-$CH_3$ | | |
| 62 | 3,4-$CH_3$ | | |

TABLE 59

| Compound No. | $R_{15}$, $R_{15'}$ | $(R_{16})_m$, $(R_{16'})_m$ | $(R_{17})_n$, $(R_{17'})_n$ |
|---|---|---|---|
| 1 | $CH_3$ | H | H |
| 2 | $CH_3$ | 2-$CH_3$ | H |
| 3 | $CH_3$ | 3-$CH_3$ | H |
| 4 | $CH_3$ | 4-$CH_3$ | H |
| 5 | $CH_3$ | 4-$CH_3$ | 2-$CH_3$ |
| 6 | $CH_3$ | 4-$CH_3$ | 3-$CH_3$ |
| 7 | $CH_3$ | 4-$CH_3$ | 4-$CH_3$ |
| 8 | $CH_3$ | 3,4-$CH_3$ | H |
| 9 | $CH_3$ | 3,4-$CH_3$ | 3,4-$CH_3$ |
| 10 | $CH_3$ | 4-$C_2H_5$ | H |
| 11 | $CH_3$ | 4-$C_3H_7$ | H |
| 12 | $CH_3$ | 4-$C_4H_9$ | H |
| 13 | $CH_3$ | 4-$C_2H_5$ | 2-$CH_3$ |
| 14 | $CH_3$ | 4-$C_2H_5$ | 3-$CH_3$ |
| 15 | $CH_3$ | 4-$C_2H_5$ | 4-$CH_3$ |
| 16 | $CH_3$ | 4-$C_2H_5$ | 3,4-$CH_3$ |
| 17 | $CH_3$ | 4-$C_3H_7$ | 3-$CH_3$ |
| 18 | $CH_3$ | 4-$C_3H_7$ | 4-$CH_3$ |
| 19 | $CH_3$ | 4-$C_4H_9$ | 3-$CH_3$ |
| 20 | $CH_3$ | 4-$C_4H_9$ | 4-$CH_3$ |

TABLE 60

| Compound No. | $R_{15}$, $R_{15'}$ | $(R_{16})_m$, $(R_{16'})_m$ | $(R_{17})_n$, $(R_{17'})_n$ |
|---|---|---|---|
| 21 | $CH_3$ | 4-$C_2H_5$ | 4-$C_2H_5$ |
| 22 | $CH_3$ | 4-$C_2H_5$ | 4-$OCH_3$ |
| 23 | $CH_3$ | 4-$C_3H_7$ | 4-$C_3H_7$ |
| 24 | $CH_3$ | 4-$C_3H_7$ | 4-$OCH_3$ |
| 25 | $CH_3$ | 4-$C_4H_9$ | 4-$C_4H_9$ |
| 26 | $CH_3$ | 4-$C_4H_9$ | 4-$OCH_3$ |
| 27 | H | 3-$CH_3$ | H |
| 28 | Cl | H | H |
| 29 | Cl | 2-$CH_3$ | H |
| 30 | Cl | 3-$CH_3$ | H |
| 31 | Cl | 4-$CH_3$ | H |
| 32 | Cl | 4-$CH_3$ | 2-$CH_3$ |
| 33 | Cl | 4-$CH_3$ | 3-$CH_3$ |

TABLE 60-continued

| Compound No. | $R_{15}$, $R_{15'}$ | $(R_{16})_m$, $(R_{16'})_m$ | $(R_{17})_n$, $(R_{17'})_n$ |
|---|---|---|---|
| 34 | Cl | 4-$CH_3$ | 4-$CH_3$ |
| 35 | $C_2H_5$ | H | H |
| 36 | $C_2H_5$ | 2-$CH_3$ | H |
| 37 | $C_2H_5$ | 3-$CH_3$ | H |
| 38 | $C_2H_5$ | 4-$CH_3$ | H |
| 39 | $C_2H_5$ | 4-$CH_3$ | 4-$CH_3$ |
| 40 | $C_2H_5$ | 4-$C_2H_5$ | 4-$CH_3$ |

TABLE 61

| Compound No. | $R_{15}$, $R_{15'}$ | $(R_{16})_m$, $(R_{16'})_m$ | $(R_{17})_n$, $(R_{17'})_n$ |
|---|---|---|---|
| 41 | $C_2H_5$ | 4-$C_3H_7$ | 4-$CH_3$ |
| 42 | $C_2H_5$ | 4-$C_4H_9$ | 4-$CH_3$ |
| 43 | $OCH_3$ | H | H |
| 44 | $OCH_3$ | 2-$CH_3$ | H |
| 45 | $OCH_3$ | 3-$CH_3$ | H |
| 46 | $OCH_3$ | 4-$CH_3$ | H |
| 47 | $OCH_3$ | 4-$CH_3$ | 4-$CH_3$ |
| 48 | $OCH_3$ | 4-$C_2H_5$ | 4-$CH_3$ |
| 49 | $OCH_3$ | 4-$C_3H_7$ | 4-$CH_3$ |
| 50 | $OCH_3$ | 4-$C_4H_9$ | 4-$CH_3$ |
| 51 | $CH_3$ | 2-$N(CH_3)_2$ | H |
| 52 | $CH_3$ | 3-$N(CH_3)_2$ | H |
| 53 | $CH_3$ | 4-$N(CH_3)_2$ | H |
| 54 | $CH_3$ | 4-Cl | H |

They may be used alone or as a mixture of more than one of them. Further, a polymer charge transporting material may be employed. As the polymer charge transporting material, well-known materials having a charge transporting property such as poly(N-vinylcarbazole), polysilane and the like are usable. Among them, polyester type polymer charge transporting materials disclosed in JP-A Nos. 8-176293 and 8-208820 have high charge transporting capability and therefore are preferably used. The polymer charge transporting materials are possible to be formed in a film by themselves, and they may be mixed with the following binder resins to be formed in a film.

As the binder resins to be employed for a charge transporting layer, examples are polycarbonate resin, a polyester resin, a methacrylic resin, an acrylic resin, a poly(vinyl chloride) resin, a poly(vinylidene chloride) resin, a polystyrene resin, a poly(vinyl acetate) resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone-alkid resin, a phenol-formaldehyde resin, a styrene-alkid resin and the like.

For the purpose of deterioration prevention of a photoreceptor by ozone or an acidic gas generated in a copying machine or by light or heat, additives such as an anti-oxidation agent, a photostabilizer, a heat stabilizer and the like may be added to a charge transporting layer. For example, as the anti-oxidation agent, compounds usable are a hindered phenol, a hindered amine, paraphenylenediamine, an arylalkane, hydroquinone, spirochroman, spiroindanone, their derivatives, an organic sulfur compound, an organic phosphorus compound, and the like. Examples of the photostabilizer are derivatives of benzophenone, benzotriazole, dithiocarbamate, tetramethylpiperidine, and the like.

Further, for the purpose of improve the sensitivity, decrease of residual potential, decrease of fatigue and the like at the time of repeat use, at least one electron acceptive substance may be added. As usable electron acceptive substance, examples are succinic acid anhydride, maleic acid anhydride, dibromomaleic anhydride, phthalic acid anhydride, tetrabromophthalic acid anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, phthalic acid, and compounds represented by the general formula (1). Among them, fluorenone type, quinone type, and benzene derivatives having electron attractive substituent groups such as Cl, CN, $NO_2$ and the like are especially preferable.

The above-described binder resins may be used solely or as a mixture of more than one of them. The mixing ratio of the charge transporting materials and the binder resins is preferably (10:1) to (1:5). The thickness of the charge transporting layer is preferably 5 to 50 $\mu$m, more preferably 10 to 30 $\mu$m. As the coating method, the following common coating methods are applicable; a blade coating method, a wire bar coating method, a spray coating method, a dip coating method, a bead coating method, an air knife coating method, a curtain coating method and the like.

Further, as the solvent, common organic solvents, e.g. aromatic hydrocarbons such as benzene, toluene, xylene, chlorobenzene and the like; ketones such as acetone, 2-butanone and the like; halogenated aliphatic hydrocarbons such as methylene chloride, chloroform, ethylene chloride, and the like; and cyclic or straight chain type ethers such as tetrahydrofuran, ethyl ether and the like; may be used alone or as a mixture of more than one of them.

2. Monolayer Type Photosensitive Layer

In the case of the monolayer type photosensitive layer, the layer is formed while containing the above-described charge generating materials and the binder resins. As the binder resins, those same as the binder resins to be employed for the above-described charge generating layer and the charge transporting layer can be used. The content of the charge generating materials in the monolayer type photosensitive layer is about 10 to 85% by mass, preferably 20 to 50% by mass, in the entire solid matter of the photosensitive layer.

As necessary, a charge transporting material may be added to the monolayer type photosensitive layer. The addition amount of the material is preferably 5 to 50% by mass in the entire solid matter of the photosensitive layer. Further, the monolayer type photosensitive layer may contain an anti-oxidation agent for the same reason as that in the case of the charge transporting layer, as necessary. The addition amount of the agent is preferably not more than 15% by mass, more preferably not more than 10% by mass, in the entire solid matter of the photosensitive layer.

The monolayer type photosensitive layer can be formed by preparing a coating solution by dissolving and dispersing a charge generating material and a binder resin and additionally, as necessary, a charge transporting material and an anti-oxidation agent in a proper solvent, applying the coating solution to a conductive support, and heating and drying the solution. The same solvents and coating methods described in the descriptions of the charge generating layer and the charge transporting layer may be employed for the solvent to be used for the coating and the coating method. The film thickness of the monolayer type photosensitive layer is about 5 to 50 $\mu$m, further preferably 10 to 40 $\mu$m.

[Photosensitive Layer in the Case No Surface Protective Layer is Formed]

In the case of forming no surface protective layer, as described above, the outermost surface layer of the photosensitive layer formed on the surface of a conductive support is the surface layer of the photoreceptor to be employed for the present invention. The photosensitive layer can be broadly divided into two types; a layered type and a monolayer type.

In the case of layered type photosensitive layer, if a charge transporting layer is in the surface, the charge transporting layer is the surface layer and if a charge generating layer is in the surface, the charge generating layer is the surface layer of the photoreceptor to be employed for the present invention. In this case, for the outermost surface layer, in place of the charge transporting layer or the charge generating layer described in the description, [Photosensitive layer in the case surface protective layer is formed], the layer explained as the surface layer is employed and other layers having the same constitution as described in the above description, [Photosensitive layer in the case surface protective layer is formed], can be employed as they are described.

However, in the case the charge generating layer is a layer composing the constitution of the present invention, it is required to add a charge generating material to the layer. As the charge generating material, same materials as those for the charge generating materials described in the above description, [Photosensitive layer in the case surface protective layer is formed], may be employed and the addition amount is preferably 10 to 60% by mass, more preferably 20 to 50% by mass, in the entire solid matter of the charge generating layer.

Further, in the case the charge transporting layer is the surface layer of a photoreceptor to be employed for the present invention, since the organic groups derived from the photofunctional compound represented by the reference character F in the compound having the above-described general formula (I) has the electron transporting function, it is not necessarily required to add a charge transporting material to the layer. Of course, a charge transporting material may be added. In the case, such a charge transporting material is added, same materials as those for the charge transporting layer described in the above description, [Photosensitive layer in the case surface protective layer is formed], may be employed. The addition amount is preferably 5 to 50% by mass, more preferably 10 to 40% by mass, in the entire solid matter of the charge transporting layer.

On the other hand, in the case of the monolayer type photosensitive layer, the photosensitive layer itself is a layer composing the above-described surface layer. However, to the monolayer type photosensitive layer, it is required to add a charge generating material. As the charge generating material, same materials as those for the charge generating layer described in the above description, [Photosensitive layer in the case surface protective layer is formed], may be employed and the addition amount is preferably 10 to 60% by mass, more preferably 20 to 50% by mass, in the entire solid matter of the photosensitive layer.

To form the outermost surface layer of the photosensitive layer in the case no such surface protective layer is formed, the layer is formed by preparing a coating solution containing the above-described indispensable constitutional components and additionally, as necessary, a charge generating material, a charge transporting material, a fluorine-containing compound, an anti-oxidation agent, a solvent and the like, applying the coating solution either to a photosensitive layer formed on a conductive support or to an underlayer and successively cross-linking and curing the coating solution by heating.

At the time of preparing the coating solution, for the purpose of solution viscosity adjustment or the like, a common organic solvent such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, and the like may be mixed alone or as a mixture of more than one of them, as necessary.

As the coating method, a common method such as a blade coating method, a wire bar coating method, a spray coating method, a dip coating method, a bead coating method, an air knife coating method, a curtain coating method and the like may be employed.

<Development Step>

The development step of the present invention is a step of forming a toner image on a latent image carrier surface by bringing a development roll bearing a developer layer containing at least a toner on the surface either into contact with the latent image carrier surface or closer to it as to stick the toner particles to the electrostatic latent image on the above-described latent image carrier surface. In both cases of a single-component developer and a binary-component developer, known development methods may be employed as the development method. As the development method using a binary component developer, there are a cascade method and a magnetic brush method and the like. In the image formation method of the present invention, the development method is not particularly restricted.

Toner for Electrophotography to be Employed for the Present Invention

A toner for electrophotography to be employed for the present invention (hereinafter, sometimes simply referred as to toner) contains a binder resin, a coloring agent, a release agent, and other components as necessary. Hereinafter, the respective constitutional components will separately be described in details.

(Binder Resin)

The binder resin in a toner to be employed for the present invention contains a crystalline resin as a main component and in this case the term, a main component, means a major component among components composing the above-described binder resin and more practically, it means a component composing 50% by mass of the above-described binder resin. However, in the present invention, in the above-described binder resin, the crystalline resin is preferably not less than 70% by mass, further preferably not less than 90% by mass, and especially preferably 100% by mass.

In the present invention, the term, crystalline, of the crystalline resin means the resin which has no step by step change of heat absorption quantity and has a clear endothermic peak by differential scanning calorimetry (DSC). The endothermic peak is sometimes a peak having a width of 40 to 50° C. when the resin is contained in a toner. In the case of a polymer containing the crystalline resin as a main chain copolymerized with other components, if other components are not more than 50% by mass, such as copolymer is also called as the crystalline resin.

The melting point of the above-described crystalline resin is preferably 50 to 120° C., further preferably 60 to 110° C. If the above-described melting point is lower than 50° C., the toner particles become easy to be aggregated and the storage property of fixed images is deteriorated in some cases, whereas if it is higher than 120° C., low temperature fixing sometimes becomes impossible.

Incidentally, the melting point of the above-described crystalline resin can be measured as the melting peak temperature of the input-compensating differential scanning calorimetry defined by JIS K-7121 in the case the measurement is carried out from a room temperature to 150° C. at a temperature increase rate of 10° C./min using a differential scanning calorimeter (DSC). Further, generally, the crystalline resin sometimes has a plurality of melting peaks and in this invention, the maximum peak is regarded as the melting point.

The crystalline resin, a main component of the binder resin to be employed for the present invention is not particularly restricted if it has crystalline property and practical examples of the crystalline resin are a polyester, a polyurethane, a polyamide, a polyacrylate, a polymethacrylate, their copolymers and the like.

Among them, from a viewpoint of the adhesion strength to an object recording medium and charging property at the time of fixing and adjustment of the melting point in a preferable range, a crystalline polyester resin is preferably employed. Also, an aliphatic crystalline polyester resin with a proper melting point is more preferably employed.

Further, in the present invention, use of a crystalline polyester resin as the main component of the binder resin of the toner in combination of a photoreceptor to be employed for the present invention gives more excellent transferring property and therefore, it is especially preferable.

Hereinafter, the crystalline polyester resin to be employed for the present invention will be described in details. The polyester resin as a main component to be employed for the present invention is required to be a crystalline polyester resin. If the polyester resin is not crystalline, that is, the resin is non-crystalline, it becomes impossible to maintain toner blocking resistance and image storage property while the low temperature fixing property being kept excellent.

The polyester resin is synthesized using an acid (dicarboxylic acid) component and an alcohol (diol) component. In the following description, regarding the polyester resin, the constituent portion which is the acid component before the synthesis of the polyester resin and the constituent portion which is the alcohol component before the synthesis of the polyester resin are sometimes referred as to an acid-derived constitutional component and an alcohol-derived constitutional component, respectively.

Acid-Derived Constitutional Component

There are a variety of dicarboxylic acids as examples of the acid to be the above-described acid-derived constitutional component, whereas as the acid-derived constitutional component in a specified polyester resin, aromatic dicarboxylic acids and aliphatic dicarboxylic acids are preferable; aliphatic dicarboxylic acids are more preferable; and straight chain type aliphatic dicarboxylic acids are especially preferable.

As the aliphatic dicarboxylic acids, examples are oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid, and the like and additionally their lower alkyl esters and acid anhydrides, and they are not restricted to these compounds. Among them, in consideration of the availability, sebacic acid and 1,10-decanedicarboxylic acid are preferable.

As the aromatic dicarboxylic acids, examples are terephthalic acid, isophthalic acid, 2,6-naphthalenedicarboxylic acid, 4,4'-biphenyldicarboxylic acid, and the like and among them, terephthalic acid is preferable in terms of the availability and the easiness of formation of a low melting point polymer.

As the above-described acid-derived constitutional component, it is preferable to contain constitutional components such as a dicarboxylic acid-derived constitutional component having a double bond and a dicarboxylic acid-derived constitutional component containing sulfonic acid group, and the like, other than the above-described aliphatic dicarboxylic acid-derived constitutional component and aromatic dicarboxylic acid-derived constitutional component.

Incidentally, the above-described dicarboxylic acid-derived constitutional component having a double bond includes constitutional components derived from a lower alkyl ester or an anhydride of a dicarboxylic acid having a double bond other than the constitutional components derived from the dicarboxylic acid having a double bond. Further, the above-described dicarboxylic acid-derived constitutional component having sulfonic acid group includes constitutional components derived from a lower alkyl ester or an anhydride and the like of a dicarboxylic acid having sulfonic acid group other than the constitutional components derived from the dicarboxylic acid having sulfonic acid group.

The above-described dicarboxylic acid having a double bond is capable of cross-linking the entire resin owing to the double bond, so that it can be used suitably for hot off-set occurrence prevention at the time of fixing. As such a dicarboxylic acid, examples are fumaric acid, maleic acid, 3-hexenedioic acid, 3-octenedioic acid, and the like, and it is not restricted to these compounds. Further, their lower alkyl esters and acid anhydrides and the like are also usable. Among them, in terms of the cost, fumaric acid, maleic acid and the like are preferable.

The above-described dicarboxylic acid having sulfonic acid group is effective to excellently dispersing a coloring material such as a pigment or the like. Further, when the entire resin is emulsified with water or suspended in water to produce ultra small particles, if there is sulfonic acid group, it is possible to emulsify and suspend without using a surfactant as it will be described later. As such a dicarboxylic acid having sulfonic acid group, examples are sodium 2-sulfoterephthalate salt, 5-sodium sulfoisophthalate salt, sodium sulfosuccinate salt, and the like, and it is riot restricted to these compounds. Further, their lower alkyl esters, acid anhydrides and the like are also usable. Among them, in terms of the cost, sodium 5-sulfoisophthalate salt and the like is preferable.

The content of these aliphatic dicarboxylic acid-derived constitutional component and aromatic dicarboxylic acid-derived constitutional component (the dicarboxylic acid-derived constitutional component having a double bond and the dicarboxylic acid-derived constitutional component having sulfonic acid group) in the entire acid-derived constitutional components is preferably 0.1 to 20% by constitutional mole, more preferably 1 to 10% by constitutional mole.

If the above-described content is less than 0.1% by constitutional mole, the pigment dispersibility is inferior and the emulsion particle diameter becomes large and the adjustment of the toner diameter is made difficult owing to the aggregation in some cases. On the other hand, if it is more than 20% by constitutional mole, the crystallinity of the polyester resin is deteriorated; the melting point is decreased; the storage property of the images is worsened; and the emulsion particle diameter becomes so small to dissolve in water to result in impossibility of latex formation in some cases.

Incidentally, in this specification, the term, % by constitutional mole, means the percentage in the case an acid-derived constitutional component in the entire acid-derived constitutional components in the polyester resin or an alcohol constitutional component in the entire alcohol-derived constitutional components in the polyester resin is respectively set as one unit (by mole).

Alcohol-Derived Constitutional Component

As an alcohol to be the alcohol-derived constitutional component, aliphatic diols are preferable and straight chain type aliphatic diols of 7 to 20 carbon atoms are more preferable. If the above-described aliphatic diols are branched type, the crystallinity of the polyester resin is deteriorated and the melting point is decreased, so that the toner blocking resistance, the image storage property, and the low temperature fixing property are deteriorated in some cases. Further, if the number of the chain carbons is less than 7, in the case of condensation polymerization with the aromatic dicarboxylic acids, the melting point becomes high and the low temperature fixing becomes difficult in some cases. On the other hand, if it is higher than 20, practically, the materials are difficult to be obtained. The number of the chain carbons is more preferably not more than 14.

Further, in the case of obtaining the polyester resin by condensation polymerization with aromatic dicarboxylic acid, the number of the chain carbons is preferably an odd number. If the above-described number of chain carbons is an odd number, the melting point of the polyester resin is low as compared with that in the case of an even number and the melting point is easy to be within the above-described numeral range.

As the aliphatic diols, practically, examples are ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13 -tridecanediol, 1,14-tetradecanediol, 1,18-octadecanediol, 1,20-eicosanediol, and the like, and it is not restricted to these diols. Among them, in consideration of the availability, ethylene glycol, 1,3-propanediol, 1,4-butanediol, 1,8-octanediol, 1,9-nonanediol, and 1,10-decanediol are preferable.

The content of these aliphatic diol-derived constitutional components is preferably not less than 80% by constitutional mole in the above-described entire alcohol-derived constitutional component and as necessary, other components may be contained. The above-described alcohol-derived constitutional component is further preferable to contain not less than 90% by constitutional mole of the above-described aliphatic diol-derived constitutional components.

If the content of the above-described aliphatic diol-derived constitutional components is less than 80% by constitutional mole, the crystallinity of the polyester resin is deteriorated and the melting point is decreased, so that toner blocking resistance, the storage property of the images, and the low temperature fixing property are worsened in some cases.

Other components to be contained as necessary are a diol-derived constitutional component having a double bond, a diol-derived constitutional component containing sulfonic acid group and the like. In the case the dicarboxylic acid-derived constitutional components do not contain the dicarboxylic acid-derived constitutional component having a double bond or containing sulfonic acid group, as the diol constitutional component, they are preferably copolymerized.

As the above-described diol having a double bond, examples are 2-butene-1,4-diol, 3-butene-1,6-diol, 4-butene-1,8-diol, and the like. As the above-described diols having sulfonic acid group, examples are sodium 1,4-dihydroxy-2-benzenesulfonate salt, sodium 1,3-dihydroxymethyl-5-benzenesulfonate salt, and sodium 2-sulfo-1,4-butanediol salt, and the like.

In the case an alcohol-derived constitutional component (at least one of a diol-derived constitutional component having a double bond and a diol-derived constitutional component having sulfonic acid group) is added other than these aliphatic diol-derived constitutional components, its content is preferably 1 to 20% by constitutional mole, more preferably 2 to 10% by constitutional mole, in the entire alcohol-derived constitutional components.

If the content of the alcohol-derived constitutional component other than the above-described aliphatic diol-derived constitutional components is less than 1% by constitutional mole, the pigment dispersibility is inferior and the emulsion particle diameter becomes large and the adjustment of the toner diameter is made difficult owing to the aggregation in some cases. On the other hand, if it is more than 20% by constitutional mole, the crystallinity of the polyester resin is deteriorated; the melting point is decreased; the storage property of the images is worsened; and the emulsion particle diameter becomes so small to dissolve in water to result in impossibility of latex formation in some cases.

Further, the crystalline polyester resin to be employed for the present invention is preferable to have the ester concentration M represented by the following expression (2) to be not lower than 0.01 and not higher than 0.2:

$$M=K/N \qquad \text{expression (2)}$$

(wherein, the reference character M represents the ester concentration; the reference character K represents the number of ester groups in the polymer; and the reference character N represents the number of atoms composing the polymer chain of the polymer, respectively.).

In this case, the term, ester concentration M, represents one index showing the content ratio of ester groups in the polymer in the crystalline polyester resin.

That the number of ester groups in the polymer represented by the reference character K in the expression means, in other words, the number of the ester bonds contained in the entire polymer.

The term, the number of atoms composing the polymer chain of the polymer, represented by the reference character N in the expression is the total of atoms composing the polymer chain of the polymer and includes all of the atoms relevant to the ester bonds, but does not include the atoms in the portions branched in other constituent parts. That is, the carbon atoms and oxygen atoms (two oxygen atoms in one ester bond) derived from carboxyl groups and alcohol groups relevant to the ester bonds and carbons composing the polymer chain, for example, six carbons in the case of an aromatic ring, are included in the count of the above-described number of atoms, however hydrogen atoms of, for example, an aromatic ring or an alkyl group composing the polymer chain and other atoms or atom groups of substituents for hydrogen atoms are not included in the count of the above-described number of atoms.

To explain with the reference of practical examples, those included in the above-described number N of atoms composing the polymer chain of the polymer among ten atoms, the total of six carbon atoms and four hydrogen atoms, are only 6 of six carbon atoms, and further if any substituents substitute for these hydrogen atoms, the atoms composing the substituents are not included in the number N of the atoms composing the polymer chain of the polymer.

In the case the crystalline polyester resin is a homopolymer comprising only one repeating unit (for example, the polymer is represented by $H—[OCOR^1COOR^2O—]_n—H$, the one repeating unit can be represented by the chain in the brackets), since one repeating unit comprises two ester bonds (that is the number K' of the ester groups in the repeating unit is 2), the ester concentration M can be calculated from the following expression (2-1):

$$M=2/N' \qquad \text{expression (2-1)}$$

(wherein, the reference character M represents the ester concentration; and the reference character N' represents the number of atoms composing the polymer chain of the polymer, respectively.).

Further, in the case the crystalline polyester resin is a copolymer comprising a plurality of copolymerization units, the number $K^x$ of ester bonds and the number $N^x$ of atoms composing the polymer chains are calculated for every copolymerization unit and after multiplication of the copolymerization ratio, the resulting numbers are summed up and the resulting numbers are substituted for the above-described expression 2 to calculate the ester concentration. For example, in the case a compound $[(Xa)_a(Xb)_b(Xc)_c]$ comprising three copolymerization units Xa, Xb and Xc and the their copolymerization ratio is a:b:c (a+b+c=1), the ester concentration M can be calculated based on the following expression (2-2):

$$M=\{K^{Xa}\times a+K^{Xb}\times b+K^{Xc}\times c\}/\{N^{Xa}\times a+N^{Xb}\times b+N^{Xc}\times c\} \qquad \text{expression (2-2)}$$

(wherein, the reference character M represents the ester concentration; the reference characters $K^{Xa}$, $K^{Xb}$ and $K^{Xc}$ each independently represent the number of ester groups in the copolymerization unit Xa, the copolymerization unit Xb, the copolymerization unit Xc, respectively; and the reference characters $N^{Xa}$, $N^{Xb}$ and $N^{Xc}$ each independently represent the number of atoms composing polymer chains in the copolymerization unit Xa, the copolymerization unit Xb, the copolymerization unit Xc, respectively.).

It has been made clear by the investigations carried out by inventors of the present invention that in the case the crystalline polyester resin is used as the binder resin, the amount of the ester groups existing in the polymers particularly significantly affects the charging property as a toner. Consequently, that the amount of the ester groups in the polymers is suppressed to low to the extent to which the low temperature fixing property is not deteriorated is an important factor to improve the charging property as a toner. In the crystalline polyester resin to be employed as the binder resin, it is made possible to obtain a toner excellent in the toner blocking resistance, the image storage property, and the low temperature fixing property, and further the charging property as well by adjusting the ester concentration M defined in the above-described (expression 2) to be not less than 0.01 and not more than 0.2. As a result, in the image formation method of the present invention, its use contributes to image formation with high image quality.

If the ester concentration M is less than 0.01, although the charging property becomes excellent, the low temperature fixing property is deteriorated since the melting point of the resin is too high. The lower limit of the ester concentration M is more preferably not less than 0.04. On the other hand, if the ester concentration M is higher than 0.2, the charging property is deteriorated and in addition to that, the stability of fixed images and the powder blocking property are deteriorated owing to that the melting point of the resin becomes too low.

Production Method of Crystalline Polyester Resin

The production method of the above-described crystalline polyester resin is not particularly restricted and common polyester polymerization methods by reacting acid components and alcohol components can be employed and for example, a direct condensation polymerization, ester interchange method and the like are selectively employed depending on the types of the monomers. The mole ratio (acid components/alcohol components) of the above-described acid components and alcohol components cannot definitely be determined since it differs depending on the reaction conditions and the like, yet it is generally about 1/1.

The production of the above-described polyester resin can be carried out at a polymerization temperature of 180 to 230° C. and as necessary, the reaction system is kept in decreased pressure to carry out the reaction while removing water and alcohol generated at the time of condensation.

If the monomers are not dissolved or compatible at the reaction temperature, a solvent with a high boiling point is added as a dissolution assisting agent to promote the dissolution. In the condensation polymerization reaction, the reaction is carried out while the dissolution assisting agent being distilled. In the case there exist monomers with low compatibility in the copolymerization reaction, the monomers with low compatibility and an acid or an alcohol, which is to be condensation polymerized, are previously condensed to carry out condensation polymerization together with main components.

As the catalyst usable for the production of the above-described polyester resin, examples are compounds of alkali metals such as sodium, lithium and the like; compounds of alkaline earth metals such as magnesium, calcium and the like; compounds of metals such as zinc, manganese, antimony, titanium, tin, zirconium, germanium, and the like; phosphite compounds, phosphate compounds, and amine compounds and the like. Practical examples are the following compounds.

For example, sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenyl antimony, tributyl antimony, tin formate, tin oxalate, tetraphenyl tin, dibutyl tin dichloride, dibutyltin oxide, diphenyl tin oxide, zirconium tetrabutoxide, zirconium naphthenate, zirconyl carbonate, zirconyl acetate, zirconyl stearate, zirconyl octylate, germanium oxide, triphenyl phosphite, tris(2,4-di-tert-butylphenyl)phosphite, ethyltriphenylphosphonium bromide, triethylamine, triphenylamine and the like.

(Coloring Agent)

The coloring agent of a toner to be employed for the present invention is not particularly restricted and well-known coloring agents are usable and properly selected depending on the purposes. One kind of pigments may be used alone or more than one pigments of similar types may be used by being mixed. Or more than one pigments of different types may also be used by being mixed. As the above-described coloring agents, practical examples are carbon black such as furnace black, channel black, acetylene black, thermal black and the like; inorganic pigments such as red iron oxide, aniline black, Prussian blue, titanium oxide, magnetic powder, and the like; azo pigments such as Fast yellow, monoazo yellow, disazo yellow, Pyrasolone Red, Chelate Red, Brilliant Carmine (3B, 6B and the like), Para Brown, and the like; phthalocyanine pigments such as copper phthalocyanine, non-metal phthalocyanine and the like; and condensed polycyclic type pigments such as flavanthrone yellow, dibromoanthrone orange, perillene red, quinacridone red, dioxazine violet and the like.

Further the coloring agents include various pigments such as Chrome Yellow, HANSA Yellow, Benzidine Yellow, Threne Yellow, Quinoline Yellow, Permanent Orange GTR, Pyrazolone Orange, Vulcan Orange, Watchung Red, Permanent Red, DU PONT Oil Red, LITHOL Red, Rhodamine B Lake, Lake Red C, Rose Bengal, Aniline Blue, Ultramarine Blue, Chalco-oil Blue, Methylene Blue Chloride, Phthalocyanine Blue, Phthalocyanine Green, Malachite Green Oxalate, Para Brown and the like; and various dyes such as acridine type, xanthene type, azo type, benzoquinone type, azine type, anthraquinone type, dioxazine type, thiazine type, azomethine type, indigo type, thioindigo type, phthalocyanine type, aniline black type, polymethine type, triphenylmethane type, diphenylmethane type, thiazole type, xanthene type and the like. A black color pigment or dye such as carbon black and the like may be mixed with these coloring agents to the extent that the transparency of the coloring agent is not deteriorated. Further, dispersion dyes, oil-soluble dyes and the like are also included in the coloring agents.

The content of the above-described coloring agents in the toner to be employed for the present invention is preferably 1 to 30 parts by mass to 100 parts by mass of the above-described binder resin, and they are preferably added as much as possible in the above-described numeric range to the extent that the smoothness of the image surface after fixation is not deteriorated. If the content of the coloring agents is increased, in the case of forming images with the same concentration, the thickness of only the images can be made thin to effectively prevent occurrence of off-set.

Incidentally, the respective color toners, a yellow toner, a magenta toner, a cyan toner, a black toner, and the like can be obtained by properly selecting the types of the above-described coloring agents.

(Other Components)

Other components usable for the toner to be employed for the present invention are not particularly restricted and properly selected depending on the purposes and examples of the components are well-known various additives such as inorganic fine particles, organic fine particles, charge controlling agents, releasing agents and the like.

The above-described inorganic fine particles are generally used for the purpose of improvement of the fluidity of the toner. Example of them are fine particles of silica, alumina, titanium oxide, barium titanate, magnesium titanate, calcium titanate, strontium titanate, zinc oxide, silica sand, clay, mica, wollastonite, kieselguhr, cerium chloride, red iron oxide, chromium oxide, cerium oxide, antimony trioxide, magnesium oxide, zirconium oxide, silicon carbide, silicon nitride and the like. Among them, silica fine particle is preferable and silica fine particle subjected to hydrophobic treatment is especially preferable.

The average primary particle diameter (the number-average particle diameter) of the above-described inorganic fine particles is preferably 1 to 1,000 nm and the addition amount (as the extra-addition) is preferably 0.01 to 20 parts by mass to 100 parts by mass of a toner.

The above-described organic particles are used generally for the purpose of improvement the cleaning property and the transferring property. As the above-described organic particles, examples are fine particles of polystyrene, poly (methyl methacrylate), and polyfluorovinylidene and the like.

The above-described charge controlling agent are used generally for the purpose of improvement the charging property. As the above-described charge controlling agents, examples are salicylate metal salts, metal-containing azo compounds, Nigrosine, quaternary ammonium salts and the like.

The above-described releasing agents are used generally for the purpose of improvement of the releasing property between a toner and the fuser roller and the like. Practical examples of the above-described releasing agents are low molecular weight polyolefins such as polyethylene, polypropylene, polybutene and the like; silicones having softening points by heating; aliphatic acid amides such as oleic amide, erucamide, ricinoleic acid amide, stearic acid amide, and the like; plant-derived waxes such as carnauba wax, rice wax, candelilla wax, Japan wax, Jojoba wax and the like; animal-derived waxes such as bees wax and the like; mineral and petroleum type waxes such as montan wax, ozocerite, ceresine, paraffin wax, microcrystalline wax, Fischer-Tropsch wax and the like; and ester type waxes such as aliphatic acid esters, montanic acid esters, carboxylic acid esters and the like. In the present invention, these releasing agents may be used by a single type or as a mixture of more than one of them.

The addition amount (intra-addition) of these releasing agents is preferably 0.5 to 50% by mass, more preferably 1 to 30% by mass, and furthermore preferably 5 to 15% by mass, in the total toner amount. If the amount is less than 0.5% by mass, no effect of the addition of the releasing agents is provided and if the amount is more than 50% by mass, the charging property of the toner is sometimes affected and the toner becomes easy to be broken in the inside of a developer and further the releasing agents are spent for the carrier to cause an effect that the charging efficiency of the toner tends to be easily decreased. Further, for example, in the case of using color toners, bleeding of the releasing agents to the image surface at the time of fixation becomes insufficient and the releasing agents thus easily remain in the images and as a result, the transparency is undesirably deteriorated.

Production Method of Toner for Electrophotography

The production method suitable to produce a toner to be employed for the present invention is not particularly restricted, and a wet granulation method is preferable. As the mentioned wet granulation method, well-known a melting and suspending method, an emulsifying and aggregation method, dissolving and suspending method and the like are suitable to be employed. The production method will be described with the reference of the emulsifying and aggregation method in the case of using a crystalline polyester resin as a main component of a binder resin.

The above-described emulsifying and aggregation method comprises an emulsifying step for forming emulsified particles (droplets) of the specified emulsified polyester resin, which is already described before in the paragraph (Binder resin) and an aggregation step for forming aggregations of the emulsified particles (droplets).

(Emulsifying Step)

In the above-described emulsifying step, the emulsified particles (droplets) of the specified polyester resin are formed by applying shearing force to a solution produced by mixing a water-based medium with a mixed solution (a polymer solution) of a sulfonated polyester resin and coloring agents added as necessary.

At that time, the viscosity of the polymer solution can be lowered by heating or dissolving the polyester resin in an organic solvent to form the emulsified particles. Further, in order to stabilize the emulsified particles and increase the viscosity of the water-based medium, a dispersant may be used. Hereinafter, such a dispersion of the emulsified particles will sometimes be referred as to a resin particle dispersion solution.

As the above-described dispersant, usable examples are water-soluble polymers such as polyvinyl alcohol, methyl cellulose, ethyl cellulose, hydoxyethyl cellulose, carboxymethyl cellulose, poly(sodium acrylate), poly(sodium methacrylate) and the like; surfactants, e.g., anionic surfactants such as sodium dodecylbenzenesulfonate, sodium octadecylsulfate, sodium oleate, sodium laurate, potassium stearate, and the like; cationic surfactants such as laurylamine acetate, stearylamine acetate, lauryltrimethylammonium chloride, and the like; amphoteric surfactant such as lauryldimethylamine oxide and the like; and nonionic surfactants such as polyoxyethylene alkyl ether, polyoxyethylene alkyl phenyl ether, polyoxyethylene alkyl amine and the like; and inorganic compounds such as tripotassium phosphate, aluminum hydroxide, calcium sulfate, calcium carbonate, barium carbonate and the like.

In the case an inorganic compound is used as the above-described dispersants, those commercialized may be used as they are, and, in order to obtain fine particles, a method for producing fine particles of an inorganic compound in a dispersion agent may be employed. The use amount of the mentioned dispersion agent is preferably 0.01 to 20 parts by mass to 100 parts by mass of the above-described polyester resin (binder resin).

Incidentally, in the above-described emulsifying step, if the above-described crystalline polyester resin is previously copolymerized with a dicarboxylic acid having sulfonic acid group (that is, a proper amount of dicarboxylic acid-derived constitutional component having sulfonic acid group is contained in the acid-derived constitutional component), the dispersion stabilizer such as a surfactant or the like can be decreased or the use is made unnecessary to form the emulsified particles.

As the above-described organic solvent, for example, ethyl acetate, toluene can be usable and the solvent is properly selected to be used corresponding to the above-described polyester resin.

The use amount of the above-described organic solvent is preferably 50 to 5,000 parts by mass, more preferably 120 to 1,000 parts by mass, to 100 parts by mass of the total amount of the above-described crystalline polyester resin and other monomers used as necessary (hereinafter, sometimes referred simply as to polymers). Incidentally, before the emulsified particle formation, coloring agents may be mixed. As the coloring agents, those described in the paragraph (Coloring agents) can be employed.

As an emulsifier to be employed at the time of forming the above-described emulsified particles, examples to be employed are a homogenizer, a homomixer, a pressurizing kneader, an extruder, a medium dispersing apparatus and the like. Regarding the size of the emulsified particles (droplets) of the above-described polyester resin, the average particle diameter (the volume-average particle diameter) is preferably 0.01 to 1 μm, more preferably 0.03 to 0.6; μm, and furthermore preferably 0.03 to 0.4 μm.

As a dispersing method for the above-described coloring agents, any methods, for example, common dispersion methods using a rotation shearing type homogenizer, a ball mill containing media, a sand mill, and a DYNO MILL can be employed without any restriction.

Further, as necessary, an aqueous dispersion of the coloring agents using a surfactant or an organic solvent dispersion of the coloring agents using a dispersing agent can be produced. Hereinafter, such dispersion of the coloring agents is sometimes referred as to a coloring particle dispersion solution. As the surfactant and the dispersing agent to be employed for the dispersion, those same as the described dispersants to be employed for dispersing the above-described crystalline polyester resin can be used.

The addition amount of the above-described coloring agents is preferably 1 to 20% by mass, more preferably 1 to 10% by mass, and further more preferably 2 to 10% by mass, particularly preferably 2 to 7% by mass, in the entire amount of the polymers. In the case the coloring agents are mixed in the above-described emulsifying step, the mixing of the above-described polymers and the coloring agents can be carried out by mixing the organic solvent dispersion of the coloring agents to the organic solvent solution of the polymers.

Further, as the dispersing method of the above-described releasing agents, same methods as those for dispersing the above-described coloring agents can be employed. Hereinafter, the dispersion of a releasing agent produced in such a manner is sometimes referred as to a releasing agent dispersion. As the surfactants and the dispersing agents to be employed for the dispersion, those same as the described dispersants to be employed for dispersing the above-described crystalline polyester resin can be used.

The addition amount of the above-described releasing agents is preferably 1 to 20% by mass, more preferably 1 to 10% by mass, and further more preferably 2 to 10% by mass, particularly preferably 2 to 7% by mass, in the entire amount of the polymers.

In the case the releasing agents are mixed in the above-described emulsifying step, the mixing of the above-described polymers and the releasing agents can be carried out by mixing the organic solvent dispersion of the releasing agents to the organic solvent solution of the polymers.

(Aggregation Step)

In the above-described aggregation step, together with the coloring particle dispersion and the releasing agent dispersion, the obtained resin emulsion particles are heated at a temperature close to the melting point of the above-described crystalline polyester resin and lower than the melting point to be aggregated and to form aggregations. Formation of the aggregations of the emulsified particles can be performed by adjusting the pH of the emulsion to be acidic under stirring condition. The pH is preferably 2 to 6, more preferably 2.5 to 5, and furthermore preferably 2.5 to 4. At that time, use of a coagulant is also effective.

The coagulant to be employed can be a surfactant with the opposed polarity to that of the surfactant used as the above-described dispersing agents and an inorganic metal salt and other than that, a metal complex with at least di-valence is preferably used. Especially, in the case of using such a metal complex, the use amount of the surfactant can be decreased and it is thus particularly preferable since the charging property can be improved.

As the above-described inorganic metal salt, examples are metal salts such as sodium chloride, zinc acetate, calcium chloride, calcium nitrate, barium chloride, magnesium chloride, zinc chloride, aluminum chloride, aluminum sulfate and the like; and inorganic metal salt polymers such as polyaluminum chloride, polyaluminum hydroxide, calcium polysulfide and the like. Among them, an aluminum salt and its polymer are especially preferably used. In order to obtain further sharp particle size distribution, the valence of the inorganic metal salt is better to be divalent than monovalent, to be trivalent than divalent, to be tetravalent than trivalent and if the valence is same, polymer type ones, inorganic metal salt polymers, are more preferable.

(Fusion Step)

In the above-described fusion step, under the stirring condition as same in the case of the aggregation step, the pH of the suspension of the aggregations is adjusted to be in a range of 3 to 7, so that the proceeding of the aggregation can be stopped and the suspension is heated at a temperature not to lower than the melting point of the above-described crystalline polyester resin to fuse the aggregations. The heating can be carried out without any problem if the temperature is not to lower than the melting point of the above-described crystalline polyester resin.

The duration of the above-described heating is sufficient if the fusion is carried out sufficiently and it may be 0.5 to 10 hours.

The fused particles obtained by fusion can be formed to be toner particles through a solid-liquid separation step such as filtration and a washing step and a drying step successively carried out based on necessity. In this case, in order to assure sufficiently high charging property and reliability as a toner, washing is preferably carried out sufficiently in the washing step.

In the drying step, any method such as a common vibration type fluidizing drying method, a spray drying method, a freeze drying method, a flash jet method and the like can be employed. It is preferable for the particles of the toner to adjust the water content after drying to be not more than 1.0% by mass or lower, more preferably not more than 0.5% by mass.

In the above-described fusion step, when the above-described crystalline polyester resin is heated to a temperature not to lower than the melting point or on the completion of the fusion, cross-linking reaction may be carried out. The cross-linking reaction may also be carried out simultaneously with the aggregation. In the case of carrying out the cross-linking reaction, for example, an unsaturated sulfonated crystalline polyester resin with which double bond components are copolymerized is used as the binder resin and radical reaction is caused on the resin to introduce the cross-linking structure. At that time, the following polymerization initiator is employed.

The polymerization initiator is, for example, tert-butyl peroxy-2-ethylhexanoate, tert-hexyl peroxy-2-ethylhexanoate, cumyl perpivalate, tert-butyl peroxylaurate, tert-hexyl peroxypivalate, tert-butyl peroxypivalate, benzoyl peroxide, lauroyl peroxide, octanoyl peroxide, ditert-butyl peroxide, tert-butylcumyl peroxide, cumyl peroxyneodecanate, 1-cyclohexyl-1-methylethyl epoxyneodecanate, tert-hexyl peroxyneodecanate, tert-butyl peroxyneodecanate, dicumyl peroxide, 2,2'-azobis (isobutyronitrile), 2,2'-azobis(2-methylbutyronitrile), 2,2'-azobis(2,4-dimethylvaleronitrile), 2,2'-azobis(4-methoxy-2, 4-dimethylvaleronitrile), 1,1-bis(tert-butylperoxy) 3,3,5-trimethylcyclohexane, 1,1-bis(tert-butylperoxy) cyclohexane, 1,4-bis(tert-butylperoxycarbonyl) cyclohexane, 2,2'-bis(tert-butylperoxy)octane, n-butyl-4,4-bis(tert-butylperoxy)valerate, 2,2-bis(tert-butylperoxy) butane, 1,3-bis(tert-butylperoxyisopropyl)benzene, 2,5-dimethyl-2,5-di(tert-butylperoxy)hexane, 2,5-dimethyl-2,5-di(tertbutylperoxy)hexane, 2,5-dimethyl-2,5-di (benzoylperoxy)hexane, di-tertbutyl diperoxyisophthalate, 2,2-bis(4,4-di-tert-butylperoxycyclohexyl)propane, di-tert-butyl peroxyamethylsuccinate, ditert-butyl peroxydimethylglutarate, di-tert-butyl peroxyhexahydroterephthalate, di-tert-butyl peroxyazelate, 2,5-dimethyl-2,5-di(tert-butylperoxy)hexane, diethylene glycol-bis(tertbutylperoxycarbonate), di-tert-butyl peroxytrimethyladipate, tris(tertbutylperoxy)triazine, vinyltris(tert-butylperoxy)silane, 2,2'-azobis(2-methylpropioneamidine dihydrochloride), 2,2'-azobis[N-(2-carboxyethyl)-2-methylpropioneamidine], 4,4'-azobis(4-cyanovaleric acid) and the like.

These polymerization initiators may be used alone and in combination of more than one of them. The amount and the types of the polymerization initiators are selected depending on the positions of the unsaturated portions in the polymer and the types and the amounts of coexisting coloring agents.

The polymerization initiators may be mixed previously with the polymer before the emulsifying step or kneaded with the aggregated mass in the aggregation step. Further, they may be introduced in the fusion step or after the fusion step. In the case of introducing them in the aggregation step, the fusion step, or after the fusion step, a solution in which polymerization initiators are dissolved or emulsified is added to the particle dispersion (the resin particle dispersion or the like). These polymerization initiators may be mixed with a well-known cross-linking agent, a chain moving agent, a polymerization inhibitor and the like in order to control the polymerization degree.

According to the toner production method by the above-described emulsifying and aggregation method, the particle shape of the toner can be controlled. As the particle shape of the toner is preferably spherical. Not only the powder fluidity can be increased but also the transferring efficiency can be improved owing to the decrease of the non-electrostatic adhesive force to the photoreceptor surface by making the particle shape spherical. Further, the transferring efficiency can further be improved by combining the toner with the above-described photoreceptor to be employed for the present invention.

The toner to be employed for the present invention may be subjected to the surface treatment of the toner particle surface with the above-described additional additives such as fluidizing agent, assisting agent and the like. Also the surface of the toner to be employed for the present invention may be coated with a surface layer. It is desirable for the surface layer not to significantly affect the dynamic properties and the melt viscoelasticity of the entire toner. For example, a non-fusible or a high melting point surface layer thick covers the toner, the low temperature fuser property provided by the utilization of the crystalline polyester resin cannot be made fully effective. Consequently, the thickness of the surface layer is desirable to be thin and more particularly it is preferable in a range of 0.001 to 0.5 μm.

In order to form the surface layer with the thickness in the above-described range, a method for chemically treating the surface of the binder resin, the coloring agents as well as inorganic fine particles to be added as necessary and particles including other materials is preferably employed.

The components to compose the surface layer include silane coupling agents, isocyanates, vinyl type monomers and the like and further the components are preferable to have polar groups introduced into and chemical bonding of the groups increases the adhesive force between the toner and an object recording medium such as paper and the like.

As the above-described polar groups, any functional group having polarity may be usable and examples are carboxyl, carbonyl, an epoxy group, an ether group, hydroxyl, an amino group, an imino group, a cyano group, an amido group, an imido group, an ester group, a sulfone group and the like.

Practical methods for the chemical treatment are, for example, a method for oxidation using a strongly oxidizing substance such as peroxides and the like, ozone oxidation, plasma oxidation and the like; a method for bonding a polymerizable monomer having polar groups by graft polymerization; and the like. Owing to the chemical treatment, the polar groups can be bonded firmly to the molecular chains of the crystalline resin by covalent bonds.

Further, another chargeable substance may be chemically or physically be attached to the particle surface of the toner to be employed for the present invention. Also, fine particles of a metal, a metal oxide, a metal salt, a ceramic, a resin, carbon black or the like may be added additionally for the purpose of improvement of the charging property, the conductivity, the powder fluidity, the lubricating property and the like.

<Preferable Physical Characteristics of Toner for Electrophotography of the Present Invention>

The volume-average particle diameter of the toner for electrophotography to be employed for the present invention is preferably 1 to 20 μm, more preferably 3 to 10 μm. Also, the number-average particle diameter is preferably 1 to 20 μm, more preferably 3 to 10 μm.

The above-described volume-average particle diameter and number-average particle diameter can be calculated by measurement using, for example, a COULTER COUNTER [TA-II] model (manufactured by Coulter Co.) with an aperture diameter of 50 μm. At that time, the measurement is carried out after the toner is dispersed in an aqueous electrolyte solution (an aqueous isoton solution) and stirred for not less than 30 seconds by ultrasonic waves.

The toner to be employed for the present invention is preferable to have a melting point in a temperature range of 50 to 120° C. Since the viscosity of the above-descried crystalline resin sharply decreases having the melting point as the threshold, if the toner is stored at the temperature not to lower than the melting point, the toner particles aggregate and cause blocking. Therefore, the melting point of the toner which contains the above-described crystalline resin as a main component of the binder resin is preferably higher than the temperature at which the toner is stored or exposed at use, that is, not lower than 50° C. On the other hand, if the melting point is higher than 120° C., the low temperature fixing sometimes becomes difficult to be carried out. The toner to be employed for the present invention is preferable to have the melting point in a temperature range of 70 to 100° C.

The melting point of the above-described toner can be measured as the melting peak temperature of the input-compensating differential scanning calorimetry defined by JIS K-7121 in the case the measurement is carried out from a room temperature to 150° C. at a temperature increase rate of 10° C./min using a differential scanning calorimeter (DSC).

Incidentally, since the toner contains the crystalline resin as the main component which sometimes has a plurality of melting peaks and sometimes contains waxes, a plurality of melting peaks sometimes appear in the measurement and in such a case, the maximum peak is regarded as the melting point.

The toner to be employed for the present invention is required to have a sufficient hardness at a normal temperature. More practically, the dynamic viscoelasticity is preferable to satisfy the storage modulus $G_L(30)$ to be not less than $1\times10^6$ Pa and loss modulus to be $G_N(30)$ to be not less than $1\times10^6$ Pa at angular frequency of 1 rad/s and temperature of 30° C. Incidentally, the storage modulus $G_L$ and the loss modulus $G_N$ are standardized in details in JIS K-6900.

At the angular frequency of 1 rad/s and temperature of 30° C., if the storage modulus $G_L(30)$ is less than $1\times10^6$ Pa or the loss modulus $G_N(30)$ is less than $1\times10^6$ Pa, the toner particles are deformed by the pressure or the shearing force received from the carrier at the time when the toner is mixed with the carrier in a developer to make it impossible to maintain stable charging and developing characteristics in some cases. Further, when the toner on the surface of the latent image carrier (the photoreceptor) is cleaned out, the toner is deformed by the shearing force received from the cleaning blade to result in cleaning failure in some cases.

If the storage modulus $G_L(30)$ and the loss modulus $G_N(30)$ are in the above-described range, respectively, at the angular frequency of 1 rad/s and temperature of 30° C., that is preferable since the fixing characteristics are stabilized even in the case the toner is used for a high speed electrophotographic apparatus.

Further, the toner to be employed for the present invention is preferable to have the storage modulus $G_L(90)$ and the loss modulus $G_N(90)$ at angular frequency of 1 rad/s and temperature of 90° C. and the storage modulus $G_L(120)$ and the loss modulus $G_N(120)$ at angular frequency of 1 rad/s and temperature of 120° C. all to be not more than $1\times10^5$ Pa and a relation between the storage modulus $G_L(90)$ and the storage modulus $G_L(120)$ satisfying the following expression (1):

$$\log G_L(90)-\log G_L(120)<2 \qquad \text{expression (1)}$$

The storage modulus $G_L$ and the loss modulus $G_N$ are measured by using a rotary plate type rheometer (RDA 2RH IOS system Ver. 4. 3. 2, manufactured by Rheometric Scientific F. E. Company Ltd.).

The measurement is carried out at the temperature increase speed of 1° C./min, the frequency of 1 rad/s, the strain of not more than 20%, and a detection torque in a range of guaranteed measurement values while setting a sample in a sample holder. As necessary, the sample holder is changed to be 8 mm and 20 mm.

If $G_L(90)$ is not more than $1\times10^5$ Pa, fixing at a temperature as low as around 100° C. is possible. Further, that $\log G_L(90)-\log G_L(120)<2$ means the viscosity alteration to the temperature change after melting is small and it means uneven melting and uneven gloss hardly take place in images after fixation even if the temperature in a fixing apparatus is uneven. Of course it leads to prevention of occurrence of excess bleeding and off-set of the toner.

Further, the toner to be employed for the present invention is preferable to have the melt viscosity of not less than 100 Pa·s at 120° C. in order to make the off-set resistance high.

Figure 7:
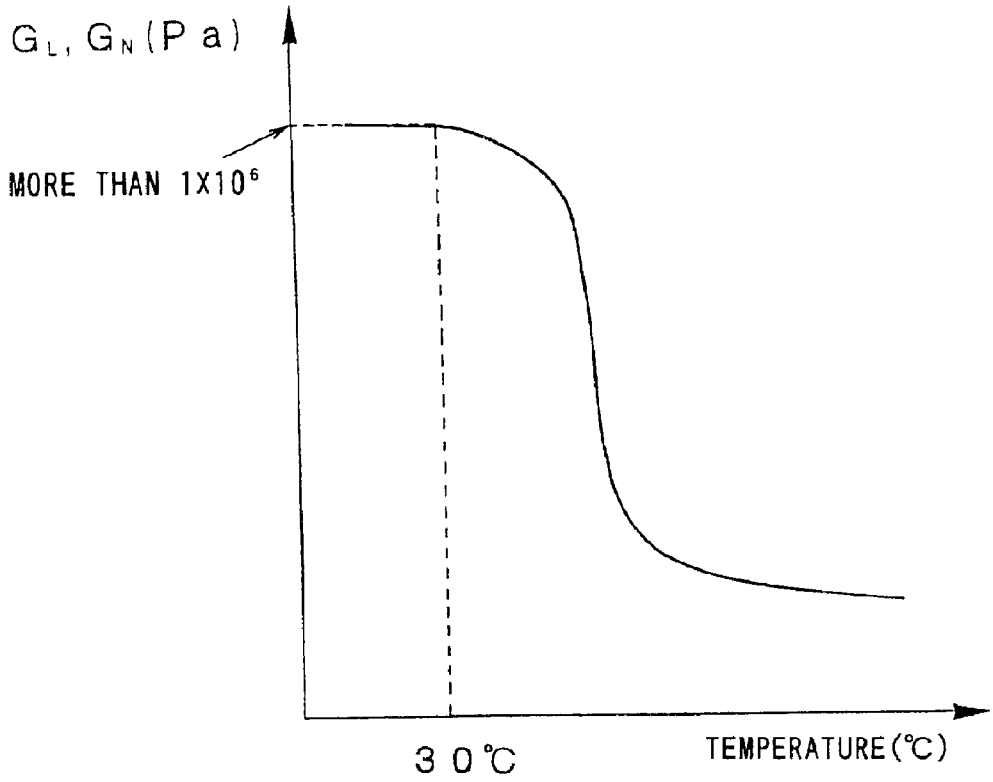
FIG. 7 is a graph showing a preferable property of a toner to be employed for the present invention and the axis of ordinates shows the common logarithms log $G_L$ of the storage modulus or the common logarithms log $G_N$ of the loss modulus and the axis of abscissas shows the temperature.

FIG. 7 shows a graph showing the preferable characteristics of the toner to be employed for the present invention. In FIG. 7, the axis of ordinates shows the common logarithm $\log G_L$ of the storage modulus or the common logarithm $\log G_N$ of the loss modulus and the axis of abscissas shows the temperature. A toner having such characteristics is found having a sharp elasticity modulus decrease at the melting point in the temperature region of 50 to 120° C. and a stable elasticity modulus in a prescribed range, so that even if the temperature becomes high at the time of fixation, the viscosity is not decreased unnecessarily and thus excess bleeding to an object recording medium such as paper and the like and occurrence of off-set can be prevented. Further, even if the temperature is uneven in the fixing apparatus, images almost free from uneven melting and uneven gloss can be obtained.

<Developing Agent>

The toner for electrophotography obtained in such a manner in the present invention can be used as a single-component developer as it is and for binary-component developer composed of a carrier and the toner. Hereinafter, the binary-component developer will be described.

A carrier usable for the above-described binary-component developer is not particularly restricted and any well-known carrier can be employed. For example, a resin-coated carrier comprising a resin coating layer on the surface of core material can be exemplified. Also, the carrier may be a resin dispersion type carrier comprising a matrix resin in which a conductive fine powder and the like are dispersed.

Examples of the coating resin, matrix resin to be used for the carrier are polyethylene, polypropylene, polystyrene, poly(vinyl acetate), polyvinyl alcohol, polyvinyl butyral, polyvinyl chloride, a polyvinyl ether, a polyvinyl ketone, a vinyl chloride-vinyl acetate copolymer, a styrene-acrylic acid copolymer, a straight silicone resin composed of organosiloxane bonds and its modified product, a fluoride resin, a polyester, a polycarbonate, a phenol resin, an epoxy resin, an urea resin, an urethane resin, a melamine resin and the like, and they are not restricted to these compounds.

Generally, the carrier is preferable to have a proper electric resistance value and in order to adjust the resistance, it is preferable to disperse a conductive fine powder in the above-described resin. As the conductive fine powder, usable examples are metals such as gold, silver, copper and the like, carbon black, and also titanium oxide, zinc oxide, barium sulfate, aluminum borate, potassium titanate, tin oxide and the like, and it is not restricted to these substances.

Further, as the core material of the carrier, examples are magnetic metals such as iron, nickel, cobalt and the like; magnetic oxides such as ferrite, magnetite and the like; glass beads and the like; and in order to make the carrier usable for a magnetic brush method, the core material is preferably a magnetic material. The volume-average particle diameter of the core material of the carrier is generally 10 to 500 $\mu$m and preferably 30 to 100 $\mu$m.

To form a resin coating on the surface of the core material of the carrier, the method to be employed for forming the coating is a method carried out using a solution for coating layer formation produced by dissolving the above-described coating resin and a variety of additives based on necessity in a proper solvent. The solvent is not particularly restricted and properly selected in consideration of the coating resin to be used and the coating suitability.

As a practical resin coating method, the methods applicable are an immersion method by immersing the powder of the core material of the carrier in a solution for coating layer formation; a spraying method by spraying the solution for coating layer formation to the surface of the core material of the carrier; a fluidized bed method for spraying the solution for coating layer formation while the core material of the carrier being floated by fluidizing air; a kneader coater method by mixing the solution for coating layer formation with the core material of the carrier in a kneader coater and then removing a solvent.

The mixing ratio (weight ratio) of the above-described toner and the above-described carrier in the binary-component developer is in a range of (1:100) to (30:100)= toner:carrier and preferably in a range of (3:100) to (20:100).

<Transferring Step>

The transferring step in the present invention is a step for forming a transferred image by transferring a toner image formed on the latent image carrier surface to an object recording medium. In the case of color image formation, it is preferable to primarily transfer respective toners to an intermediate transfer drum or belt and successively secondarily transfer to an object recording medium such as paper or the like.

As the transferring apparatus to transfer a toner image to paper or an intermediate transfer drum from a photoreceptor, corotron can be employed. The corotron is effective as means for evenly charging a sheet of paper, however voltage as high as several kV has to be applied in order to give electric charge to a sheet of paper, which is an object recording medium, and therefore a high voltage power source is required. Further, since ozone is generated by corona discharge, rubber units and the photoreceptor are deteriorated, so that it is preferable to employ a contact transferring method for transferring a toner image to a sheet of paper by bringing a conductive transfer roll made of an elastic material into contact with an image carrier by pressure.

The image formation method of the present invention is not particularly restricted regarding the transferring apparatus.

<Cleaning Step>

In the present invention, the cleaning step to be performed as necessary is a step of removing a toner, paper powder, and dust adhering to the latent image carrier surface by bringing a blade, a brush, a roll or the like into a direct contact with the latent image carrier surface.

The most commonly employed method is a blade cleaning method by pushing a rubber member of a polyurethane or the like against a photoreceptor. In contrast with that, there are other methods applicable; a magnetic brush method for recovering a toner by fixing a magnet in the inside and installing a rotatable cylindrical non-magnetic sleeve in the outer circumference and depositing a magnetic carrier on the sleeve and a method for removing a toner by making semiconductive resin fibers or animal hairs be roll-like shape in rotatable manner and applying bias with opposed polarity to that of the toner to the roll. For the former magnetic brush method, corotron for pretreatment may be installed for cleaning.

Further, a method using a permanent magnet fixed and installed in the inside and a brush implanted with fibers and so disposed as to be rotatable around the permanent magnet is also applicable. Moreover, a method using a rotatable sleeve made of a non-magnetic material and magnetic fibers implanted in the surface of sleeve is also applicable.

In the image formation method of the present invention, the cleaning method is not particularly restricted.

<Fixing Step>

The fixing step of the present invention is a step of fixing the toner image transferred to the object recording medium surface to a fixing apparatus. For the fixing apparatus, a heat fixing method using a heat roll is preferably employed. The heat fixing apparatus comprises a heater lamp for heating in the inside of a cylindrical core metal, a fuser roller provided with so-called releasing layer, which is heat resistant resin coating layer or a heat resistant rubber coating layer, in the outer circumference, and a pressurizing roller or a pressurizing belt so installed as to be pushed to the fuser roller and produced by forming a heat resistant elastic layer in the outer circumferential face of the cylindrical core metal. The fixing process for an un-fixed toner image is carried out by passing an object recording medium, on which the un-fixed toner image is formed, between the fuser roller and the pressurizing roller to fix the toner image by thermally melting the binder resin and the additives in the toner.

In the image formation method of the present invention, the fixing method is not particularly restricted.

As the object recording medium to transfer a toner image thereto, usable examples are ordinal paper to be used for an electrophotographic copying apparatus, a printer and the like; an OHP sheet and the like. In order to further improve the smoothness of the image surface after fixing, the surface of the above-described object recording medium is preferably also smooth as much as possible and coat paper obtained by coating ordinal paper surface with a resin or the like, art paper for printing, and the like are preferably used.

EXAMPLES

Hereinafter, the present invention will be described more particularly with the reference to examples, but the present invention is not at all restricted to these examples. Incidentally, in the following descriptions, the term, parts, all means parts by mass.

Production of Photoreceptor (1)

An EI processed aluminum cylindrical substrate with a diameter of 80 mm and a length of 340 mm was subjected to a honing treatment and the substrate surface was coated with a solution containing 20 parts of a zirconium compound (trade name: ORGANOTIX ZC 540, produced by Matsumoto Seiyaku Kogyo K.K.), 2.5 parts of a silane compound (trade name: A1100, produced by Nippon Unicar Co., Ltd.), 7 parts of a polyvinyl butyral resin (trade name: S-LEC BM-S, produced by Sekisui Chem. Co., Ltd.) and 45 parts of butanol by a dip coating method and dried by heating at 150° C. for 10 minutes to form an underlayer with a thickness of 1.0 $\mu$m.

After 1 part of chlorogallium phthalocyanine having strong diffraction peaks of Bragg angle (20±0.2°) of 7.4°, 16.6°, 25.5°, and 28.3° in the x-ray diffraction spectrum was mixed with 100 parts of n-butyl acetate and dispersed together with glass beads by a paint shaker for 1 hour, the obtained coating solution was applied to the underlayer on the surface of the above-described cylindrical substrate made of aluminum by dip coating and dried by heating at 100° C. for 10 minutes to form a charge generating layer with a thickness of about 0.15 $\mu$m.

A coating solution obtained by dissolving 2 parts of a benzidine compound of the exemplified compound (V-27) and 3 parts of a polymer compound (the viscosity average molecular weight 39,000) defined by the following basic unit 1 as the repeating unit in 20 parts of chlorobenzene was applied to the above-described charge generating layer by a dip coating method and heated at 110° C. for 40 minute to form a charge transporting layer with a thickness of 20 $\mu$m.

Basic unit 1

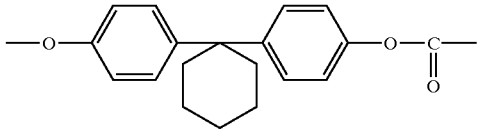

Two parts of exemplified compound (261), 2 parts of methyltrimethoxysilane, 0.5 parts of tetramethoxysilane, and 0.3 parts of colloidal silica were dissolved 5 parts of isopropyl alcohol, 3 parts of tetrahydrofuran, and 0.3 parts of distilled water and after 0.5 parts of an ion exchange resin (AMBERLYST 15E) was added, the resulting solution was stirred at a room temperature to carry out hydrolysis for 24 hours.

To 2 parts of the liquid obtained by separating the ion exchange resin from the hydrolyzed products by filtration, 0.04 parts of aluminum trisacetylacetonate and 0.1 parts of 3,5-di-tert-butyl-4-hydroxytoluene (BHT) were added to produce a surface protective layer coating solution. The coating solution was applied to the above-described charge transporting layer by a ring type dip coating method. After air drying at a room temperature for 30 minutes, curing was carried out at 170° C. for 1 hour to form a surface protective layer with a thickness of about 3 $\mu$m arid thus the photoreceptor (1) was produced.

Production of Photoreceptor (2)

A base photoreceptor was produced in the same manner to the charge transporting layer formation as Example 1. Ten parts of exemplified compound (III-13) and 4 parts of methyl-phenylsiloxane were dissolved 20 parts of isopropyl alcohol, 20 parts of tetrahydrofuran, and 0.5 parts of distilled water and after 0.5 parts of an ion exchange resin (AMBERLYST 15E) was added, the resulting solution was stirred at a room temperature to carry out hydrolysis for 2 hours. To the resulting solution, 8 parts of 4,4'-dihydroxymethyltriphenylamine and 0.2 parts of aluminum trisacetylacetonate were added to obtain a uniform solution. Further, 0.3 parts of BHT was added to the resulting solution to produce a surface protective layer coating solution. After the coating solution was applied to the above-described charge transporting layer in the same manner as Example 1, heat curing was carried out at 150° C. for 1 hour to form a surface protective layer with a dry film thickness of 4 $\mu$m and thus the photoreceptor (2) was produced.

Production of Photoreceptor (3)

A photoreceptor (3) was produced in the same manner as the photoreceptor (1) except that no surface protective layer was formed in the production of the photoreceptor (1).

Synthesis of Polyester Resin (1) (Crystalline)

After a heat-dried three neck distillation flask was charged with 497 parts of ethylene glycol, 23.7 parts of sodium dimethyl 5-sulfoisophthalate, 22.8 parts of dimethyl fumarate, 857 parts of dimethyl sebacate, and 0.4 parts of dibutyltin oxide as a catalyst, the air in the container was replaced with nitrogen gas to keep the inside in an inert atmosphere by pressure decreasing operation and these compounds were stirred at 180° C. for 5 hours by mechanical stirring. After that, the temperature was gradually increased to 220° C. in decreased pressure and stirring was carried out for 2 hours and when the mixture became viscous, the mixture was air cooled and the reaction was stopped to synthesize 985 parts of the polyester resin (1).

By the molecular weight measurement by gel permeation chromatography (on the basis of polystyrene), the weight average molecular weight (Mw) of the obtained polyester resin (1) was found 8,500 and the number average molecular weight ($M_n$) was found 3,700.

The melting point (Tm) of the polyester resin (1) was measured by the above-described measurement method using a differential scanning calorimeter (DSC) to find the resin have clear peaks and the temperature of the peak top be 72° C.

The content ratios of copolymer synthesizing components; 5-sulfoisophthalic acid component, fumaric acid component, and sebacic acid component; were found to be 2:5:93, respectively, by measurement by NMR spectrum of the resin and calculation.

Synthesis of Polyester Resin (2) (Crystalline)

After a heat-dried three neck distillation flask was charged with 214 parts of dimethyl sebacate, 174 parts of 1,10-decanediol, 6 parts of sodium dimethyl 5-sulfoisophthalate, 7.2 parts of dimethyl fumarate, 40 parts of dimethyl sulfoxide, and 0.1 parts of dibutyltin oxide as a catalyst, the air, in the container was replaced with nitrogen gas to keep the inside in an inert atmosphere by pressure decreasing operation and these compounds were stirred at 180° C. for 5 hours by mechanical stirring. After that, dimethyl sulfoxide was removed by distillation and then the temperature was gradually increased to 220° C. in decreased pressure and stirring was carried out for 2 hours and when the mixture became viscous, the mixture was air cooled and the reaction was stopped to synthesize 276 parts of the polyester resin (2).

By the molecular weight measurement by gel permeation chromatography (on the basis of polystyrene), the weight average molecular weight ($M_w$) of the obtained polyester resin (2) was found 8,800 and the number average molecular weight ($M_n$) was found 4,600.

The melting point (Tm) of the polyester resin (2) was measured by the above-described measurement method using a differential scanning calorimeter (DSC) to find the resin have clear peaks and the temperature of the peak top be 76° C.

The content ratios of copolymer synthesizing components; 5-sulfoisophthalic acid component, fumaric acid component, and sebacic acid component; were found to be 2:5:93, respectively, by measurement by NMR spectrum of the resin and calculation.

Synthesis of Polyester Resin (3) (Non-Crystalline)

After a heat-dried two neck distillation flask was charged with 194 parts of dimethyl terephthalate, 90 parts of 1,3-butanediol, and 0.3 parts of dibutyltin oxide as a catalyst, the air in the container was replaced with nitrogen gas to keep the inside in an inert atmosphere by pressure decreasing operation and these compounds were stirred at 180° C. for 5 hours by mechanical stirring. After that, the temperature was gradually increased to 230° C. in decreased pressure and stirring was carried out for 2 hours and when the mixture became viscous, the mixture was air cooled and the reaction was stopped to synthesize 240 parts of a non-crystalline polyester resin (3) (a non-crystalline polyester resin containing the acid-derived constitutional component containing the aromatic dicarboxylic acid-derived constitutional component in 100% by constitutional mole and an alcohol-derived constitutional component containing the aliphatic diolderived constitutional component in 100% by constitutional mole).

By the molecular weight measurement by gel permeation chromatography (on the basis of polystyrene), the weight average molecular weight (Mw) of the obtained polyester resin (3) was found 9,500 and the number average molecular weight ($M_a$) was found 4,200.

Further, the DSC spectrum of the non-crystalline polyester resin (3) was measured in the same manner as the above-described melting point measurement method using a differential scanning calorimeter (DSC) to find no clear peak exist and step-by-step heat absorption quantity change was observed. The glass transition point, which was the mean point of the step-by-step heat absorption quantity change, was found to be 49° C.

Synthesis of Polyester Resin (4) (Noncrystalline)

After a heat-dried two neck distillation flask was charged with 94 parts of polyoxyethylene(2,0)-2,2-bis(4-hydroxyphenyl)propane and 192 parts of polyoxypropylene (2,2)-2,2-bis(4-hydroxyphenyl)propane (constitutional mole ratio: 35/65) as diol components; 114 parts of terephthalic acid, 28 parts of n-dodecenylsuccinic acid, 19 parts of trimellitic acid (constitutional mole ratio: 80/10/10) as dicarboxylic acid components; and 0.12 parts (0.0005 mole to the total number of moles of all of the acid components) of dibutyltin oxide, nitrogen gas was introduced into the container to keep the inside in an inert atmosphere and the temperature was increased and successively condensation copolymerization reaction was carried out at 150 to 230° C. for about 12 hours and after that, the pressure was gradually decreased at 210 to 250° C. to synthesize 350 parts of a non-crystalline polyester resin (4).

By the molecular weight measurement by gel permeation chromatography (on the basis of polystyrene), the weight average molecular weight ($M_W$) of the obtained polyester resin (4) was found 15,400 and the number average molecular weight ($M_n$) was found 6,800.

Further, the DSC spectrum of the non-crystalline polyester resin (4) was measured in the same manner as the above-described melting point measurement method using a differential scanning calorimeter (DSC) to find no clear peak exist and step-by-step heat absorption quantity change was observed. The glass transition point, which was the mean point of the step-by-step heat absorption quantity change, was found to be 65° C.

Production of Toner (1) (Emulsifying and Aggregation Method)

<Production of Resin Particle Dispersion (1)>

Eighty parts of the above-described crystalline polyester resin (1) and 0.4 parts of sodium dodecylbenzenesulfonate were added to 720 parts of distilled water and mixed and stirred by a homogenizer (ULTRATRAX, manufactured by IKA Japan Co.) while being heated at 80° C. to obtain a resin particle dispersion (1).

<Production of Coloring Agent Dispersion (1)>

After 250 parts of a phthalocyanine pigment (PV FAST BLUE; produced by Dainichiseika Color & Chemicals Mfg. Co., Ltd.), 20 parts of an anionic surfactant (NEOGEN RK; produced by Dai-Ichi Kogyo Seiyaku Co., Ltd.), and 730 parts of ion exchanged water were mixed and dissolved and the mixture was dispersed by a homogenizer (ULTRATRAX; manufactured by IKA Japan Co.,) to produce a coloring agent dispersion (1) containing the dispersed coloring agent (the phthalocyanine pigment).

<Production of Releasing Agent Dispersion (1)>

A hundred parts of candelilla wax, 25 parts of an anionic surfactant (NEOGEN RK; produced by Dai-Ichi Kogyo Seiyaku Co., Ltd.), and 200 parts of ion exchanged water were mixed and the mixture was dispersed by a homogenizer (ULTRATRAX; manufactured by IKA Japan Co.,) to produce a releasing agent dispersion (1).

<Aggregation and Fusion Step>

A round type flask made of a stainless was charged with 800 parts of the resin particle dispersion (1), 5 parts of the coloring agent dispersion (1), 17 parts of the releasing agent dispersion (1), 1.4 parts of aluminum sulfate (produced by Wako Pure Chemical Industries, Ltd.), and 0.08 parts of a 50% emulsion of tert-hexyl perpivalate (produced by Nippon Oil & Fats Co., Ltd.) and after the pH was adjusted to be 3.0, the mixture was dispersed by a homogenizer (ULTRATRAX T 50, manufactured by IKA Japan Co.) and heated to 65° C. in an oil bath for heating while being stirred. After being kept at 65° C. for 3 hours, the mixture was observed by an optical microscope to find that aggregated particles with an average particle diameter of about 7.0 μm were formed. The temperature was increased to 69° C.; the pH was increased to 4.0; and stirring was continuously carried out for 30 minutes. After that, the temperature was increased to 80° C., stirring was continued for 1 hour. Observation by an optical microscope made it clear that toner particles with an average particle diameter of about 7.2 μm were produced.

After that, the reaction product was filtered and sufficiently washed with ion exchanged water and successively dried using a vacuum drier to obtain a toner (1).

Regarding the toner (1), the average particle diameter was measured by a COULTER COUNTER [TA-II] model (the aperture diameter: 50 μm, manufactured by Coulter Co.) to find the volume-average particle diameter of 7.8 μm and the number-average particle diameter of 7.3 μm.

Production of Toner (2) (Emulsifying and Aggregation Method)

<Production of Resin Particle Dispersion (2)>

Eighty parts of the above-described crystalline polyester resin (1) and 0.4 parts of sodium dodecylbenzenesulfonate were added to 720 parts of distilled water and mixed and stirred by a homogenizer (ULTRATRAX, manufactured by IKA Japan Co.) while being heated at 90° C. to obtain a resin particle dispersion (1).

<Aggregation and Fusion Step>

A round type flask made of a stainless was charged with 800 parts of the resin particle dispersion (1), 5 parts of the coloring agent dispersion (1), 17 parts of the releasing agent dispersion (1), 1.4 parts of aluminum sulfate (produced by Wako Pure Chemical Industries, Ltd.), and 0.04 parts of a 50% emulsion of tert-hexyl perpivalate (produced by Nippon Oil & Fats Co., Ltd.) and after the pH was adjusted to be 3.0, the mixture was dispersed by a homogenizer (ULTRATRAX T 50, manufactured by IKA Japan Co.) and heated to 65° C. in an oil bath for heating while being stirred. After being kept at 70° C. for 3 hours, the mixture was observed by an optical microscope to find that aggregated particles with an average particle diameter of about 6.8 μm were formed. The temperature was increased to 76° C.; the pH was increased to 4.0; and stirring was continuously carried out for 30 minutes. After that, the temperature was increased to 83° C., stirring was continued for 1 hour. Observation by an optical microscope made it clear that toner particles with an average particle diameter of about 7.3 μm were produced.

After that, the reaction product was filtered and sufficiently washed with ion exchanged water and successively dried using a vacuum drier to obtain a toner (2).

Regarding the toner (2), the average particle diameter was measured by a COULTER COUNTER [TA-II] model (the aperture diameter: 50 μm, manufactured by Coulter Co.) to find the volume-average particle diameter of 7.8 μm and the number-average particle diameter of 7.3 μm.

Production of Toner (3) (Emulsifying and Aggregation Method)

<Production of Resin Particle Dispersion (3)>

Eighty parts of the above-described crystalline polyester resin (2) and 0.4 parts of sodium dodecylbenzenesulfonate were added to 720 parts of distilled water and mixed and stirred by a homogenizer (ULTRATRAX, manufactured by IKA Japan Co.) while being heated at 90° C. to obtain a resin particle dispersion (3).

<Aggregation and Fusion Step>

A round type flask made of a stainless was charged with 800 parts of the resin particle dispersion (3), 5 parts of the coloring agent dispersion (1), 17 parts of the releasing agent dispersion (1), 1.4 parts of aluminum sulfate (produced by Wako Pure Chemical Industries, Ltd.), and 0.08 parts of a 50% emulsion of tert-hexyl perpivalate (produced by Nippon Oil & Fats Co., Ltd.) and after the pH was adjusted to be 3.0, the mixture was dispersed by a homogenizer (ULTRATRAX T 50, manufactured by IKA Japan Co.) and heated to 65° C. in an oil bath for heating while being stirred. After being kept at 70° C. for 3 hours, the mixture was observed by an optical microscope to find that aggregated particles with an average particle diameter of about 6.8 μm were formed. The temperature was increased to 76° C.; the pH was increased to 4.0; and stirring was continuously carried out for 30 minutes. After that, the temperature was increased to 83° C., stirring was continued for 1 hour. Observation by an optical microscope made it clear that toner particles with an average particle diameter of about 7.0 μm were produced.

After that, the reaction product was filtered and sufficiently washed with ion exchanged water and successively dried using a vacuum drier to obtain a toner (3).

Regarding the toner (3), the average particle diameter was measured by a COULTER COUNTER [TA-II] model (the aperture diameter: 50 μm, manufactured by Coulter Co.) to find the volume-average particle diameter of 7.6 μm and the number-average particle diameter of 7.0 μm.

Production of Toner (4) (Dissolving and Suspending Method)

Eighty six parts of the above-described non-crystalline polyester resin (3) and 16 parts of copper phthalocyanine pigment (C.I. Pigment Blue 15:3) were melted and kneaded by a Banbury mixer to obtain a high concentration colored resin composition. A dispersion was produced by dispersing and dissolving 25 parts of the colored resin composition and 75 parts of the polyester resin (3) in 100 parts of ethyl acetate.

The obtained dispersion was added to a mixed solution of 1 part of carboxymethyl cellulose, 20 parts of calcium carbonate, and 100 parts of water and dispersed by a high speed stirring by a mixer to obtain an emulsion. The emulsion was moved to a beaker and water in about 5 times much amount was added and while being stirred, the resulting mixture was kept at 45° C. in a bath for 10 hours to evaporate ethyl acetate. After calcium carbonate was dissolved in hydrochloric acid and water washing was repeated, a mixture of water and a toner was obtained. Finally, water was evaporated by a freeze drying apparatus to produce a toner (4).

Regarding the toner (4), the average particle diameter was measured by a COULTER COUNTER [TA-II] model (the aperture diameter: 50 μm, manufactured by Coulter Co.) in the same manner as Example 1 to find the volume-average particle diameter of 7.9 μm and the number-average particle diameter of 7.3 μm.

Production of Toner (5) (Dissolving and Suspending Method)

Eighty six parts of the above-described polyester resin (4) and 16 parts of copper phthalocyanine pigment (C.I. Pigment Blue 15:3) were melted and kneaded by a Banbury mixer to obtain a high concentration colored resin composition. A dispersion was produced by dispersing and dissolving 25 parts of the colored resin composition and 75 parts of the polyester resin (4) in 100 parts of ethyl acetate.

The obtained dispersion was added to a mixed solution of 1 part of carboxymethyl cellulose, 20 parts of calcium carbonate, and 100 parts of water and dispersed by a high speed stirring by a mixer to obtain an emulsion. The emulsion was moved to a beaker and water in about 5 times much amount was added and while being stirred, the resulting mixture was kept at 45° C. in a bath for 10 hours to evaporate ethyl acetate. After calcium carbonate was dissolved in hydrochloric acid and water washing was repeated, a mixture of water and a toner was obtained. Finally, water was evaporated by a freeze drying apparatus to produce a toner (5).

Regarding the toner (5), the average particle diameter was measured by a COULTER COUNTER [TA-II] model (the aperture diameter: 50 μm, manufactured by Coulter Co.) in the same manner as Example 1 to find the volume-average particle diameter of 7.9 μm and the number-average particle diameter of 7.3 μm.

<Toner Viscoelasticity>

The viscoelasticity of the above-described toners of five kinds was measured. The storage modulus $G_L$ and the loss modulus $G_N$ were measured by using a rotary plate type rheometer (RDA 2RH IOS system Ver. 4. 3. 2, manufactured by Rheometric Scientific F. E. Company Ltd.).

The measurement was carried out at the temperature increase speed of 1° C./min (from a room temperature to 160° C.), the frequency of 1 rad/s, the strain of not more than 20%, and a detection torque in a range of guaranteed measurement values while setting a sample in a sample holder.

As necessary, the sample holder is changed to be 8 mm and 20 mm. The values calculated by dividing the loss modulus $G_N$ at 120° C. by the measured frequency 1 rad/s for the obtained toners (1) to (5) and the values were represented by the melt viscosity of the respective toners at 120° C. The results were shown together with the ester concentrations in Table 62.

TABLE 62

| | toner (1) | toner (2) | toner (3) | toner (4) | toner 5 |
|---|---|---|---|---|---|
| $G_L(90)$ (Pa) | 1050 | 1000 | 5000 | $1 \times 10^5$ | $2 \times 10^5$ |
| $G_N(90)$ (Pa) | 1050 | 700 | 3000 | $1.2 \times 10^5$ | $3 \times 10^5$ |
| $G_L(120)$ (Pa) | 500 | 60 | 5000 | 80 | 200 |
| $G_N(120)$ (Pa) | 800 | 300 | 3000 | 800 | 6000 |
| Log $G_L(90)$–Log $G_L(120)$ | 0.32 | 1.22 | 0 | 4.1 | 3 |

TABLE 62-continued

| | toner (1) | toner (2) | toner (3) | toner (4) | toner 5 |
|---|---|---|---|---|---|
| ester concentration M | 0.12 | 0.12 | 0.08 | 0.125 | 0.067 |
| melt viscosity at 120° C. (Pa·s) | 800 | 300 | 3000 | 800 | 6000 |

<Developer>

To the above-described toners (1) to (5), 1% by mass of hydrophobic silica R 972 (produced by Nippon Aerosil Co., Ltd.) was added by extra-addition and the respective toners and a carrier (Carrier for ACOLOR 630; particle diameter of 50 $\mu$m; manufactured by Fuji Xerox Co., Ltd.) were mixed in a toner concentration of 10% by mass to obtain binary-component developers (1) to (5).

<Image Forming Apparatus>

As an image forming apparatus, partially modified ACOLOR-935 manufactured by Fuji Xerox Co., Ltd. and whose constitutional figure is illustrated in FIG. 1 was employed. The photoreceptor of the apparatus and the developer were replaced respectively with the above-described obtained photoreceptors and developers and the fixing apparatus was set at 120° C.

Example 1

The photoreceptor (1) was installed in ACOLOR-935 and the developer (1) was set in a developing apparatus and at the time a solid image (5×4 cm, 20 $cm^2$) were developed on the photoreceptor surface, the machine was stopped and the developed toner on the photoreceptor surface was completely sampled with a tape and the weight of the developed toner was measured. On the other hand, the same image was developed on the photoreceptor surface and the toner image was transferred to paper, and then the machine was stopped and the weight of the un-fixed toner on the surface of the paper was measured to measure the transferred toner weight. The transferring efficiency was calculated from the following expression to find that the efficiency was 95%.

the transferring efficiency (%)=[transferred toner weight (*mg*)/developed toner weight (*mg*)]×100.

After that, a test pattern image was printed 100,000 times, the transferring efficiency was measured again to find the efficiency was 85%. The results were shown in Table 63.

Example 2

The transferring efficiency was measured at the beginning and after 100,000 times printing in the same manner as Example 1, except the developer 2 was used in place of the development 1 in Example 1. The results were shown in Table 63.

Example 3

The transferring efficiency was measured at the beginning and after 100,000 times printing in the same manner as Example 1, except the developer 3 was used in place of the development 1 in Example 1. The results were shown in Table 63.

Example 4

The transferring efficiency was measured at the beginning and after 100,000 times printing in the same manner as Example 1, except the photoreceptor 2 was used in place of the photoreceptor 1 in Example 1. The results were shown in Table 63.

Example 5

The transferring efficiency was measured at the beginning and after 100,000 times printing in the same manner as Example 1, except the developer 2 was used in place of the development 1 and the photoreceptor 2 was used in place of the photoreceptor 1 in Example 1. The results were shown in Table 63.

Example 6

The transferring efficiency was measured at the beginning and after 100,000 times printing in the same manner as Example 1, except the photoreceptor 2 was used in place of the photoreceptor 1 and the developer 3 was used in place of the developer 1 in Example 1. The results were shown in Table 63.

Comparative Example 1

The transferring efficiency was measured at the beginning and after 100,000 times printing in the same manner as Example 1, except the developer 4 was used in place of the developer 1 in Example 1. The results were shown in Table 63. Incidentally, during printing repeated 100,000 times, at the fixing temperate of 120° C., cold off-set took place in the image, so that the measurement was carried out while the temperature of the fixing apparatus being set at 160° C.

Comparative Example 2

The transferring efficiency was measured at the beginning and after 100,000 times printing in the same manner as Example 1, except the developer 5 was used in place of the developer 1 in Example 1. The results were shown in Table 63. Incidentally, during printing repeated 100,000 times, the measurement was carried out while the temperature of the fixing apparatus being set at 160° C. same as that in Comparative Example 1.

Comparative Example 3

The transferring efficiency was measured at the beginning and after 100,000 times printing in the same manner as Example 1, except the photoreceptor 2 was used in place of the photoreceptor 1 and the developer 5 was used in place of the developer 1 in Example 1. The results were shown in Table 63. Incidentally, during printing repeated 100,000 times, the measurement was carried out while the temperature of the fixing apparatus being set at 160° C. same as that in Comparative Example 1.

Comparative Example 4

The transferring efficiency was measured at the beginning and after 100,000 times printing in the same manner as Example 1, except the photoreceptor 3 was used in place of the photoreceptor 1 in Example 1. The results were shown in Table 63.

Comparative Example 5

The transferring efficiency was measured at the beginning and after 100,000 times printing in the same manner as Example 1, except the photoreceptor 3 was used in place of the photoreceptor 1 and the developer 5 was used in place of the developer 1 in Example 1. The results were shown in Table 63. During printing repeated 100,000 times, the measurement was carried out while the temperature of the fixing apparatus being set at 160° C. same as that in Comparative Example 1.

Incidentally, in Comparative Example 4 and Comparative Example 5, after 100,000 times printing, stripe-like and dot-like scratches were many found formed on the photoreceptor surface and image defects supposedly attributed to that took place.

TABLE 63

| | photoreceptor employed | developer employed | initial transferring efficiency (%) | fixing apparatus temperature at printing (° C.) | transferring efficiency after 100,000 times printing (%) |
|---|---|---|---|---|---|
| Example 1 | photoreceptor 1 | developer 1 | 95 | 120 | 85 |
| Example 2 | photoreceptor 1 | developer 2 | 94 | 120 | 85 |
| Example 3 | photoreceptor 1 | developer 3 | 95 | 120 | 83 |
| Example 4 | photoreceptor 2 | developer 1 | 93 | 120 | 85 |
| Example 5 | photoreceptor 2 | developer 2 | 95 | 120 | 84 |
| Example 6 | photoreceptor 2 | developer 3 | 95 | 120 | 83 |
| Comparative Example 1 | photoreceptor 1 | developer 4 | 83 | 160 | 64 |
| Comparative Example 2 | photoreceptor 1 | developer 5 | 80 | 160 | 60 |
| Comparative Example 3 | photoreceptor 2 | developer 5 | 82 | 160 | 63 |
| Comparative Example 4 | photoreceptor 3 | developer 1 | 88 | 120 | 77 |
| Comparative Example 5 | photoreceptor 3 | developer 5 | 82 | 160 | 65 |

Based on the results in Table 63, it was found from the Examples 1 to 6 that an initial transferring efficiency as high as not less than 93% could be achieved by combining photoreceptors (photoreceptors (1) and (2)) bearing an overcoating of resin having siloxane bonds with developers (developers (1) to (3)) using toners containing crystalline resin and that the degree of the decrease of the transferring efficiency even after 100,000 times printing was as slight as about 10%. On the other hand, from Comparative Examples, the transferring efficiency was sometimes decreased by either using photoreceptors without an overcoating as the photoreceptor or developers (the developers (4) and (5)) using a conventional toner of a non-crystalline resin as the developer.

According to the present invention, an electrophotographic photoreceptor with excellent wear resistance and high durability can be provided and at the same time an image formation method having a high toner transferring efficiency and capable of providing images with high quality can be provided.

What is claimed is:

1. A method for forming an image, the method comprising the steps of:

developing an electrostatic latent image on a latent image carrier surface with a developer including at least a toner to form a toner image, the latent image carrier including a surface layer which includes a cross-linked resin that is capable of transporting charge, and the toner including at least a coloring agent and a binder resin which includes a crystalline resin as a main component;

transferring the toner image from the latent image carrier surface to an object recording medium surface to form a transferred image; and fixing the transferred toner image on the object recording medium surface;

wherein the toner has a storage modulus $G_L(90)$ for an angular frequency of 1 rad/s at 90° C., a loss modulus $G_N(90)$ for an angular frequency of 1 rad/s at 90° C., a storage modulus $G_L(120)$ for an angular frequency of 1 rad/s at 120° C. and a loss modulus $G_N(120)$ for an angular frequency of 1 rad/s at 120° C. which are respectively not more than $1\times10^5$ Pa, the storage modulus $G_L(90)$ and the storage modulus $G_L(120)$ satisfying the following expression (1):

$$\log G_L(90)-\log G_L(120)<2 \qquad \text{Expression (1).}$$

2. The method of claim 1, wherein the cross-linked resin included in the surface layer of the latent image carrier comprises a resin that includes siloxane bonds.

3. The method of claim 2, wherein the resin that includes siloxane bonds comprises a compound represented by the following general formula (I):

$$F—(D—A)_b \qquad \text{General formula (I)}$$

in which F represents an organic group derived from a photo-functional compound; D represents a flexible organic subunit; A is selected from substituent silicon groups represented by $—Si(R_1)_{(3-a)}Q_a$, in which $R_1$ is selected from the group consisting of hydrogen, alkyl groups, substituted aryl groups and unsubstituted aryl groups, Q is selected from hydrolyzable groups, and a represents an integer of 1 to 3; and b represents an integer of 1 to 4.

4. The method of claim 3, wherein the organic group derived from a photo-functional compound F comprises an organic group derived from a compound represented by the following general formula (II):

General formula (II)

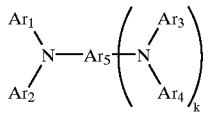

in which $Ar_1$, $Ar_2$, $Ar_3$ and $Ar_4$ each independently are selected from the group consisting of substituted aryl groups and unsubstituted aryl groups; $Ar_5$ is selected from the group consisting of substituted aryl groups, unsubstituted aryl groups, substituted arylene groups and unsubstituted arylene groups; at least one and at most four of the groups $Ar_1$, $Ar_2$, $Ar_3$, $Ar_4$ and $Ar_5$ has a bond capable of bonding with the group represented by —D—A in general formula (I); and k represents 0 or 1.

5. The method of claim 3, wherein the surface layer of the latent image carrier further comprises a compound including a group capable of bonding with the compound represented by general formula (I).

6. The method of claim 5, wherein the compound including a group capable of bonding with the compound represented by general formula (I) comprises an organosilicic compound represented by the following general formula (III):

$$B—(—A')_n \qquad \text{General formula (III)}$$

in which A' represents a hydrolysable substituent silicon group selected from the group consisting of $—Si(R_1)_{(3-a)}Q_a$; B represents a group selected from the group consisting of n-valent hydrocarbon groups, n-valent hydrocarbon groups having branches, n-valent phenyl groups, —NH—, —O—Si— and groups structured by a combination of groups selected therefrom; and n represents an integer of at least 2.

7. The method of claim 1, wherein the crystalline resin included as a main component in the binder resin comprises a crystalline polyester resin.

8. The method of claim 7, wherein the crystalline polyester resin comprises a polymer with an ester concentration M, as defined by the following expression (2), in a range from 0.01 to 0.2:

$$M=K/N \qquad \text{Expression (2)}$$

wherein M represents the ester concentration; K represents the number of ester groups in the polymer; and N represents the number of atoms in the polymer chain of the polymer.

9. The method of claim 1, wherein the crystalline resin included as a main component in the binder resin has a melting point of from 50 to 120° C.

10. The method of claim 1, wherein the toner has a melt viscosity at 120° C. of at least 100 Pa·s.

11. The method of claim 1, wherein the toner is produced by a method comprising at least one production method selected from the group consisting of emulsifying and aggregation methods, dissolving and suspending methods and melting and suspending methods.

* * * * *